US009255500B2

(12) United States Patent
Hayashi et al.

(10) Patent No.: US 9,255,500 B2
(45) Date of Patent: Feb. 9, 2016

(54) VALVE TIMING CONTROL APPARATUS

(71) Applicant: DENSO CORPORATION, Kariya, Aichi-pref. (JP)

(72) Inventors: Masashi Hayashi, Okazaki (JP); Tomonori Suzuki, Kariya (JP); Isao Hattori, Gifu (JP)

(73) Assignee: DENSO CORPORATION, Kariya (JP)

( * ) Notice: Subject to any disclaimer, the term of this patent is extended or adjusted under 35 U.S.C. 154(b) by 33 days.

(21) Appl. No.: 14/479,380

(22) Filed: Sep. 8, 2014

(65) Prior Publication Data

US 2014/0373796 A1 Dec. 25, 2014

Related U.S. Application Data

(62) Division of application No. 14/041,297, filed on Sep. 30, 2013, now Pat. No. 8,904,980.

(30) Foreign Application Priority Data

Sep. 28, 2012 (JP) ..... 2012-216440
Sep. 28, 2012 (JP) ..... 2012-216469
Jun. 20, 2013 (JP) ..... 2013-129539

(51) Int. Cl.
*F01L 1/34* (2006.01)
*F01L 1/344* (2006.01)

(52) U.S. Cl.
CPC ..... *F01L 1/3442* (2013.01); *F01L 1/344* (2013.01); *F01L 2001/34433* (2013.01); *F01L 2001/34479* (2013.01); *F01L 2101/00* (2013.01); *F01L 2820/031* (2013.01)

(58) Field of Classification Search
CPC ..... F01L 1/344; F01L 1/3442; F01L 2001/34433; F01L 2001/34479
USPC ..... 123/90.15, 90.17
See application file for complete search history.

(56) References Cited

U.S. PATENT DOCUMENTS

| | | | |
|---|---|---|---|
| 6,173,688 | B1 | 1/2001 | Fukuhara et al. |
| 8,904,980 | B2 * | 12/2014 | Hayashi et al. |
| 2009/0159025 | A1 | 6/2009 | Kimura et al. |
| 2014/0090612 | A1 | 4/2014 | Hayashi et al. |

FOREIGN PATENT DOCUMENTS

| | | |
|---|---|---|
| JP | 10-159518 | 6/1998 |
| JP | 11-081928 | 3/1999 |
| JP | 11-311109 | 11/1999 |
| JP | 2000-161028 | 6/2000 |

(Continued)

OTHER PUBLICATIONS

Hayashi et al., U.S. Appl. No. 14/041,343, filed Sep. 30, 2013.

(Continued)

*Primary Examiner* — Ching Chang
(74) *Attorney, Agent, or Firm* — Nixon & Vanderhye PC

(57) ABSTRACT

A resin member may include a first side wall, which is placed between a first housing and a laminated body, and a second side wall, which is placed between a second housing and the laminated body. A vane rotor may include a pressing oil passage that is configured to guide hydraulic oil to a first seal member and a second seal member to exert a pressing force, which radially outwardly and axially urge the first seal member and the second seal member.

15 Claims, 49 Drawing Sheets

(56) References Cited

FOREIGN PATENT DOCUMENTS

| | | |
|---|---|---|
| JP | 2001-234713 | 8/2001 |
| JP | 2002-097910 | 4/2002 |
| JP | 2003-262109 | 9/2003 |
| JP | 2004-346780 | 12/2004 |
| JP | 2005-344586 | 12/2005 |
| JP | 2005-351182 | 12/2005 |
| JP | 2009-222024 | 10/2009 |
| JP | 2010-174700 | 8/2010 |
| JP | 2010-275962 | 12/2010 |

OTHER PUBLICATIONS

Office Action (2 pages) dated Sep. 9, 2014, issued in corresponding Japanese Application No. 2012-216469 and English translation (4 pages).

Office Action (3 pages) dated Sep. 30, 2014, issued in corresponding Japanese Application No. 2013-219539 and English translation (5 pages).

* cited by examiner

VALVE TIMING CONTROL APPARATUS

CROSS REFERENCE TO RELATED APPLICATION

This application is a Divisional of application Ser. No. 14/041,297, filed Sep. 30, 2013, which claims priority to Japanese Patent Application No. 2012-216440 filed on Sep. 28, 2012, Japanese Patent Application No. 2012-216469 filed on Sep. 28, 2012 and Japanese Patent Application No. 2013-129539 filed on Jun. 20, 2013, the disclosures of each of which are incorporated herein by reference.

TECHNICAL FIELD

The present disclosure relates to a valve timing control apparatus.

BACKGROUND

It is known to provide a valve timing control apparatus that controls opening timing and closing timing of intake valves or exhaust valves, which are driven by a driven-side shaft of an internal combustion engine, by changing a rotational phase between a driving-side shaft and the driven-side shaft of the engine. For example, the valve timing control apparatus of JP2005-351182A changes the opening timing and closing timing of the valves through rotation of a vane rotor relative to a housing by changing a pressure of hydraulic oil in advancing chambers and a pressure of hydraulic oil in retarding chambers in the housing. The vane rotor of JP2005-351182A is made only of a plurality of metal plates, which are stacked one after another in the axial direction.

A size of the metal plate varies among the metal plates of the vane rotor. Therefore, the axial size and the radial size of the vane rotor vary from product to product. Particularly, the axial size of the vane rotor largely varies from product to product because of accumulation of size errors of the metal plates, which are stacked one after another in the axial direction. Therefore, a gap between the vane rotor and the housing cannot be reduced beyond a certain limit, and thereby oil leakage from the gap may possibly occur.

JPH11-81928A teaches another type of valve timing control apparatus, which changes opening timing and closing timing of the valves through rotation of a vane rotor relative to a housing by changing a pressure of hydraulic oil in advancing chambers and a pressure of hydraulic oil in retarding chambers in the housing.

In the valve timing control apparatus of JPH11-81928A, a seal member is installed to a radially outer end of each of vanes of the vane rotor. In a state where the pressure of the advancing chamber is larger than the pressure of the retarding chamber, the seal member is urged against a retarding chamber side wall surface of a corresponding groove of the vane rotor and an inner wall of the housing by a pressure of the hydraulic oil, which enters from the advancing chamber into a clearance between the seal member and the vane. In another state where the pressure of the retarding chamber is larger than the pressure of the advancing chamber, the seal member is urged against an advancing chamber side wall surface of the corresponding groove of the vane rotor and the inner wall of the housing by a pressure of the hydraulic oil, which enters from the retarding chamber into a clearance between the seal member and the vane.

In the valve timing control apparatus of JPH11-81928A, when the pressure difference between the advancing chamber and the retarding chamber is reduced, the differential pressure, which is a pressure difference between the pressure of the hydraulic oil in the advancing chamber and the pressure of the hydraulic oil in the retarding chamber and is applied to the seal member, is reduced. Therefore, the position of the seal member becomes unstable, and thereby the oil leakage may easily occur.

Furthermore, the hydraulic oil, which is pumped from an oil pump, is supplied to the clearance between the seal member and the vane of the vane rotor through the advancing chamber or the retarding chamber. Therefore, the pressure loss, which occurs in the path from the oil pump to the clearance, is relatively large. Thus, it is not possible to obtain a sufficient pressing force to press the seal member. As a result, the oil leakage can easily occur.

SUMMARY

The present disclosure is made in view of the above points. According to the present disclosure, there is provided a valve timing control apparatus, which controls opening timing and closing timing of one of an intake valve and an exhaust valve of an internal combustion engine, which is driven by a driven-side shaft of the internal combustion engine, through changing of a rotational phase between a driving-side shaft of the internal combustion engine and the driven-side shaft. The valve timing control apparatus includes a first housing, a second housing, a laminated body and a resin member. The first housing is rotatable integrally with one of the driving-side shaft and the driven-side shaft. The second housing is fixed to the first housing and forms a plurality of pressurization compartments in cooperation with the first housing. The laminated body includes a plurality of thin plates, which are stacked one after another in an axial direction. The laminated body is rotatable integrally with the other one of the driving-side shaft and the driven-side shaft and is placed at a corresponding location, which is between the first housing and the second housing. The resin member is made of a resin material. The laminated body is insert molded in the resin member. The resin member includes a plurality of vanes, a first side wall and a second side wall. Each of the plurality of vanes radially extends to partition a corresponding one of the plurality of pressurization compartments into an advancing chamber and a retarding chamber. The first side wall is placed between the first housing and the laminated body and is slidable relative to the first housing. The second side wall is placed between the second housing and the laminated body and is slidable relative to the second housing.

According to the present disclosure, there is also provided a valve timing control apparatus, which controls opening timing and closing timing of one of an intake valve and an exhaust valve of an internal combustion engine, which is driven by a driven-side shaft of the internal combustion engine, through changing of a rotational phase between a driving-side shaft of the internal combustion engine and the driven-side shaft. The valve timing control apparatus includes a first housing, a second housing, a vane rotor, a first seal member and a second seal member. The first housing is rotatable integrally with one of the driving-side shaft and the driven-side shaft. The second housing is fixed to the first housing and forms a plurality of pressurization compartments in cooperation with the first housing. The vane rotor includes a boss portion and a plurality of vanes. The boss portion is rotatable integrally with the other one of the driving-side shaft and the driven-side shaft and is placed in one of the first housing and the second housing. Each of the plurality of vanes radially extends from the boss portion to partition a corresponding one of the plurality of pressurization compartments into an advancing chamber and a retarding chamber. The first seal member is placed between the first housing and the vane rotor and is radially and axially movable relative to the vane rotor. The second seal member is placed between the second housing and the vane rotor and is radially and axially movable relative to the vane rotor and the first seal member. The vane rotor includes a pressing oil passage that opens in a contact surface of the vane rotor, which is abuttable against the first seal member, and also opens in a contact surface of the vane rotor, which is abuttable against the second seal member. The pressing oil passage is configured to guide hydraulic oil, which is received from an outside of the valve timing control apparatus, to the first seal member and the second seal member without passing through the advancing chambers and the retarding chambers of the plurality of pressurization compartment to exert a pressing force, which radially outwardly and axially urge the first seal member and the second seal member.

BRIEF DESCRIPTION OF THE DRAWINGS

The drawings described herein are for illustration purposes only and are not intended to limit the scope of the present disclosure in any way.

FIG. 46 is a plan view of a seventh type metal plate of the laminated body of

FIG. 38;

FIG. 47 is a plan view of an eighth type metal plate of the laminated body of

FIG. 38;

DETAILED DESCRIPTION

Figure 1:
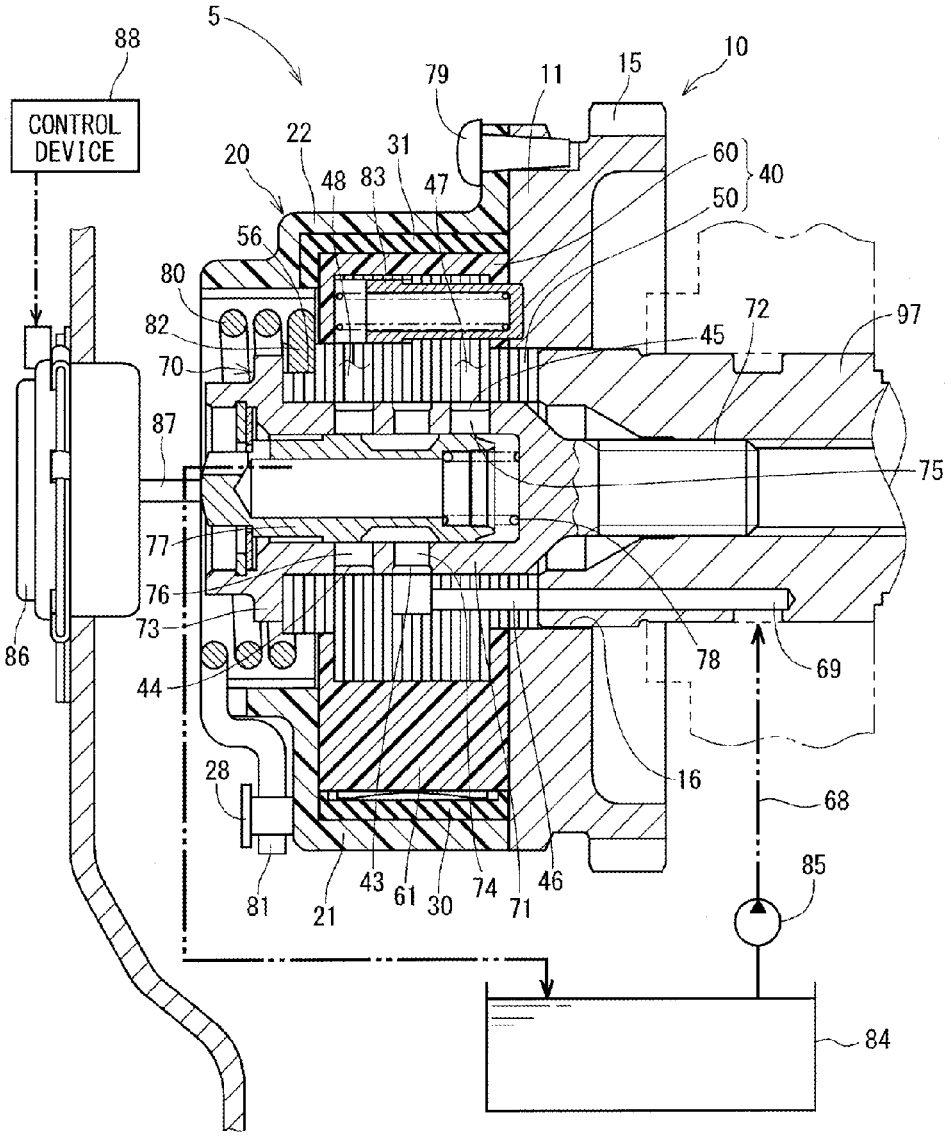
FIG. 1 is a schematic cross-sectional view showing a valve timing control system, which includes a valve timing control apparatus according to a first embodiment of the present disclosure.

Various embodiments of the present disclosure will be described with reference to the accompanying drawings. In the following discussion of the embodiments, similar components will be indicated by the same reference numerals and will not be described redundantly for the sake of simplicity.

First Embodiment

Figure 2:
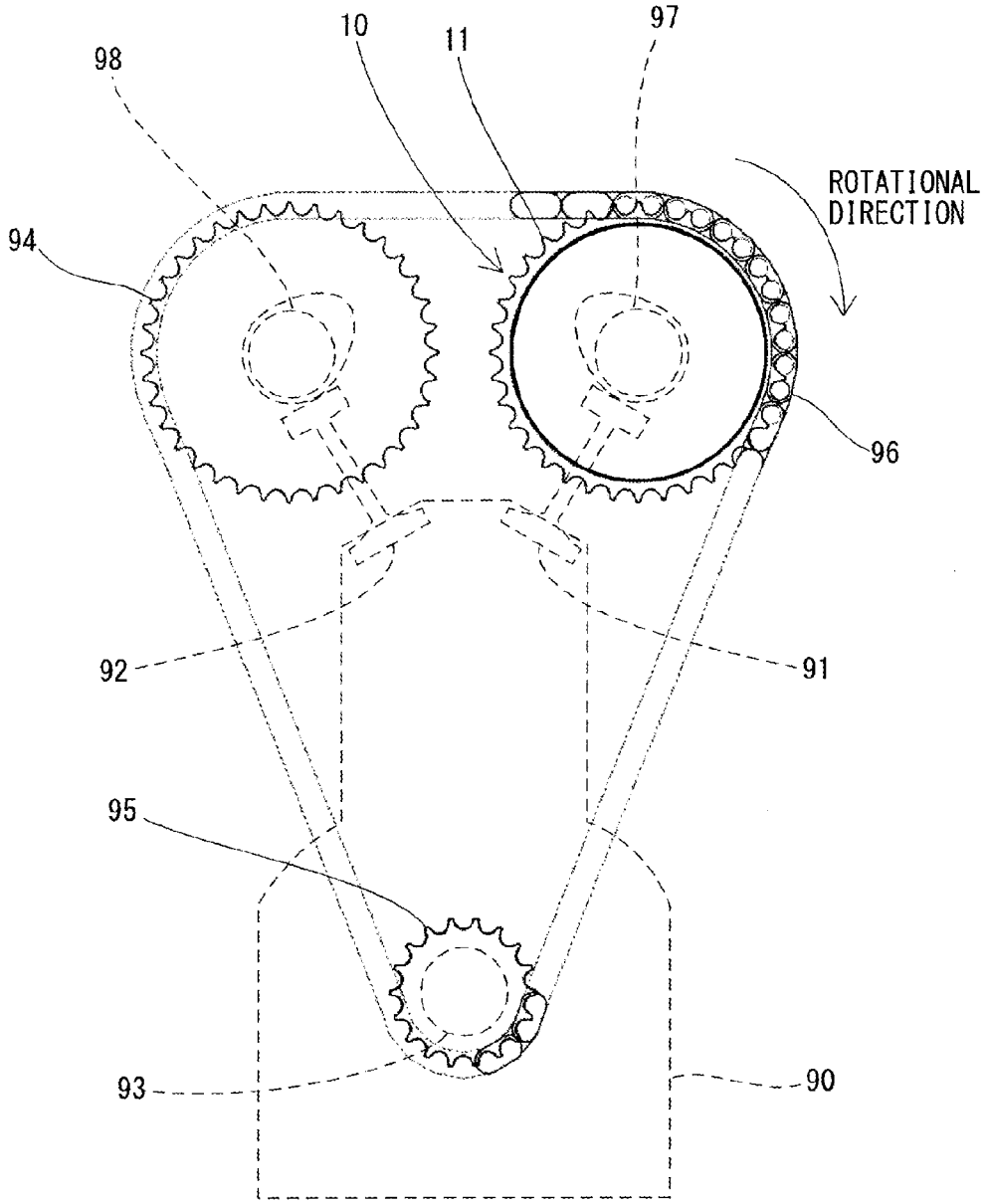
FIG. 2 is a schematic diagram showing an internal combustion engine, to which the valve timing control apparatus of FIG. 1 is applied.

In a first embodiment of the present disclosure, a valve timing control apparatus is applied to a valve timing control system shown in FIG. 1. The valve timing control system 5 controls opening timing and closing timing of intake valves 91 of an internal combustion engine 90 shown in FIG. 2. As shown in FIG. 2, rotation of a crankshaft 93, which is a driving-side shaft of the engine 90, is transmitted to two camshafts 97, 98 through a chain 96, which is wound around three sprockets 11, 94, 95. The camshaft 97 is a driven-side shaft, which drives the intake valves 91 to open and close the same. The camshaft 98 is a driven-side shaft, which drives the exhaust valves 92 to open and close the same.

In the valve timing control system 5, when the camshaft 97 is rotated in a rotational direction relative to the sprocket 11, which is rotated integrally with the crankshaft 93, the opening timing and closing timing of the intake valves 91 is shifted forwarded. This relative rotation of the camshaft 97, which shifts the opening timing and closing timing of the intake valves 91 forward, will be referred to as "advancing".

In contrast, when the camshaft 97 is rotated in an opposite direction, which is opposite from the rotational direction, relative to the sprocket 11, the opening timing and closing timing of the intake valves 91 is shifted backward. This relative rotation of the camshaft 97, which shifts the opening timing and closing timing of the intake valves 91 backward, will be referred to as "retarding".

Now, a structure of the valve timing control system 5 will be schematically described with reference to FIGS. 1 to 4.

The valve timing control system 5 includes the valve timing control apparatus 10, an oil pump 85, a linear solenoid 86 and an electronic control device 88.

The valve timing control apparatus 10 includes the sprocket 11, a housing 20, a vane rotor 40, a sleeve bolt 70 and a spool 77.

The sprocket 11 serves as a first housing of the present disclosure and is rotated integrally with the crankshaft 93.

The housing 20 serves as a second housing of the present disclosure and includes an outer shell 21 and a plurality of partitions 22. The outer shell 21 is configured into a cup-form and is fixed to the sprocket 11 through an outer peripheral part of the outer shell 21. The partitions 22 radially extend to partition an inside of the outer shell 21 into a plurality (five in this instance) of pressurization compartments 29.

The vane rotor 40 is placed in an inside of the housing 20 and is rotatable integrally with the camshaft 97. The vane rotor 40 includes a plurality (five in this instance) of vanes 61. Each of the vanes 61 radially extends to partition a corresponding one of the pressurization compartments 29, which are formed in the inside of the housing 20, into an advancing chamber 23 and a retarding chamber 24. The vane rotor 40 includes a plurality (two in this instance) of supply oil passages 46, 49, a plurality (five in this instance) of advancing oil passages 47 and a plurality (five in this instance) of retarding oil passages 48. The supply oil passages 46, 49 axially extend from a camshaft 97 side end surface of the vane rotor 40 and open in an inner peripheral wall surface of the vane rotor 40 at an axial center portion of the vane rotor 40. Each advancing oil passage 47 radially outwardly extends from the inner peripheral wall surface of the vane rotor 40 and is communicated with a corresponding one of the advancing chambers 23. Each retarding oil passage 48 radially outwardly extends from the inner peripheral wall surface of the vane rotor 40 and is communicated with a corresponding one of the retarding chambers 24. The supply oil passage 49 is parallel to the supply oil passage 46. The vane rotor 40 is rotated relative to the housing 20 in an advancing side, which is indicated by an arrow Y1 in FIG. 4, or a retarding side, which is indicated by an arrow Y2 in FIG. 4, depending on a pressure of hydraulic oil present in the advancing chambers 23 and a pressure of hydraulic oil present in the retarding chambers 24.

The sleeve bolt 70 is a fixing member, which fixes the vane rotor 40 to the camshaft 97. The sleeve bolt 70 includes a sleeve 71, a threaded portion (a male-threaded portion) 72 and a head 73. The sleeve 71 is configured into a tubular body having a bottom and is fitted to the inner peripheral wall surface of the vane rotor 40 at a location that is on a radially inner side of a laminated body 50 of the vane rotor 40 discussed below. The threaded portion 72 axially extends from the sprocket 11 side bottom of the sleeve 71 and is threadably engaged with a female thread of the camshaft 97. The head 73 is formed in an opening end of the sleeve 71. The sleeve 71 includes a supply groove 43, a retarding groove 44, an advancing groove 45, a supply port 74, an advancing port 75 and a retarding port 76. The supply groove 43 is formed in an outer peripheral surface of a peripheral wall of the sleeve 71 to circumferentially extend as an annular groove and is communicated with the supply oil passages 46, 49. The retarding groove 44 is formed in the outer peripheral surface of the peripheral wall of the sleeve 71 to circumferentially extend as an annular groove and is communicated with the retarding oil passages 48. The advancing groove 45 is formed in the outer peripheral surface of the peripheral wall of the sleeve 71 to circumferentially extend as an arcuate groove and is communicated with the advancing oil passages 47. The supply port 74 radially extends through the peripheral wall of the sleeve 71 at an axial position that coincides with an axial position of the supply groove 43. The advancing port 75 radially extends through the peripheral wall of the sleeve 71 at an axial position that coincides with an axial position of the advancing groove 45. The retarding port 76 radially extends through the peripheral wall of the sleeve 71 at an axial position that coincides with an axial position of the retarding groove 44.

The spool 77 is reciprocatable in the axial direction in the inside of the sleeve 71 of the sleeve bolt 70. The spool 77 and the sleeve bolt 70 cooperate together to serve as an oil passage change valve. Corresponding ones of the ports 74-76 of the sleeve 71 are communicated and discommunicated with each other through the axial movement of the spool 77. Specifically, the spool 77 can be moved to one of first to third operational positions (first to third axial positions). When the spool 77 is placed in the first operational position, the spool 77 connects the supply port 74 to the advancing port 75 and connects the retarding port 76 to an external drain space to enable flow of the oil. When the spool 77 is placed in the second operational position, the spool 77 connects the supply port 74 to the retarding port 76 and connects the advancing port 75 to the drain space to enable flow of the oil. When the spool 77 is placed in the third operational position, the spool 77 disconnects the advancing port 75 from the supply port 74 and the drain space and disconnects the retarding port 76 from the supply port 74 and the drain space. The spool 77 is urged toward the linear solenoid 86 by the spring 78. The axial position of the spool 77 is determined by balance between an urging force of the spring 78 and a push force of the linear solenoid 86.

The oil pump 85 takes the hydraulic oil from the oil pan (serving as an external oil supply source) 84 and supplies it to the supply port 74 through the supply oil passages 68, 69, 46, 49 and the supply groove 43.

The linear solenoid 86 has an output rod 87, which can push the spool 77 in the axial direction. The output rod 87 is moved in the axial direction in response to a magnetic field, which is generated when a coil of the linear solenoid 86 is energized.

The electronic control device 88 controls the axial position of the spool 77 by driving the linear solenoid 86 such that a rotational phase of the vane rotor 40 relative to the housing 20 of the valve timing control apparatus 10 coincides with a target value.

In the valve timing control system 5, which is constructed in the above-described manner, when the rotational phase is on the retarding side of the target value, the electronic control device 88 controls the axial position of the spool 77 such that the supply port 74 and the advancing port 75 of the valve timing control apparatus 10 are communicated with each other. In this way, in the valve timing control apparatus 10, the hydraulic oil is supplied to the advancing chambers 23, and the hydraulic oil is drained from the retarding chambers 24 through the path located at the outside of the spool 77.

Furthermore, in the valve timing control apparatus 10, when the rotational phase is on the advancing side of the target value, the electronic control device 88 controls the axial position of the spool 77 such that the supply port 74 and the retarding port 76 of the valve timing control apparatus 10 are communicated with each other. In this way, in the valve timing control apparatus 10, the hydraulic oil is supplied to the retarding chambers 24, and the hydraulic oil is drained from the advancing chambers 23 through the path located in the inside of the spool 77.

Furthermore, in the valve timing control apparatus 10, when the rotational phase coincides with the target value, the electronic control device 88 controls the axial position of the spool 77 such that the supply port 74 is discommunicated from the advancing port 75 and the retarding port 76. In this way, the hydraulic oil in the advancing chambers 23 and the hydraulic oil in the retarding chambers 24 are maintained.

Next, the characteristic features of the valve timing control apparatus 10 will be described with reference to FIGS. 1 and 3 to 15.

Figure 3:
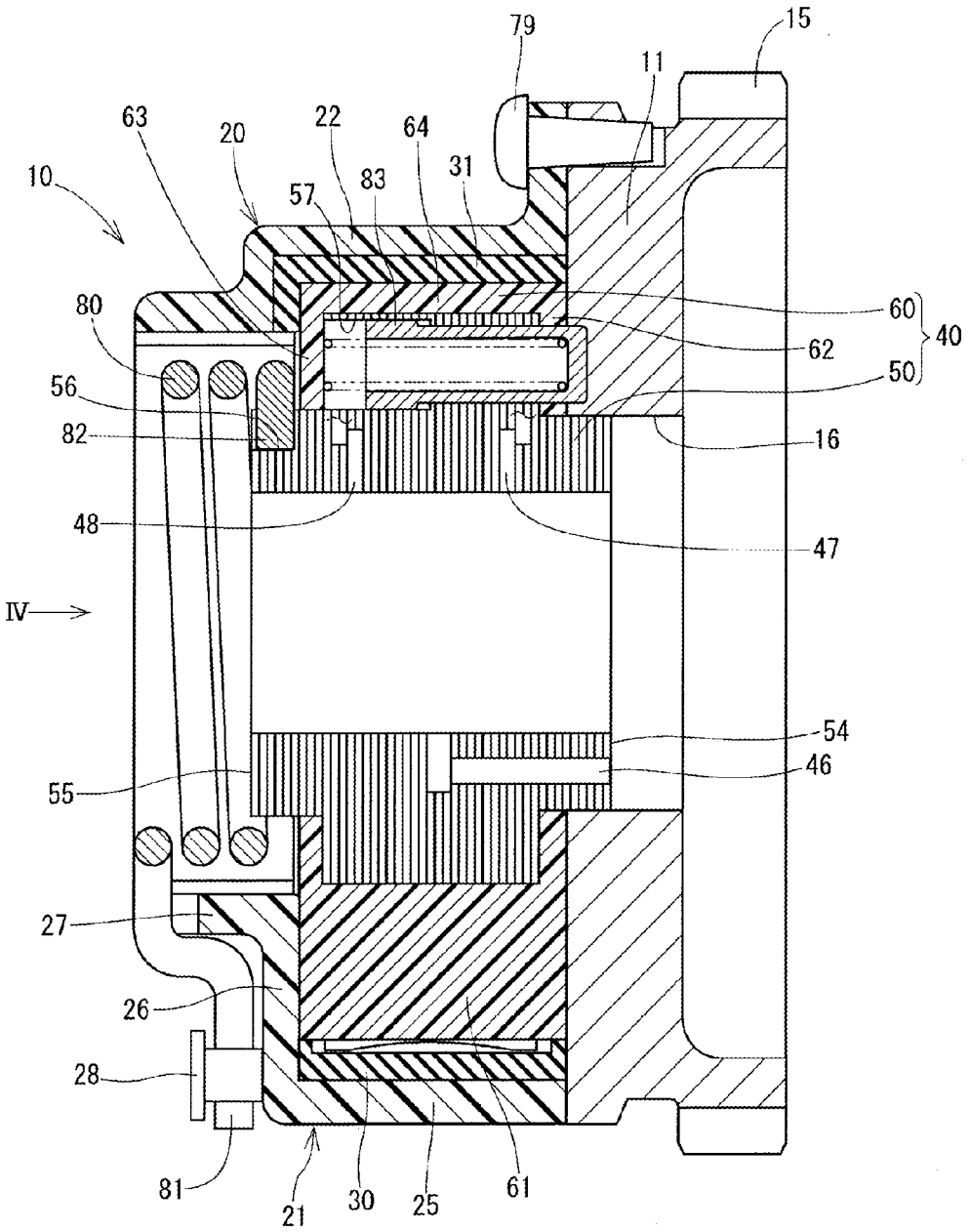
FIG. 3 is a longitudinal cross-sectional view of the valve timing control apparatus of FIG. 1.
Figure 4:
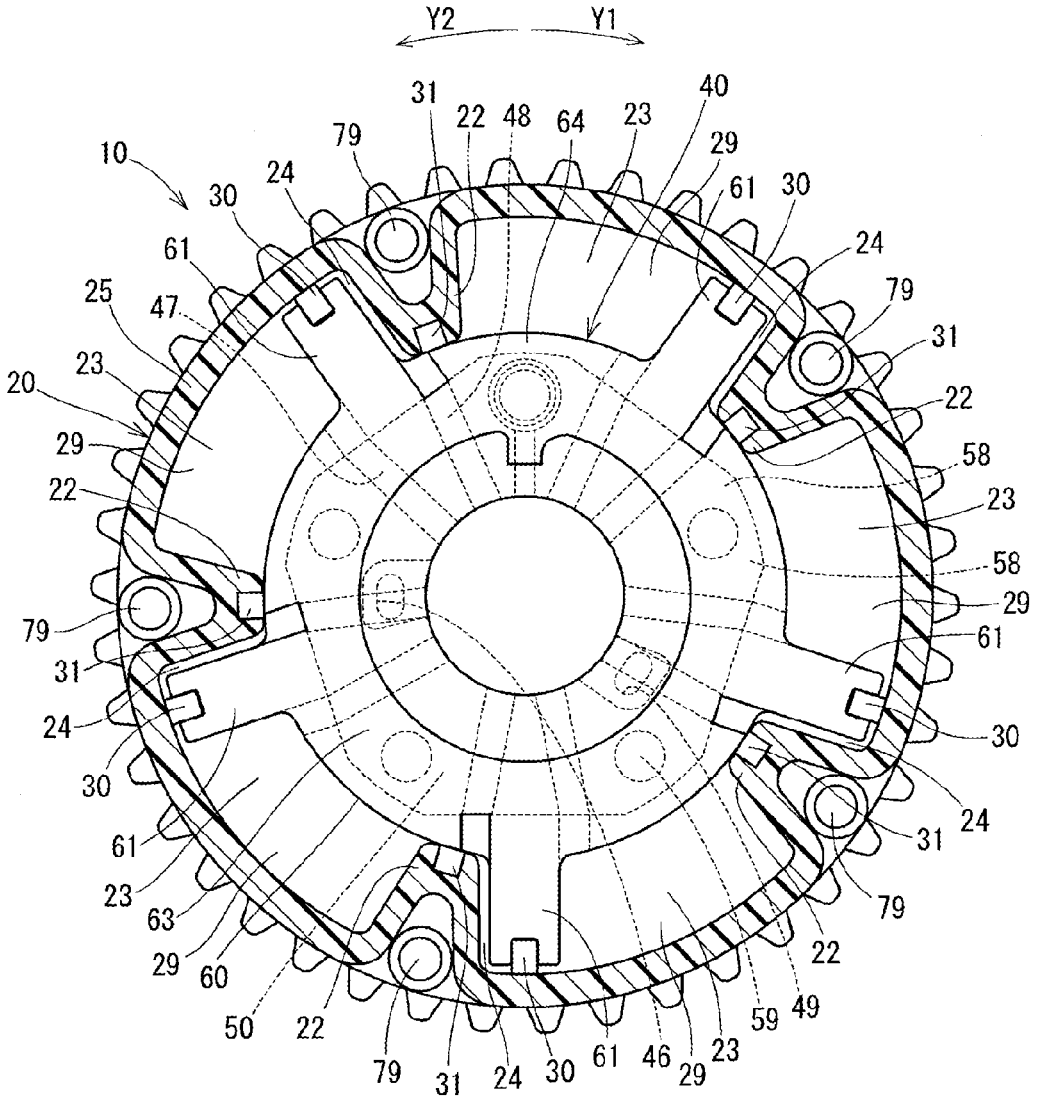
FIG. 4 is a schematic view of the valve timing control apparatus taken from a direction of an arrow IV in FIG. 3 without depicting an outer shell of a housing and an assist spring for the sake of simplicity.

As shown in FIGS. 1, 3 and 4, the outer shell 21 of the housing 20 includes a large-diameter tube section 25, a bottom section 26 and a small-diameter tube section 27. The large-diameter tube section 25 is located on a radially outer side of the vane rotor 40. The bottom section 26 is located on a side of the large-diameter tube section 25, which is opposite from the sprocket 11 in the axial direction. The small-diameter tube section 27 axially projects from the bottom section 26 on a side, which is opposite from the large-diameter tube section 25 in the axial direction. An assist spring (serving as an urging member) 80 is received in the small-diameter tube section 27.

The housing 20 is made of a resin composite material. In the first embodiment, the resin composite material is fiber reinforced plastic. The fiber reinforced plastic is a composite material, which is formed by mixing a reinforcing material (e.g., glass fibers, carbon fibers) into the resin material to increase the strength. The resin material may be, for example, polyamide 66 (abbreviated as PA66) resin, poly phenylene sulfide (abbreviated as PPS) resin, modified polyphenylene ether (abbreviated as m-PPE) resin, polyarylethe-retherketone (abbreviated as PEEK) resin or phenol-formaldehyde (abbreviated as PF) resin.

The sprocket 11 is made of a metal material and has external teeth 15 and a through-hole 16. The chain 96 (see FIG. 2) is wound around the external teeth 15. The camshaft 97 is received through the through-hole 16. The housing 20 is fixed to the sprocket 11 with screws 79.

Figure 5:
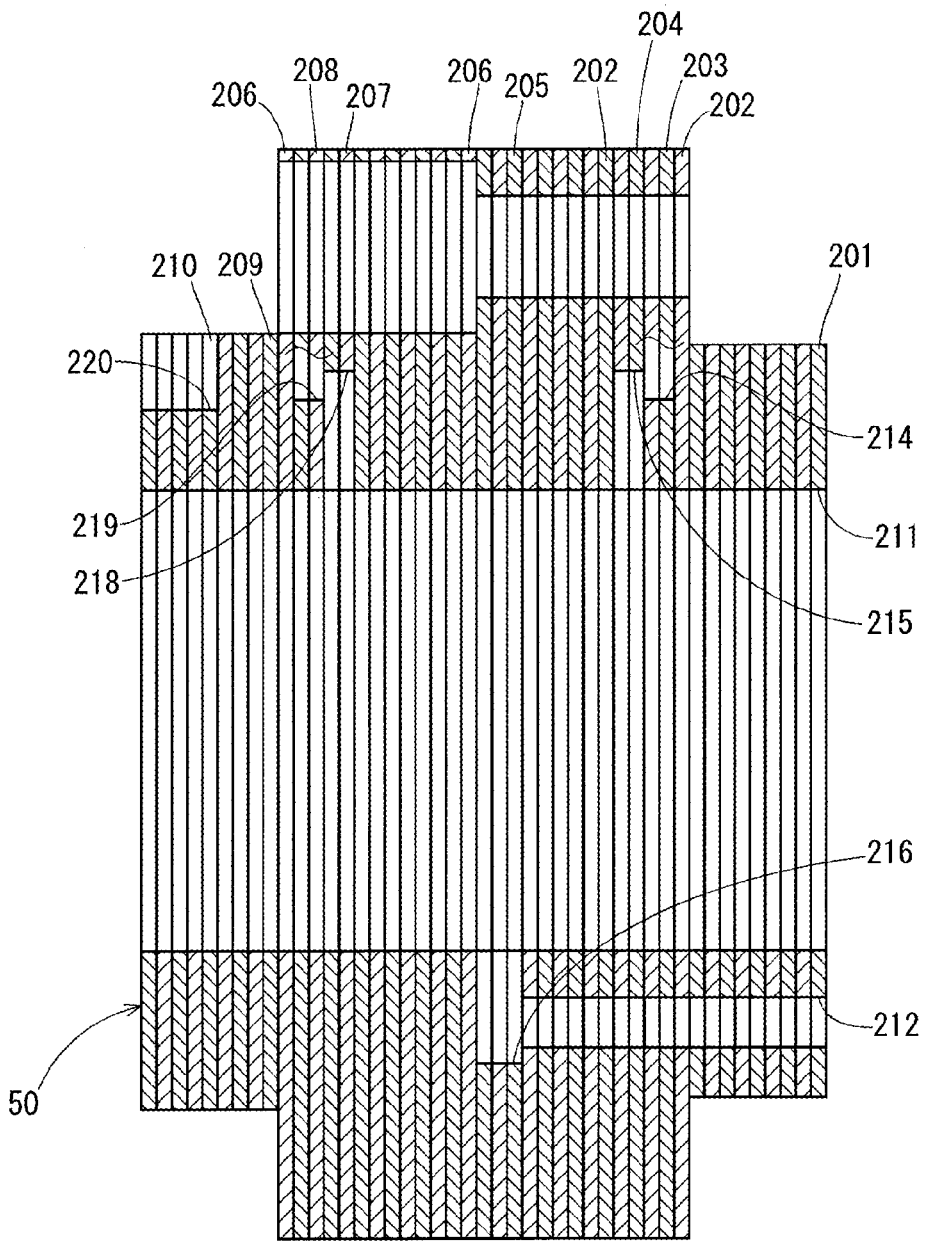
FIG. 5 is a schematic longitudinal cross sectional view, showing a laminated body of FIG. 3.

As shown in FIGS. 3 and 5, the vane rotor 40 includes the laminated body 50 and a resin member 60. The laminated body 50 includes a plurality of metal plates 201-210, which are stacked one after another in the axial direction. The resin member 60 is made of a resin material, and the laminated body 50 is insert molded in the resin member 60. The laminated body 50 is configured into a tubular form and includes the supply oil passages 46, 49, the advancing oil passages 47 and the retarding oil passages 48. The metal plates 201-210 are fixed together by press-fit pins 59 shown in FIG. 4. In FIGS. 1 and 3, for the sake of convenience, the metal plates 201-210 are cut to show a longitudinal cross-section, and hatching lines of the cross-section of the metal plates 201-210 are omitted.

Figure 6:
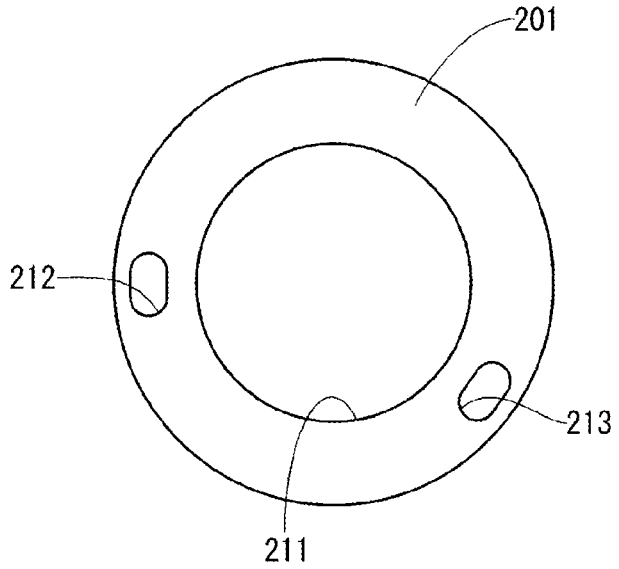
FIG. 6 is a plan view of a first type metal plate of the laminated body of FIG. 5.
Figure 7:
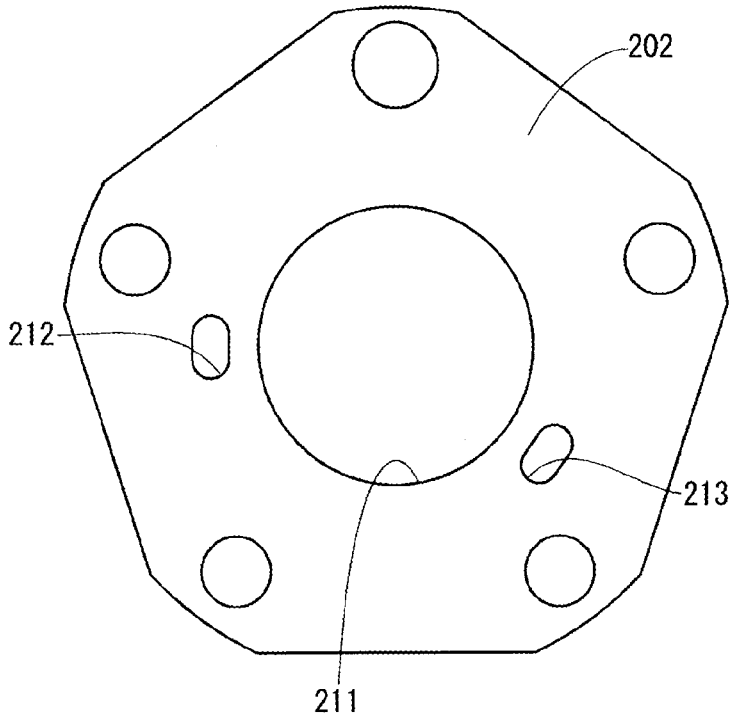
FIG. 7 is a plan view of a second type metal plate of the laminated body of FIG. 5.
Figure 8:
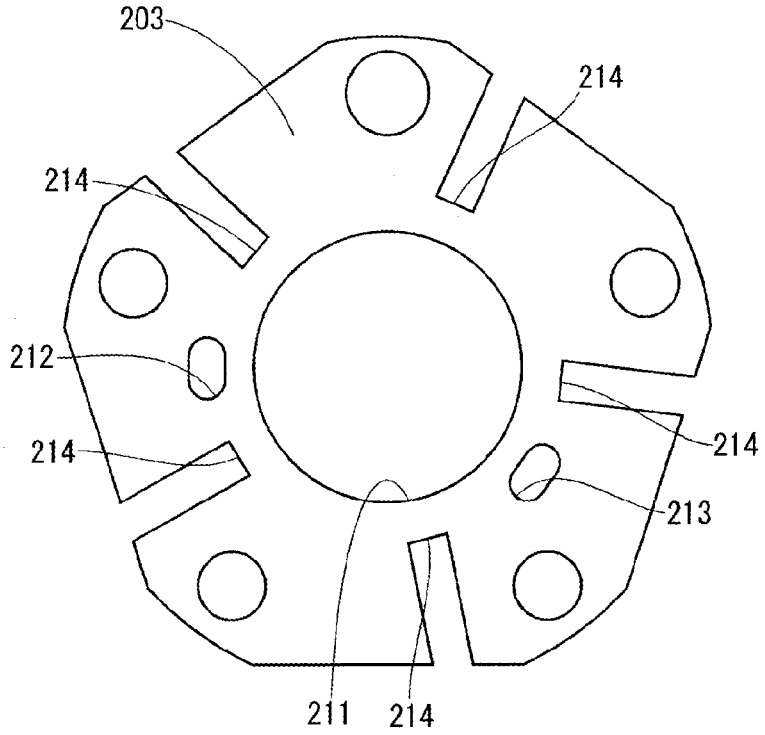
FIG. 8 is a plan view of a third type metal plate of the laminated body of FIG. 5.
Figure 9:
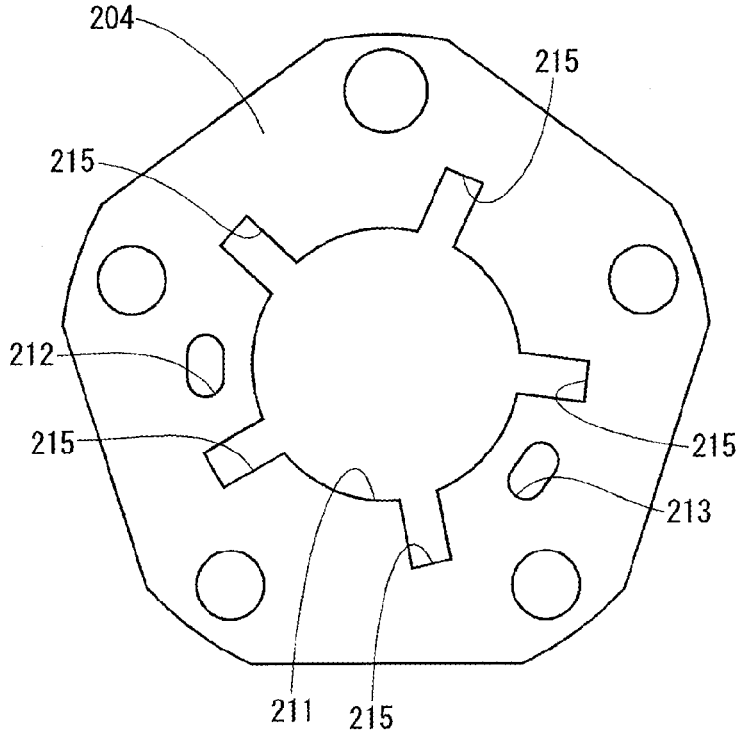
FIG. 9 is a plan view of a fourth type metal plate of the laminated body of FIG. 5.
Figure 10:
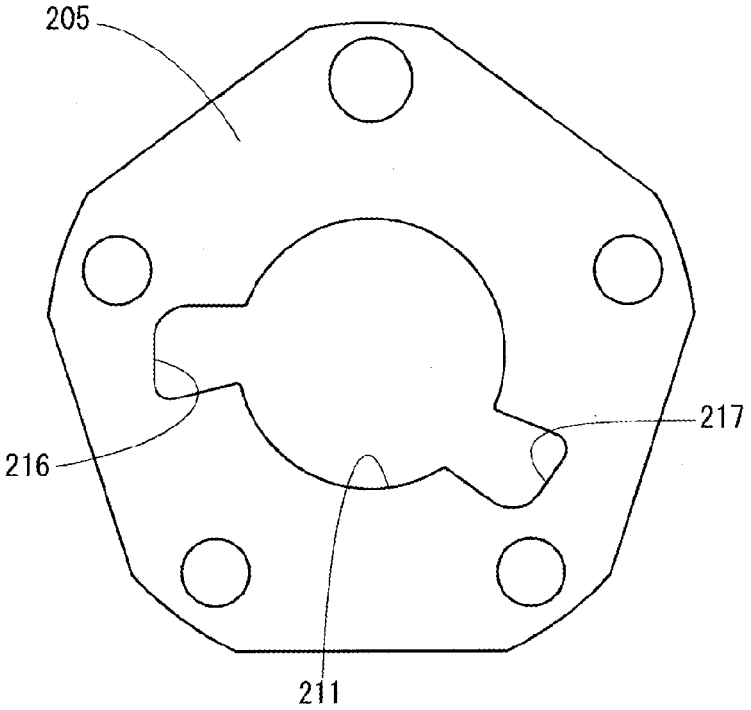
FIG. 10 is a plan view of a fifth type metal plate of the laminated body of FIG. 5.
Figure 11:
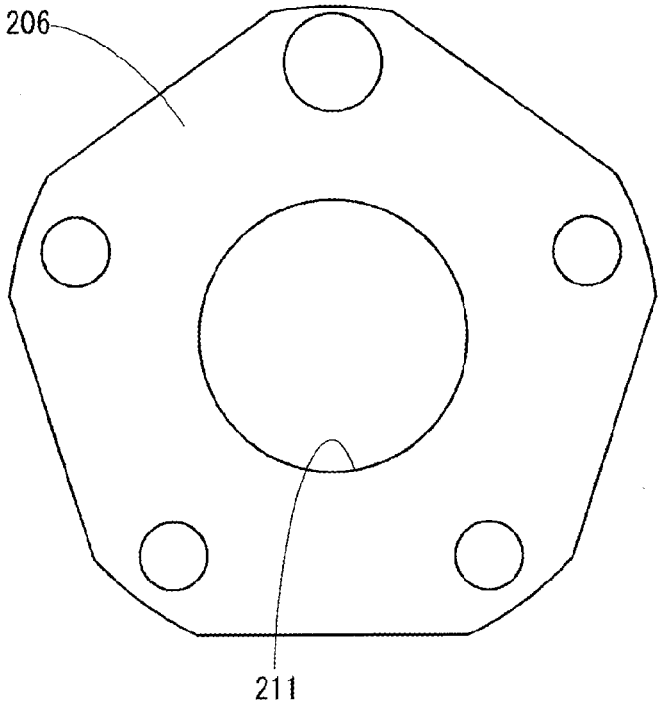
FIG. 11 is a plan view of a sixth type metal plate of the laminated body of FIG. 5.
Figure 12:
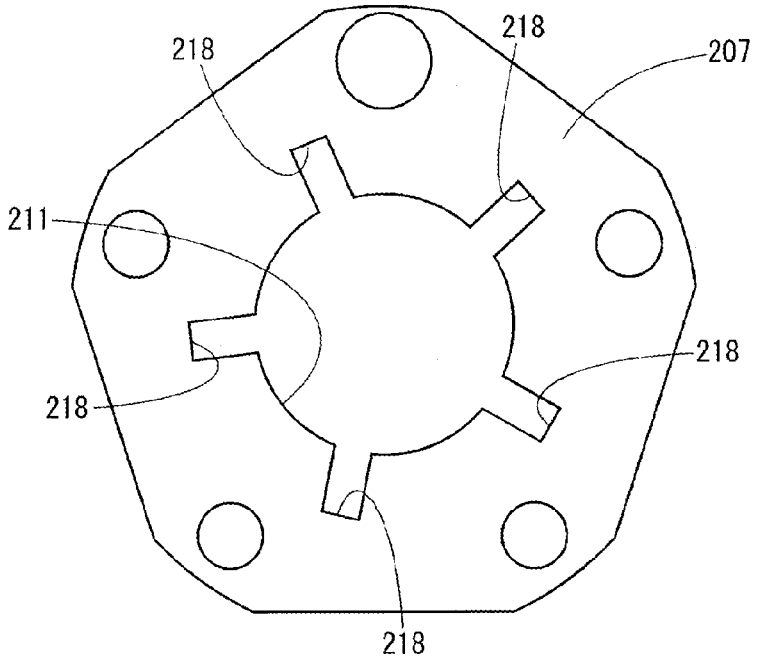
FIG. 12 is a plan view of a seventh type metal plate of the laminated body of FIG. 5.
Figure 13:
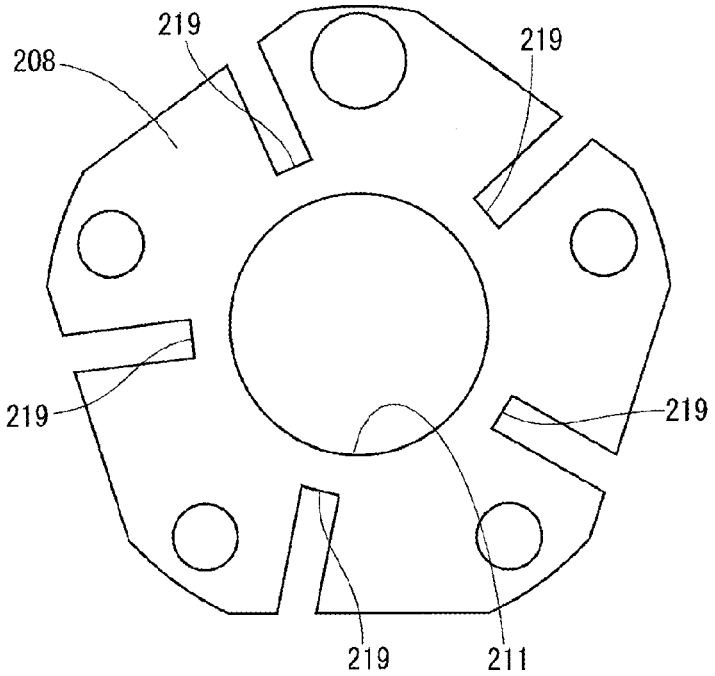
FIG. 13 is a plan view of an eighth type metal plate of the laminated body of FIG. 5.
Figure 14:
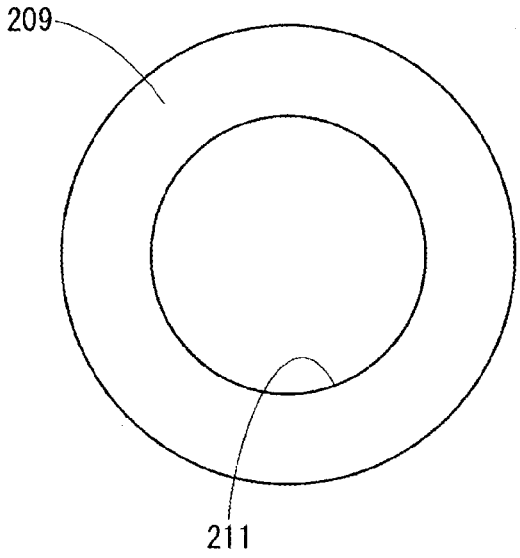
FIG. 14 is a plan view of a ninth type metal plate of the laminated body of FIG. 5.
Figure 15:
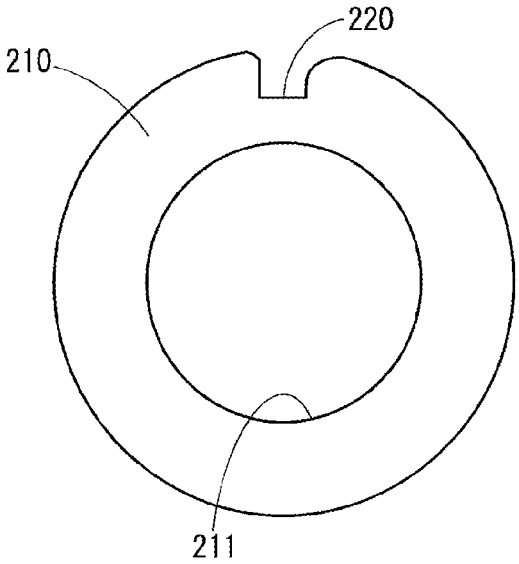
FIG. 15 is a plan view of a tenth type metal plate of the laminated body of FIG. 5.

The laminated body 50 is formed by axially stacking the metal plates 201 of FIG. 6, the metal plates 202 of FIG. 7, the metal plates 203 of FIG. 8, the metal plates 204 of FIG. 9, the metal plates 202 of FIG. 7, the metal plates 205 of FIG. 10, the metal plates 206 of FIG. 11, the metal plates 207 of FIG. 12, the metal plates 208 of FIG. 13, the metal plate 206 of FIG. 11, the metal plates 209 of FIG. 14 and the metal plates 210 of FIG. 15 in this order.

As shown in FIG. 6, the metal plate 201 is configured into a circular form in the axial view. The metal plate 201 includes a fitting hole 211 and two oil holes 212, 213. The fitting hole 211 is a hole, into which the sleeve 71 of the sleeve bolt 70 is fitted. The oil hole 212 is a hole that forms a part of the supply oil passage 46. The oil hole 213 is a hole that forms a part of the supply oil passage 49. The oil hole 213 is spaced from the oil hole 212 in the circumferential direction.

As shown in FIG. 7, the metal plate (serving as an oil passage forming plate) 202 is configured into a form of a polygon (hereinafter also referred to as a polygonal form) in the axial view. The metal plate 202 includes the fitting hole 211 and the oil holes 212, 213.

As shown in FIG. 8, the metal plate 203 is configured into a polygonal form, which is the same as the polygonal form of the metal plate 202 in the axial view. The metal plate 203 includes the fitting hole 211, the oil holes 212, 213 and a plurality (five in this instance) of radial recesses 214. In the metal plate 203, each radial recess 214 is radially inwardly recessed from an outer peripheral edge of the metal plate 203 and forms a part of a corresponding one of the advancing oil passages 47.

As shown in FIG. 9, the metal plate 204 is configured into a polygonal form, which is the same as the polygonal form of the metal plate 202 in the axial view. The metal plate 204 includes the fitting hole 211, the oil holes 212, 213 and a plurality (five in this instance) of radial recesses 215. In the metal plate 204, each radial recess 215 is radially outwardly recessed from the fitting hole 211. In the axial view, a radially outer end of each radial recess 215 overlaps with a radially inner end of a corresponding one of the radial recesses 214 of the metal plate 203 to form a part of the corresponding advancing oil passage 47.

As shown in FIG. 10, the metal plate 205 is configured into a polygonal form, which is the same as the polygonal form of the metal plate 202 in the axial view. The metal plate 205 includes the fitting hole 211, a radial recess 216 and a radial recess 217. In the metal plate 205, the radial recess 216 radially outwardly recessed from the fitting hole 211. In the axial view, a portion of the radial recess 216 overlaps with the oil hole 212 to form a part of the supply oil passage 46. In the metal plate 205, the radial recess 217 radially outwardly recessed from the fitting hole 211. In the axial view, a portion of the radial recess 217 overlaps with the oil hole 213 to form a part of the supply oil passage 49.

As shown in FIG. 11, the metal plate 206 is configured into a polygonal form, which is the same as the polygonal form of the metal plate 202 in the axial view. The metal plate 206 includes the fitting hole 211.

As shown in FIG. 12, the metal plate 207 is configured into a polygonal form, which is the same as the polygonal form of the metal plate 202 in the axial view. The metal plate 207 includes the fitting hole 211 and a plurality (five in this instance) of radial recesses 218. In the metal plate 207, each radial recess 218 is radially outwardly recessed from the fitting hole 211 and forms a part of the corresponding retarding oil passage 48.

As shown in FIG. 13, the metal plate 208 is configured into a polygonal form, which is the same as the polygonal form of the metal plate 202 in the axial view. The metal plate 208 includes the fitting hole 211 and a plurality (five in this instance) of radial recesses 219. In the metal plate 208, each radial recess 219 is radially inwardly recessed from the outer peripheral edge of the metal plate 208. In the axial view, a radially inner end of each radial recess 219 overlaps with a radially outer end of a corresponding one of the radial recesses 218 of the metal plate 207 to form the part of the corresponding retarding oil passage 48.

As shown in FIG. 14, the metal plate 209 is configured into a circular form and includes the fitting hole 211.

As shown in FIG. 15, the metal plate 210 is configured into a circular form, which is the same as the circular form of the metal plate 210 in the axial view. The metal plate 210 includes the fitting hole 211 and a radial recess 220. In the metal plate 210, the radial recess 220 is radially inwardly recessed from an outer peripheral edge of the metal plate 210 and forms a part of an engaging groove 56.

The laminated body 50 is fixed to the camshaft 97 with the sleeve bolt 70 and is rotatable integrally with the camshaft 97. One axial end portion 54 of the laminated body 50, which is axially placed on the sprocket 11 side, is exposed outwardly from the resin member 60 and is rotatably supported by the inner wall surface of the through-hole 16 of the sprocket 11. The metal plate 201 at the one axial end (the right end in FIG. 1) of the laminated body 50 and the metal plate 210 at the other axial end (the left end in FIG. 1) of the laminated body 50 are made of a metal material that has a strength, which is higher than a metal material of the other metal plates (or other types of metal plates) of the laminated body 50, which are other than these metal plates 201, 210.

One end portion 81 of the assist spring 80 is engaged with an engaging pin 28, which axially projects from an outer wall surface of the housing 20. The other end portion 82 of the assist spring 80 is engaged with the engaging groove 56, which is formed in the other axial end portion 55 of the laminated body 50 that is axially opposite from the one axial end portion 54 of the laminated body 50. The assist spring 80 urges the vane rotor 40 toward the advancing side.

The laminated body 50 includes a slide hole 57, which axially slidably supports a lock pin 83. The lock pin 83 is insertable into and removable from the sprocket 11 (more specifically, an engaging hole of the sprocket 11). When the lock pin 83 is inserted into the sprocket 11, the lock pin 83 limits relative rotation between the vane rotor 40 and the sprocket 11. In contrast, when the lock pin 83 is removed from the sprocket 11, the relative rotation between the vane rotor 40 and the sprocket 11 is enabled.

The resin member 60 includes a plurality of vanes 61, a first side wall 62, a second side wall 63 and a peripheral wall 64. The first side wall 62 is axially placed between the laminated body 50 and the sprocket 11, which are axially opposed to each other. The first side wall 62 is joined to the laminated body 50 and is slidable relative to the sprocket 11. The second side wall 63 is axially placed between the laminated body 50 and the bottom section 26 of the housing 20, which are axially opposed to each other. The second side wall 63 is joined to the laminated body 50 and is slidable relative to the bottom section 26. The peripheral wall 64 is joined to an outer peripheral surface of a peripheral wall (also referred to as an outer peripheral wall surface) of the laminated body 50, which is located in a radially outer part of the laminated body 50. Furthermore, the peripheral wall 64 is slidable relative to radial distal ends (i.e., radial inner ends) of the partitions 22 of the housing 20.

In the axial view, the laminated body 50 is in a form of a polygon (i.e., a polygonal form), which has a plurality of sides. In other words, a cross section of the laminated body 50, which is taken along a plane perpendicular to the axial direction of the laminated body 50, is the polygonal form. The number of the sides of the polygon of the laminated body 50 is twice greater than the number of the vanes 61 of the resin member 60. In the present embodiment, the number of the vanes 61 of the resin member 60 is five, and the number of the sides of the polygon of the laminated body 50, i.e., the number of the sides of the laminated body 50 located in the outer peripheral wall surface of the laminated body 50 is ten. Corners 58 of the outer peripheral wall surface of the laminated body 50 serve as a rotation limiting means (also referred to as rotation limiting portions) for limiting rotation of the laminated body 50 relative to the resin member 60. A circumferential position of each of the vanes 61 of the resin member 60 coincides with position of a center (circumferential center) of a corresponding one of the sides of the outer peripheral wall surface of the laminated body 50 in the axial view.

The resin member 60 is made of a thermoset resin material. The thermoset resin material in a molten state is filled into a cavity of a molding die, in which the laminated body 50 is set in advance. When the thermoset resin material is cooled and is solidified over the laminated body 50, the resin member 60 is formed.

A seal member 30 is installed to a radially outer end of each of the vanes 61 of the resin member 60 so that the seal member 30 is interposed between the vane 61, which is located on one side of the seal member 30, and the housing 20 and the sprocket 11, which are located on the other side of the seal member 30. Furthermore, a seal member 31 extends along the peripheral wall 64 and the second side wall 63 of the resin member 60, so that the peripheral wall 64 and the second side wall 63 of the resin member 60 cooperate with the large-diameter tube section 25 and the bottom section 26 of the housing 20 to hold the seal member 31 therebetween. The seal members 30, 31 oil-tightly seal a gap between the corresponding advancing chamber 23 and the corresponding retarding chamber 24.

As discussed above, according to the first embodiment, the valve timing control apparatus 10 includes the laminated body 50 and the resin member 60. The laminated body 50 has the metal plates 201-210, which are stacked one after another in the axial direction. The laminated body 50 is insert molded into the resin member 60. The resin member 60 has the vanes 61, each which radially extends to partition the corresponding pressurization compartment 29 into the advancing chamber 23 and the retarding chamber 24. The resin member 60 has the first side wall 62 and the second side wall 63. The first side wall 62 is axially placed between the sprocket 11 and the laminated body 50, which are axially opposed to each other, and the first side wall 62 is slidable relative to the sprocket 11. The second side wall 63 is axially placed between the laminated body 50 and the bottom section 26 of the housing 20, which are axially opposed to each other. The second side wall 63 is slidable relative to the bottom section 26. The laminated body 50 and the resin member 60 form the vane rotor 40.

The resin member 60 can be formed with a high precision through the molding process without requiring any additional process. Therefore, even when the axial size of the laminated body 50 varies from product to product, the variation in the axial side of the vane rotor 40 can be limited by the first side wall 62 and the second side wall 63 of the resin member 60. That is, the variations in the axial size of the laminated body 50 can be absorbed by the first side wall 62 and the second side wall 63. Therefore, the axial gap between the housing 20 and the vane rotor 40 and the axial gap between the sprocket 11 and the vane rotor 40 can be minimized to reduce or minimize the oil leakage through such an axial gap(s). Therefore, the operational response of the valve timing control apparatus 10 and the holding stability of the operational state of the valve timing control apparatus 10 are both improved.

In the case of the prior art vane rotor, which is made only of the metal plates, when the outer peripheral edges of the metal plates, which are stamped with the stamping machine, are not machined to properly finish the outer peripheral edges of the stamped metal plates, a burr(s) and/or a warped portion(s) of the outer peripheral edges of the stamped metal plates will interfere with the inner wall of the housing through engagement with the inner wall of the housing to limit the rotation of the vane rotor relative to the housing. The manufacturing costs would be increased when the burr(s) and/or the warped portion(s) of the outer peripheral edges of the stamped metal plates are removed by the machining in order to prevent the engagement of the burr(s) and/or the warped portion(s) of the outer peripheral edges of the stamped metal plates with the inner wall of the housing.

In contrast, according to the first embodiment, the peripheral wall 64 of the resin member 60 is joined to the outer peripheral wall surface of the laminated body 50. That is, the peripheral wall 64 of the resin member 60 is placed between the outer peripheral wall surface of the laminated body 50 and the large-diameter tube section 25 of the housing 20. Therefore, the interference between the laminated body 50 and the housing 20 can be limited.

Furthermore, according to the first embodiment, the laminated body 50 is configured into the form of the polygon (polygonal form) in the axial view. The corners 58 of the polygon of the laminated body 50, i.e., the corners 58 of the outer peripheral wall surface of the laminated body 50 serve as the rotation limiting means (rotation limiting portions) for limiting the rotation of the laminated body 50 relative to the resin member 60.

Therefore, it is possible to limit the relative rotation between the laminated body 50 and the resin member 60 caused by a load, such as a torque applied at the time of tightening the sleeve bolt 70 and/or a torque change of the camshaft 97.

According to the first embodiment, in the axial view, the laminated body 50 has the form of the polygon having the sides, and the number of the sides of the polygon of the laminated body 50 is twice greater than the number of the vanes 61 of the resin member 60. A circumferential position of each of the vanes 61 of the resin member 60 coincides with the center part of the corresponding one of the sides of the polygon of the laminated body 50, i.e., the sides of the outer peripheral wall surface of the laminated body 50 in the axial view.

Therefore, the rotational balance of the vane rotor 40 is improved.

Furthermore, in the first embodiment, the one axial end portion 54 of the laminated body 50 is axially exposed to the outside of the resin member 60 and is rotatably supported by the sprocket 11.

Therefore, the strength and the wear resistance of the rotatably supported portion of the vane rotor 40, which is made of the metal material, are higher than those of the rotatably supported portion of the vane rotor 40, which is made of the resin material.

Furthermore, according to the first embodiment, the lock pin 83 is axially slidably supported by the inner peripheral wall surface of the slide hole 57 of the laminated body 50.

Therefore, the wear resistance of the sliding portion is higher in comparison to the case where the lock pin 83 is supported by the resin portion of the vane rotor 40.

Furthermore, according to the first embodiment, the other end portion 82 of the assist spring 80 is engaged with the engaging groove 56 of the laminated body 50.

Therefore, the assist spring 80 can be installed to the vane rotor 40 without a need for providing a dedicated installation member of the assist spring 80.

In the first embodiment, the metal plate 210, which is placed at the other axial end (the left end in FIG. 1) of the laminated body 50, has a seat surface, against which the sleeve bolt 70 is seated at the time of tightening the sleeve bolt 70. The metal plate 201, which is placed at the one axial end (the right end in FIG. 1) of the laminated body 50, has a contact surface, which contacts the camshaft 97. These two metal plates 210, 201 are made of the metal material that has the higher strength in comparison to the strength(s) of the other metal plates of the laminated body 50, as discussed above.

Therefore, it is possible to limit the buckling of the seat surface of the metal plate 210 and the buckling of the contact surface of the metal plate 201. Furthermore, when the material, which has the high strength, is locally used, the manufacturing costs can be reduced.

In the first embodiment, the resin member 60 of the vane rotor 40 is made of the thermoset resin material. Therefore, it is possible to avoid adhesive wearing caused by influences of small vibrations, heat and pressure, which are generated at the time of slide movement of the vane rotor 40 relative to the housing 20 made of the resin material.

Second Embodiment

Figure 16:
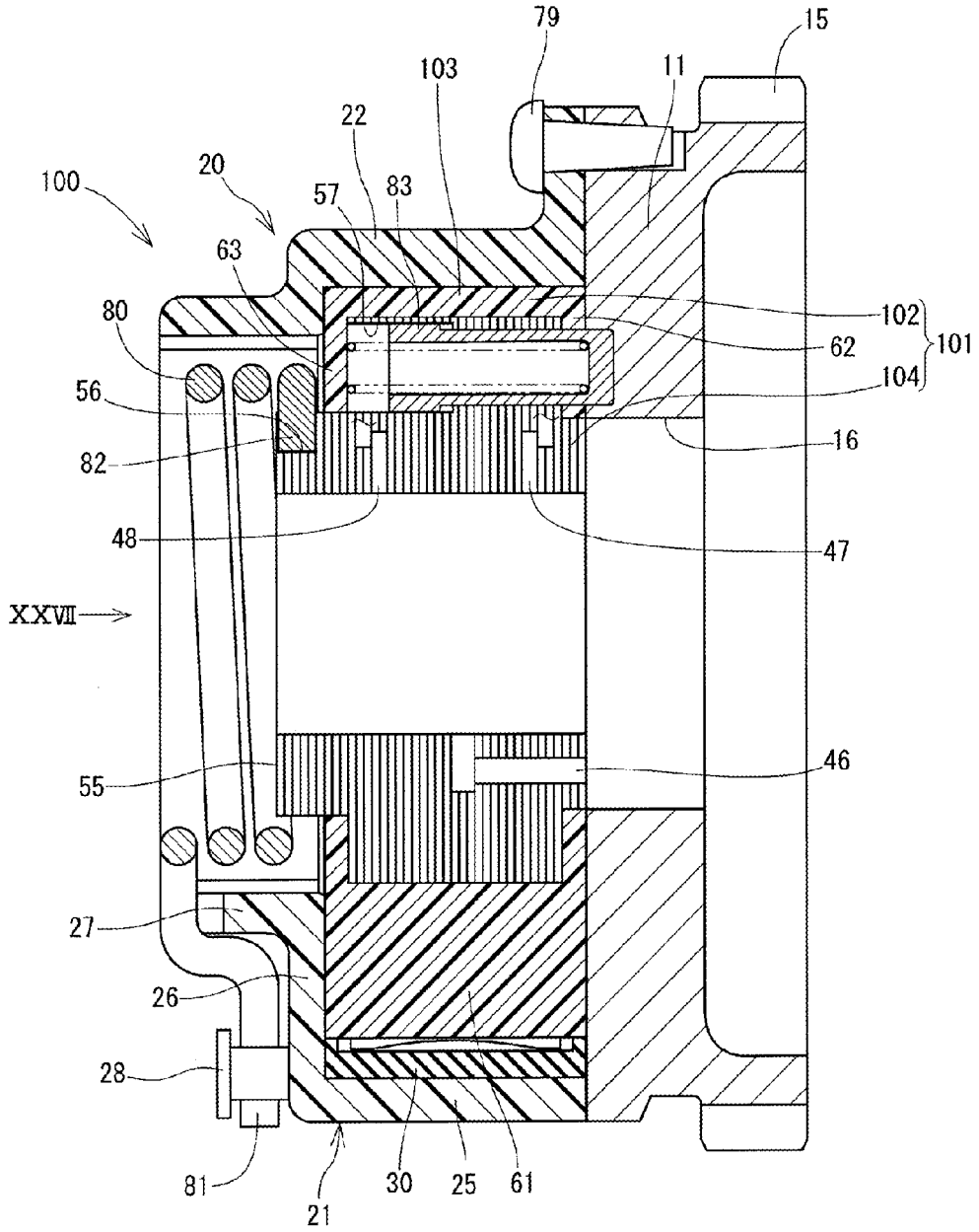
FIG. 16 is a longitudinal cross sectional view of a valve timing control apparatus according to a second embodiment of the present disclosure.
Figure 17:
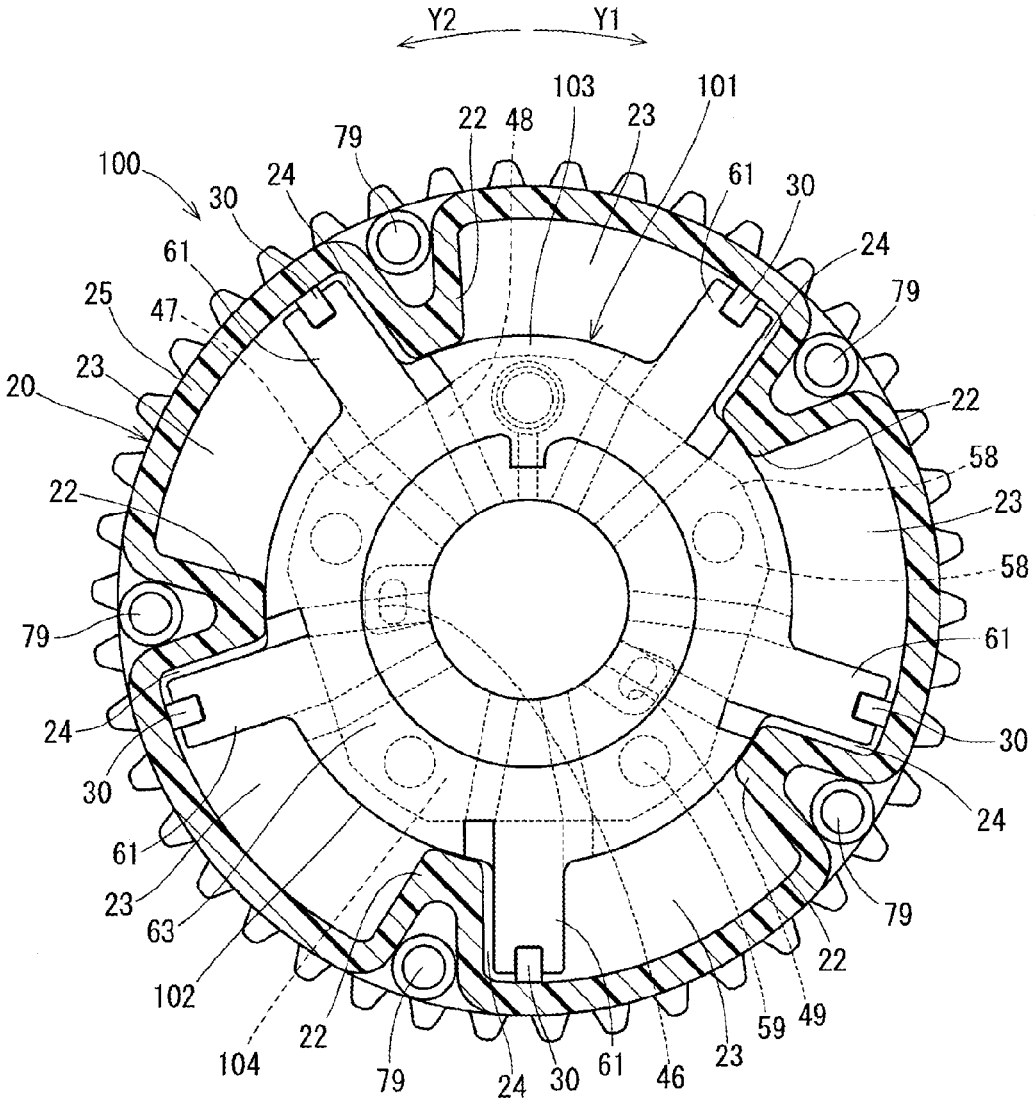
FIG. 17 is a schematic view of the valve timing control apparatus taken from a direction of an arrow XVII in FIG. 16 without depicting an outer shell of a housing and an assist spring for the sake of simplicity.

A valve timing control apparatus according to a second embodiment of the present disclosure will now be described with reference to FIGS. 16 and 17. In the valve timing control apparatus 100, the peripheral wall 103 of the resin member 102 of the vane rotor 101 is rotatably supported by the partitions 22 of the housing 20. The laminated body 104 is not supported by the sprocket 11 (see FIG. 16).

The resin member 102, which is made of the resin material, can be formed with a high precision through the molding process without requiring any additional process. Therefore, according to the second embodiment, it is possible to more effectively limit the variations in the radial size of the vane rotor 101 in comparison to the prior art vane rotor, which is made only of the metal plates. Thus, the axial gap between the housing 20 and the vane rotor 101 and the axial gap between the sprocket 11 and the vane rotor 101 can be minimized to reduce or minimize the oil leakage through such an axial gap(s). Thereby, the operational response of the valve timing control apparatus 100 and the holding stability of the operational state of the valve timing control apparatus 100 are both improved.

Third Embodiment

Figure 18:
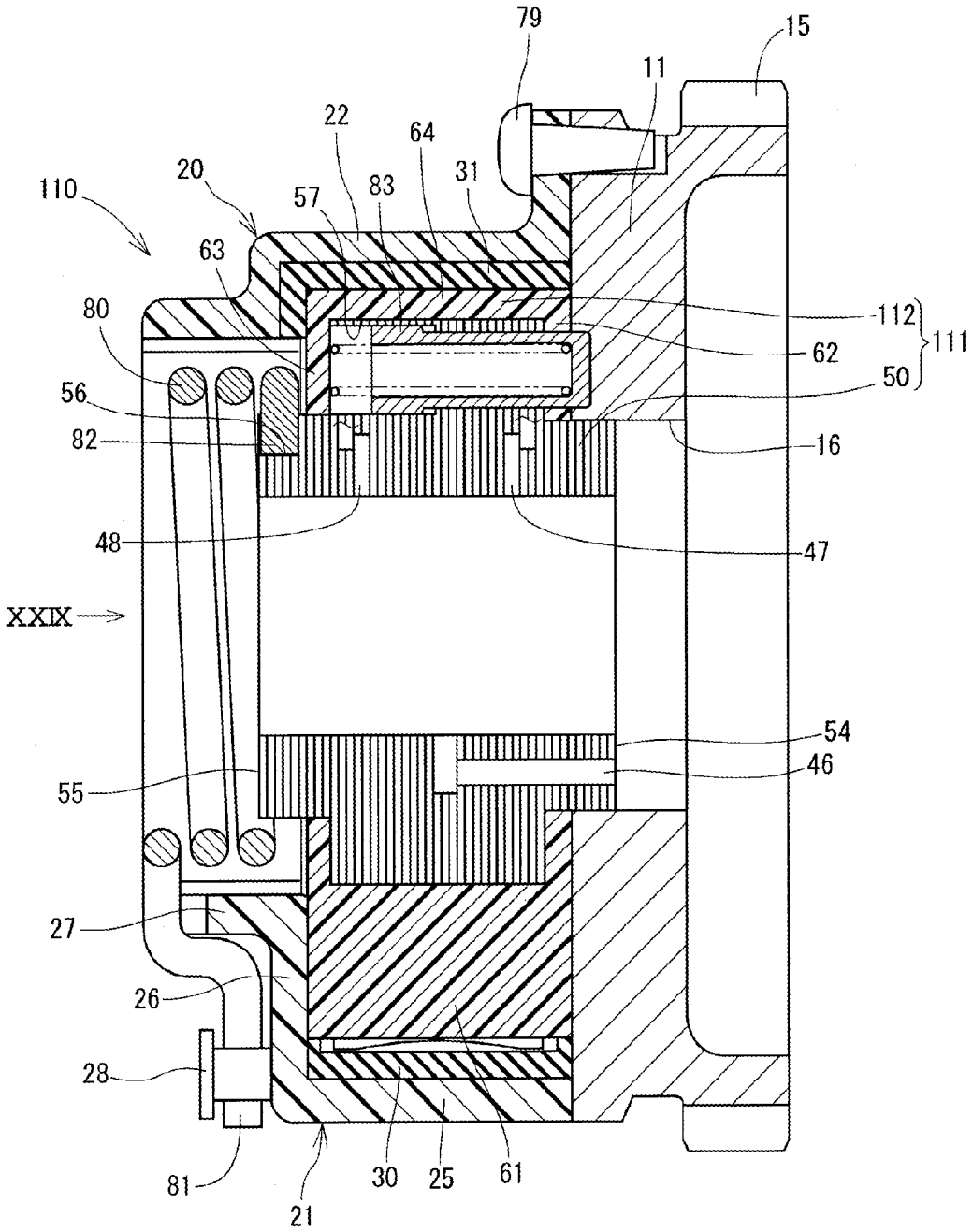
FIG. 18 is a longitudinal cross sectional view of a valve timing control apparatus according to a third embodiment of the present disclosure.
Figure 19:
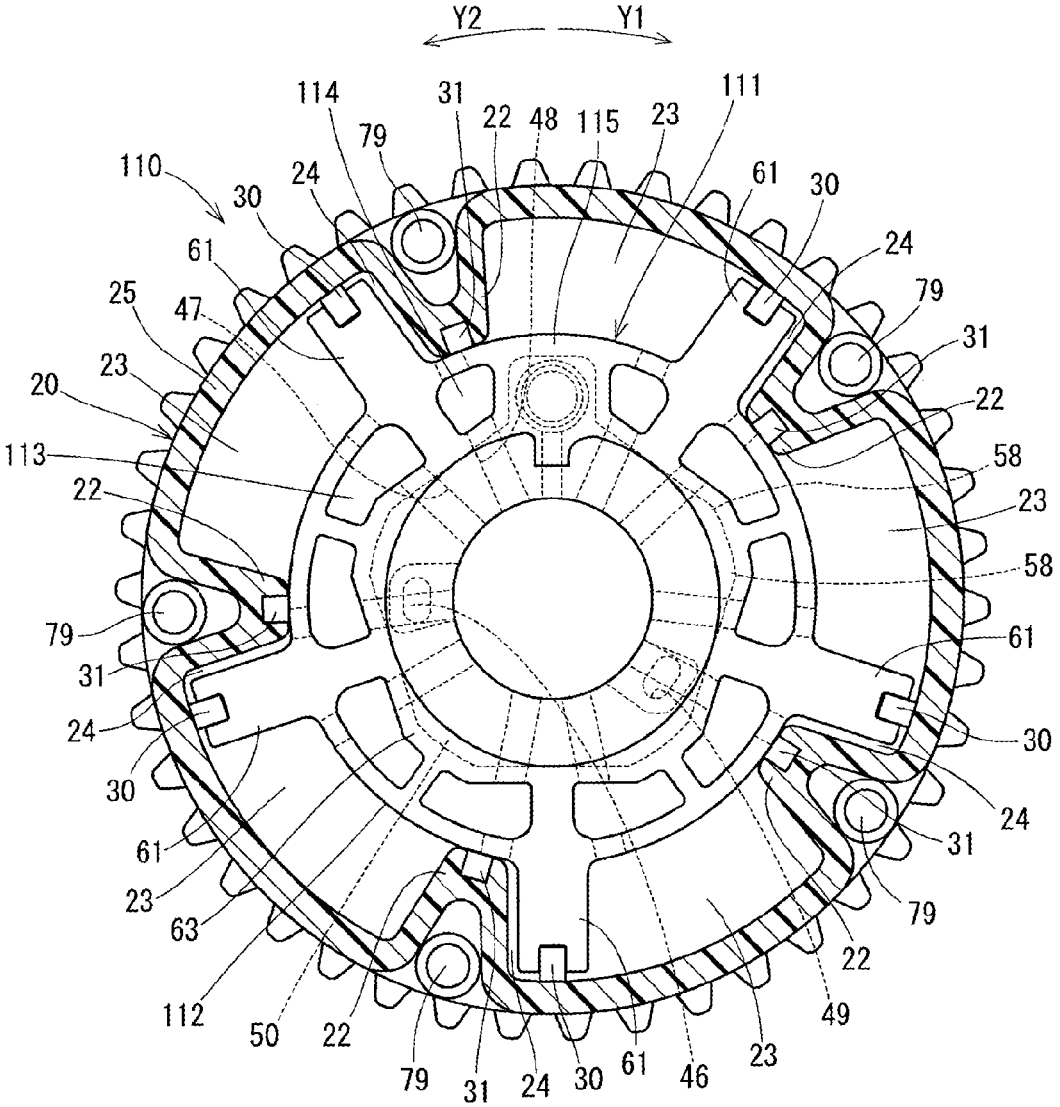
FIG. 19 is a schematic view of the valve timing control apparatus taken from a direction of an arrow XIX in FIG. 18 without depicting a portion of an outer shell of a housing and an assist spring for the sake of simplicity.

A valve timing control apparatus according to a third embodiment of the present disclosure will now be described with reference to FIGS. 18 and 19. In the valve timing control apparatus 110, the peripheral wall 115 of the resin member 112 of the vane rotor 111 includes a plurality of first holes (also referred to as advancing holes) 113 and a plurality of second holes (also referred to as retarding holes) 114. Each first hole 113 axially extends through the peripheral wall 115 at a corresponding circumferential position, which coincides with a corresponding one of the advancing oil passages 47. Each second hole 114 axially extends through the peripheral wall 115 at a corresponding circumferential position, which coincides with a corresponding one of the retarding oil passages 48. Each first hole 113 is communicated with a corresponding one of the advancing chambers 23 and forms an oil passage. Each second hole 114 is communicated with a corresponding one of the retarding chambers 24 and forms an oil passage.

According to the third embodiment, the weight of the resin member 60 can be reduced because of the first and second holes 113, 114. As a result, the weight of the vane rotor 111 and thereby the weight of the valve timing control apparatus 110 can be reduced to enable a reduction in the manufacturing costs.

Fourth Embodiment

Figure 20:
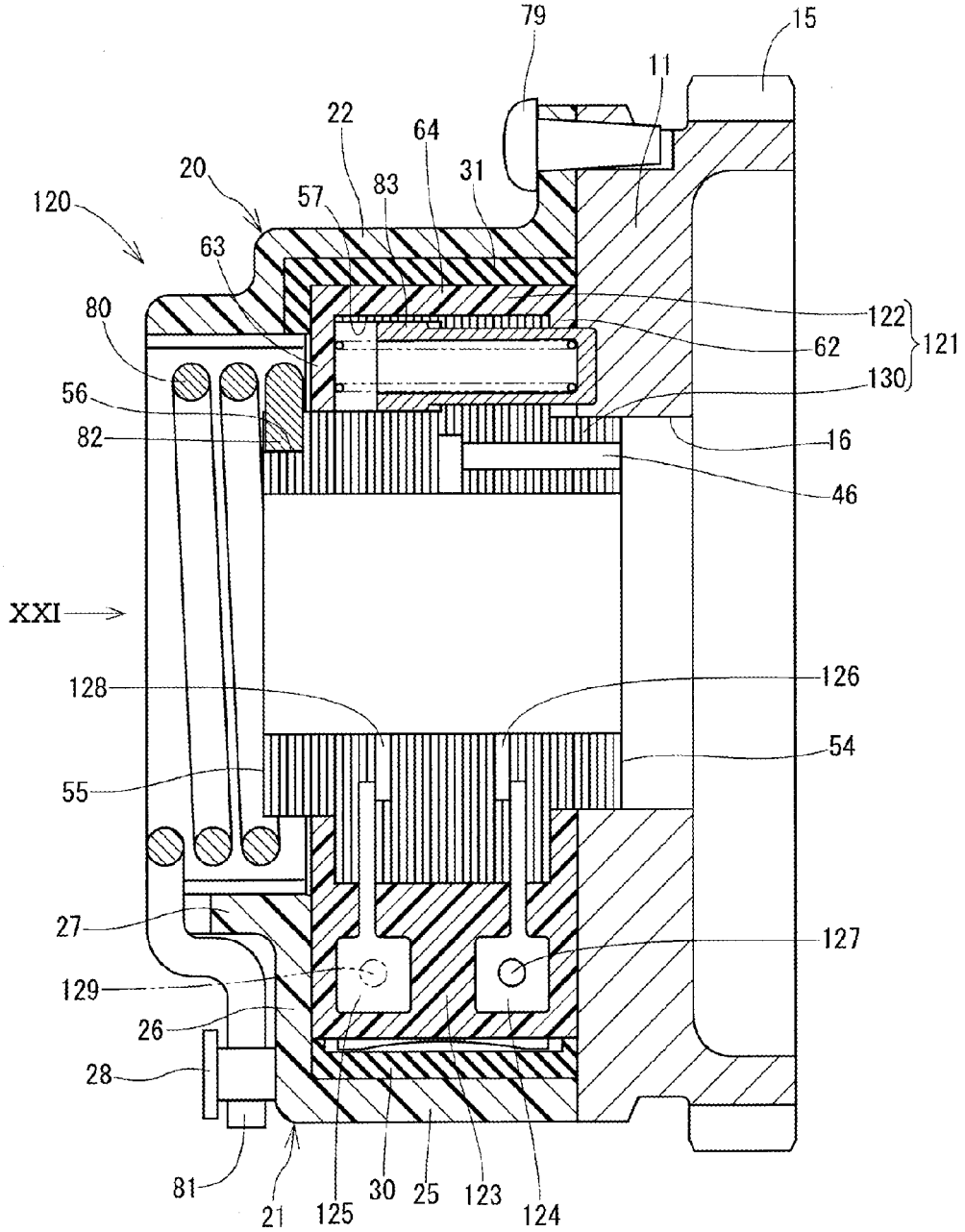
FIG. 20 is a longitudinal cross sectional view of a valve timing control apparatus according to a fourth embodiment of the present disclosure.
Figure 21:
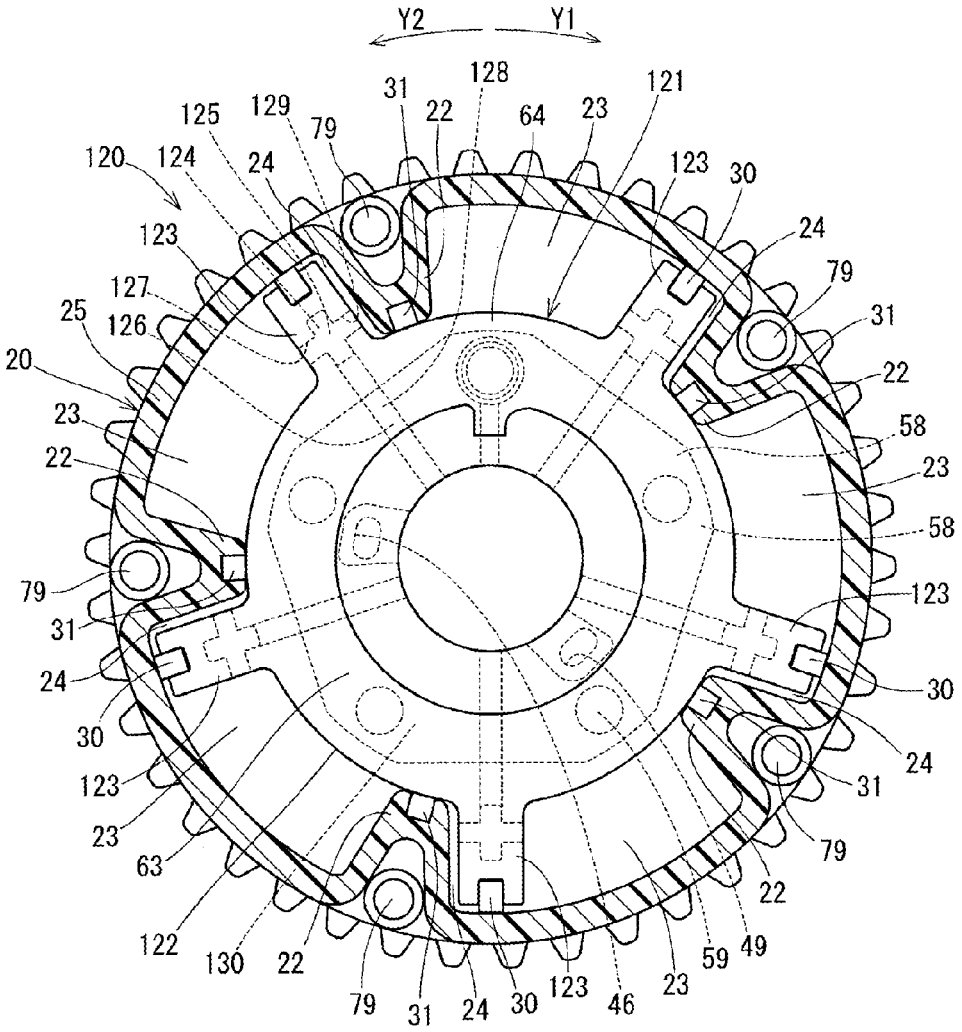
FIG. 21 is a schematic view of the valve timing control apparatus taken from a direction of an arrow XXI in FIG. 20 without depicting a portion of an outer shell of a housing and an assist spring for the sake of simplicity.

A valve timing control apparatus according to a fourth embodiment of the present disclosure will now be described with reference to FIGS. 20 and 21. In the valve timing control apparatus 120, each of the vanes 123 of the resin member 122 of the vane rotor 121 includes a third hole (also referred to as an advancing hole) 124 and a fourth hole (also referred to as a retarding hole) 125. The third hole 124 is communicated with the corresponding advancing chamber 23 and forms an oil passage. The fourth hole 125 is communicated with the retarding chamber 24 and forms an oil passage. The third hole 124 is placed at one axial side part of the vane 123, at which the sprocket 11 is located, and the fourth hole 125 is placed at the other axial side part of the vane 123, at which the bottom section 26 of the housing 20 is located. In each vane 123, the circumferential position of the third hole 124 coincides with the circumferential position of the fourth hole 125, and the third hole 124 and the fourth hole 125 are arranged one after another in the axial direction.

The vane rotor 121 includes a plurality of radially inner advancing oil passages (or simply referred to as advancing oil passages) 126, a plurality of radially outer advancing oil passages (or simply referred to as advancing oil passages) 127, a plurality of radially inner retarding oil passages (or simply referred to as retarding oil passages) 128, and a plurality of radially outer retarding oil passages (or simply referred to as retarding oil passages) 129. Each of the radially inner advancing oil passages 126 radially outwardly extends from the inner peripheral wall surface of the vane rotor 121 to a corresponding one of the third holes 124, and a corresponding one of the radially outer advancing oil passages 127 circumferentially extends from this third hole 124 to a corresponding one of the advancing chambers 23. Each of the radially inner retarding oil passages 128 radially outwardly extends from the inner peripheral wall surface of the vane rotor 121 to a corresponding one of the fourth holes 125, and a corresponding one of the radially outer retarding oil passages 129 circumferentially extends from this fourth hole 125 to a corresponding one of the retarding chambers 24. Each of the radially inner advancing oil passages 126 and the corresponding adjacent one of the radially inner retarding oil passages 128, which are adjacent to each other, are arranged such that the circumferential position of the radially inner advancing oil passage 126 coincides with the circumferential position of the radially inner retarding oil passage 128, and the radially inner advancing oil passage 126 and the radially inner retarding oil passage 128 are arranged one after another in the axial direction and are spaced from each other.

In the first embodiment, a cross-sectional area of an opening of each advancing oil passage 47 relative to the corresponding advancing chamber 23 becomes disadvantageously small when the vane rotor 40 is placed in the most advanced position. Furthermore, a cross-sectional area of an opening of each retarding oil passage 48 relative to the corresponding retarding chamber 24 becomes disadvantageously small when the vane rotor 40 is placed in the most retarded position.

With respect to the above disadvantages, according to the fourth embodiment, a cross-sectional area of an opening of each radially outer advancing oil passage 127 relative to the corresponding advancing chamber 23 is constant and is relatively large regardless of the rotational phase of the vane rotor 121, and a cross-sectional area of an opening of each radially outer retarding oil passage 129 relative to the corresponding retarding chamber 24 is constant and is relatively large regardless of the rotational phase of the vane rotor 121. Therefore, the flow of the hydraulic oil from the radially inner advancing oil passage 126 and the radially outer advancing oil passage 127 to the corresponding advancing chamber 23 becomes smooth. Also, the flow of the hydraulic oil from the radially inner retarding oil passage 128 and the radially outer retarding oil passage 129 to the corresponding retarding chamber 24 becomes smooth.

Furthermore, according to the fourth embodiment, the circumferential position of each radially inner advancing oil passage 126 coincides with the circumferential position of the corresponding adjacent radially inner retarding oil passage 128. Therefore, the type of the metal plate, which forms the radially inner advancing oil passages 126, can be the same as the type of the metal plate, which forms the radially inner retarding oil passages 128. Therefore, it is possible to reduce the number of types of the metal plates.

Fifth Embodiment

Figure 22:
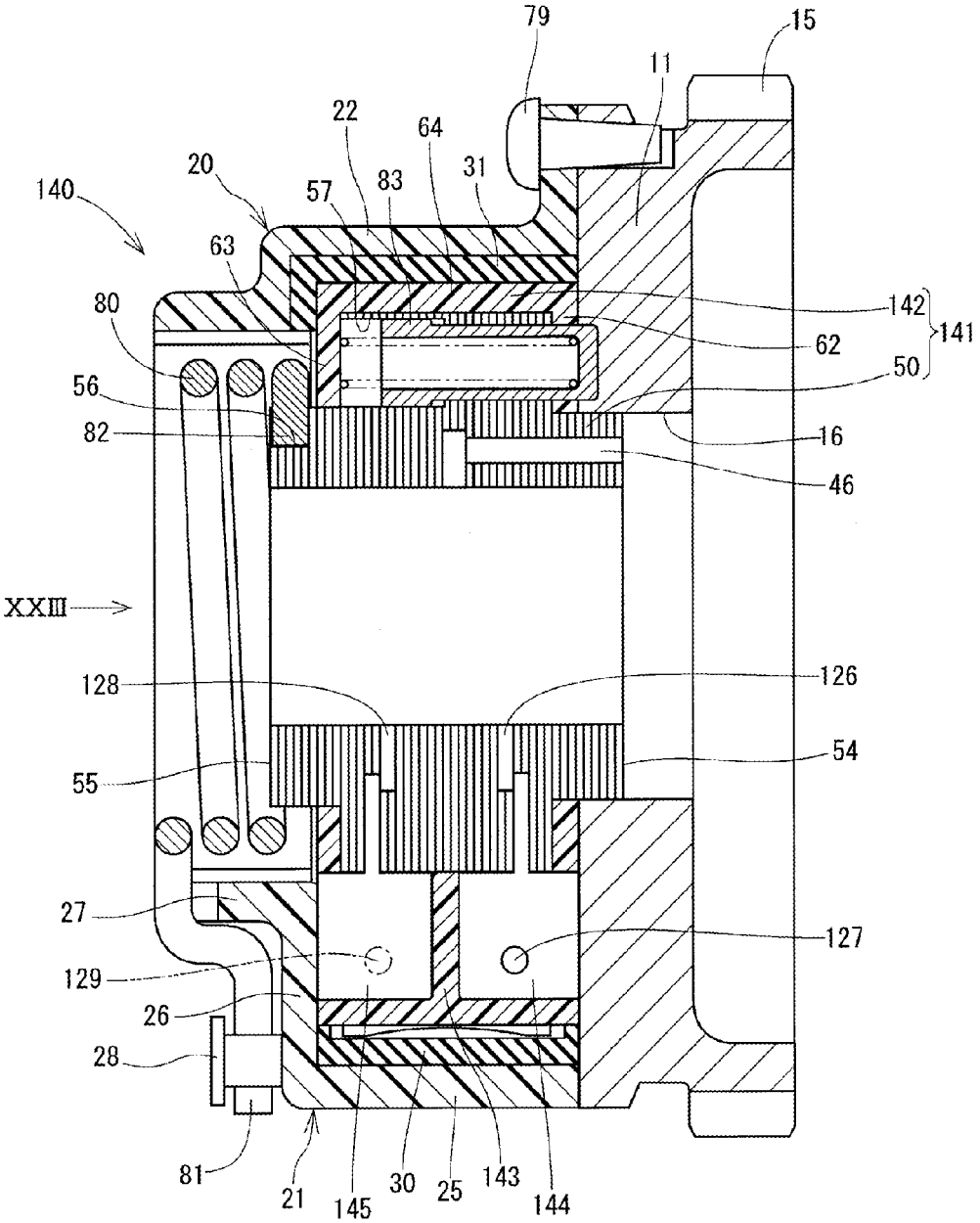
FIG. 22 is a longitudinal cross sectional view of a valve timing control apparatus according to a fifth embodiment of the present disclosure.
Figure 23:
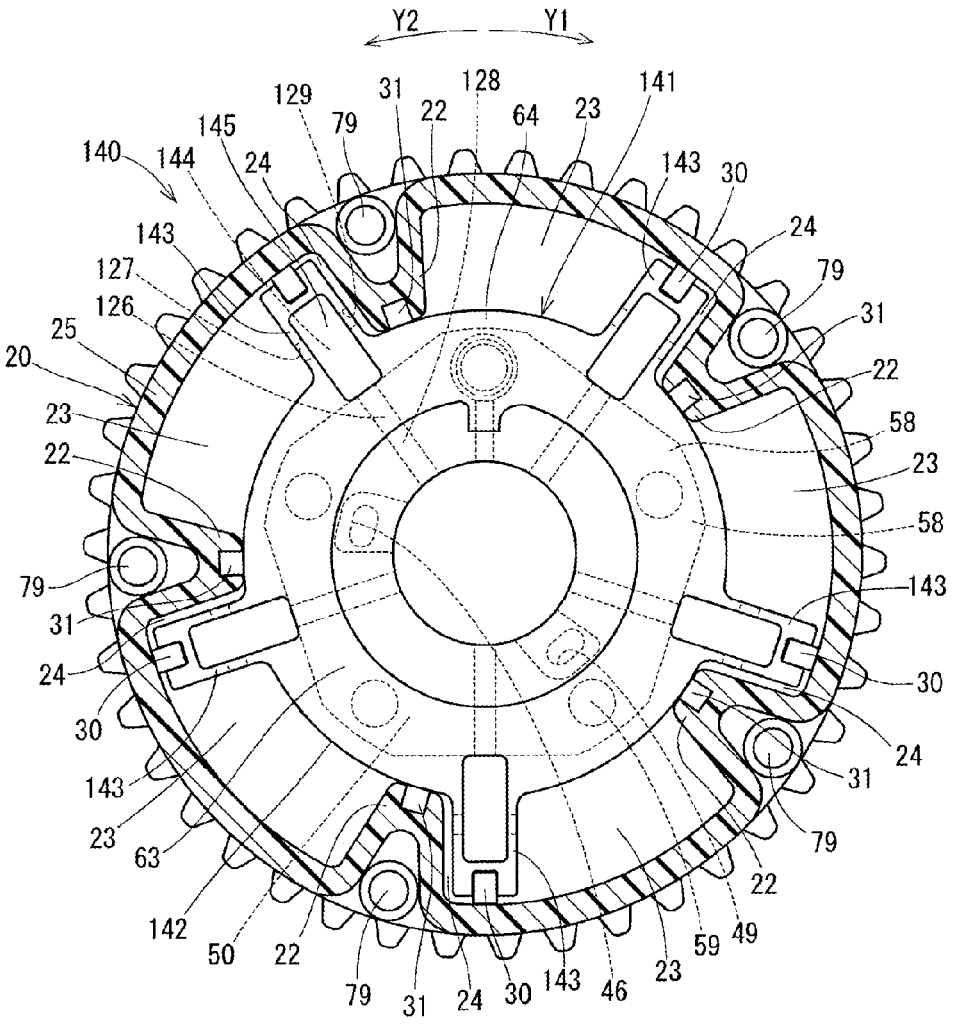
FIG. 23 is a schematic view of the valve timing control apparatus taken from a direction of an arrow XXIII in FIG. 22 without depicting a portion of an outer shell of a housing and an assist spring for the sake of simplicity.

A valve timing control apparatus according to a fifth embodiment of the present disclosure will now be described with reference to FIGS. 22 and 23. In the valve timing control apparatus 140, each of the vanes 143 of the resin member 142 of the vane rotor 141 includes the third hole (the advancing hole) 144 and the fourth hole (the retarding hole) 145. In the vane 143, the third hole 144 is configured such that the third hole 144 opens on the one axial side where the sprocket 11 is located, and a radially inner end of the third hole 144 is placed adjacent to the laminated body 130. Furthermore, in the vane 143, the fourth hole 145 is configured such that the fourth hole 145 opens on the other axial side where the bottom section 26 of the housing 20 is located, and a radially inner end of the fourth hole 145 is placed adjacent to the laminated body 130.

According to the fifth embodiment, the moldability of the resin member 142 is improved in comparison to the resin member 122 of fourth embodiment.

Sixth Embodiment

Figure 24:
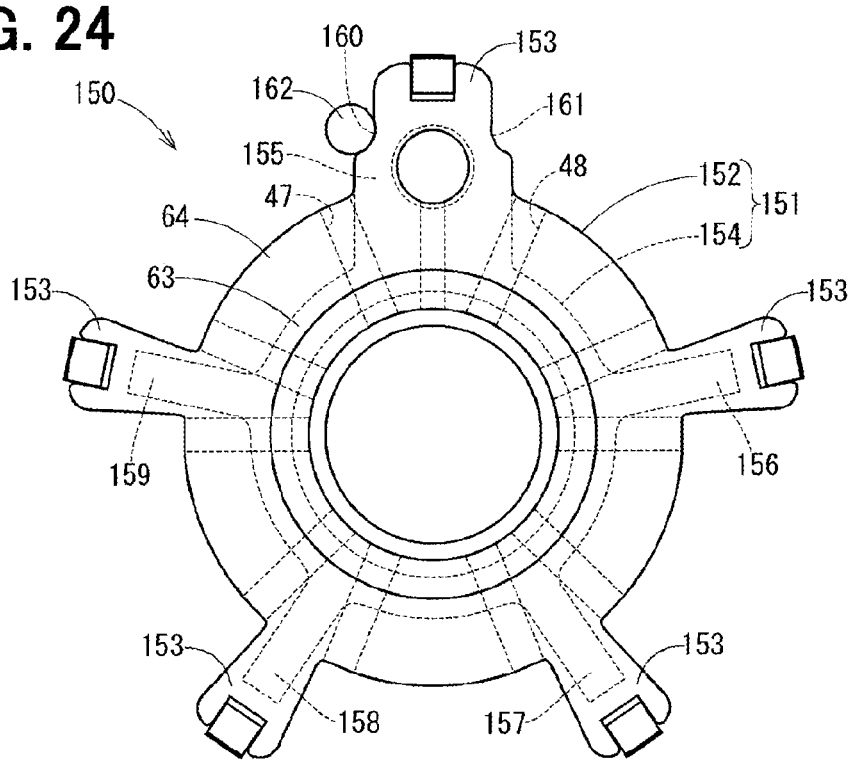
FIG. 24 is a front view of a vane rotor of a valve timing control apparatus according to a sixth embodiment of the present disclosure.

A valve timing control apparatus according to a sixth embodiment of the present disclosure will now be described with reference to FIG. 24. FIG. 24 shows only the vane rotor 151 and the stopper 162 for the sake of convenience.

The laminated body 154 of the vane rotor 151 of the valve timing control apparatus 150 includes a plurality (five in this instance) of projections 155-159, which are formed in the vanes 153, respectively, of the resin member 152. Each projection 155-159 functions as a reinforcing means (or a reinforcing portion) for reinforcing a root of the vane 153.

One of the projections 155-159, specifically, the projection 155 has a circumferential width that coincides with a circumferential width of the vane 153, and two circumferential side walls (serving as limiting portions) 160, 161, which are circumferentially opposed to each other, of the projection 155 are exposed outwardly from the resin member 152. The projection 155 serves as a limiting (or a limiting portion) means for limiting the relative rotation of the vane rotor 151 relative to the housing 20 when the projection 155 circumferentially contacts a stopper 162, which is fixed to the housing 20.

According to the sixth embodiment, the strength of the root of the vane 153 of the resin member 152 is increased. Furthermore, the projection 155, which is made of the metal material, contacts the stopper 162 upon rotation of the vane rotor 151. Therefore, the rotor vane 151 can effectively withstand the collision shock, which is generated at the time of contacting the projection 155 against the stopper 162.

Seventh Embodiment

Figure 25:
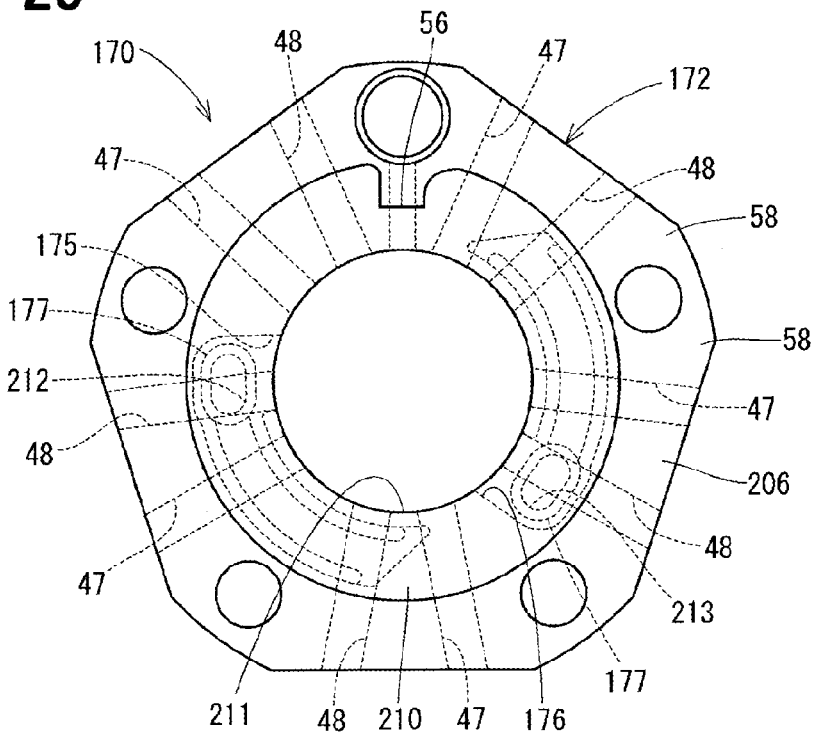
FIG. 25 is a front view of a laminated body of a vane rotor of a valve timing control apparatus according to a seventh embodiment of the present disclosure.

A valve timing control apparatus according to a seventh embodiment of the present disclosure will be described with reference to FIGS. 25 to 29. FIG. 25 shows only the laminated body 172 for the sake of convenience.

Figure 26:
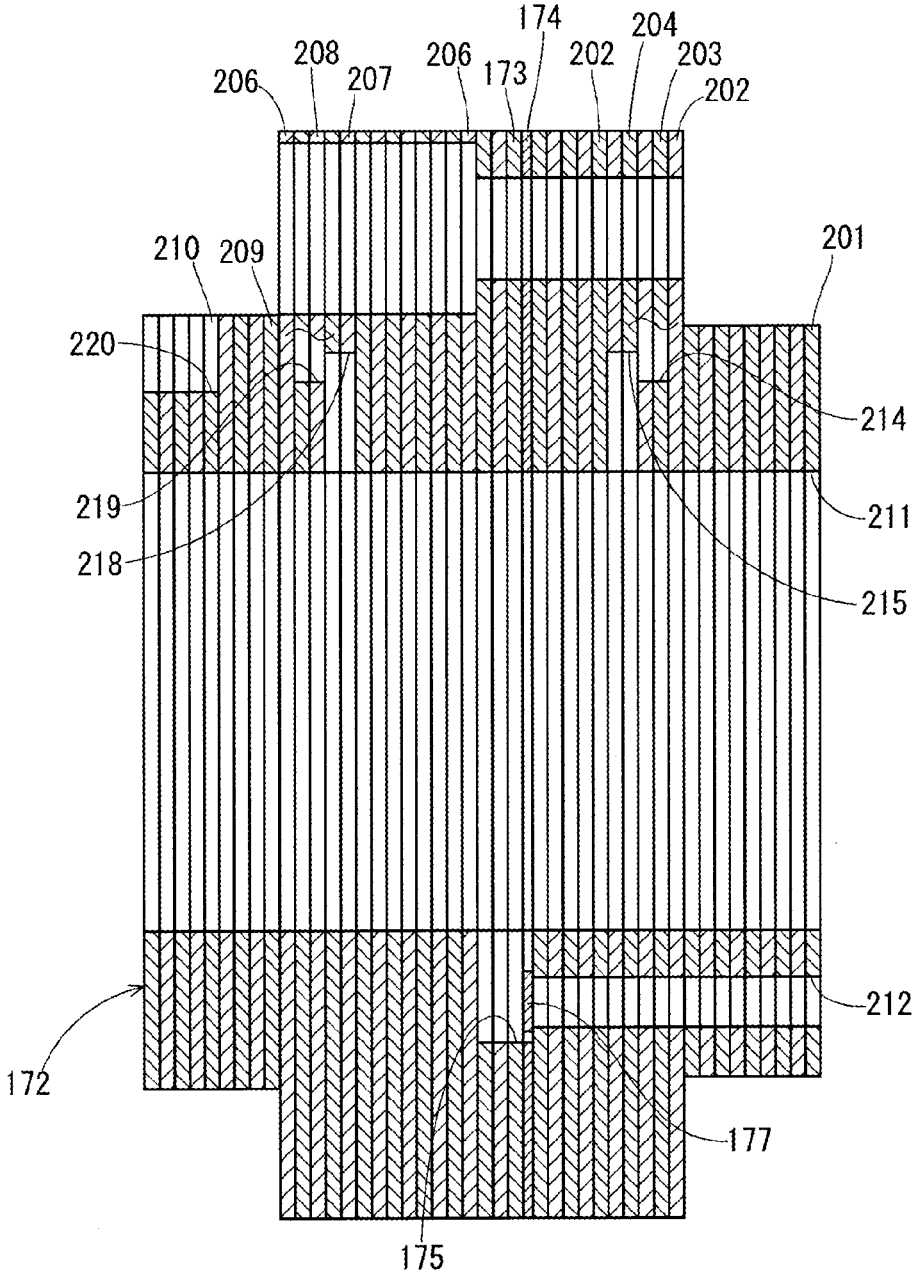
FIG. 26 is a schematic longitudinal cross sectional view of the laminated body of FIG. 25.

As shown in FIGS. 25 and 26, unlike the laminated body 50 of the first embodiment, the laminated body 172 of the valve timing control apparatus 170 includes metal plates 173 and a reed valve plate 174 in place of the corresponding metal plates 205 of the first embodiment.

Figure 27:
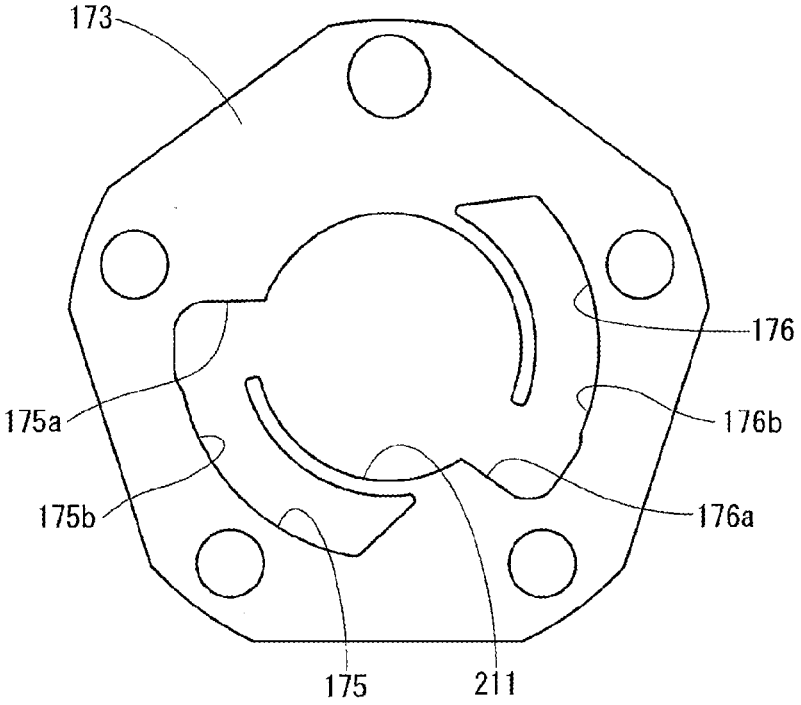
FIG. 27 is a plan view of one of metal plates of the laminated body of FIG. 26.

As shown in FIG. 27, each of the metal plates 173 is configured into a polygonal form, which is the same as the polygonal form of the metal plate 202 in the axial view. Furthermore, each of the metal plates 173 includes the fitting hole 211, a recess 175 and a recess 176. The recess 175 includes a radial recess section **175*a* and an arcuate section 175*b*. In the metal plate 173, the radial recess section 175*a* radially outwardly extends from a circumferential position, which is the same as the circumferential position of the oil hole 212, and the arcuate section 175*b* circumferentially extends from the radial recess section 175*a*. The recess 176 includes a radial recess section 176*a* and an arcuate section 176*b*. In the metal plate 173, the radial recess section 176*a* radially outwardly extends from a circumferential position, which is the same as the circumferential position of the oil hole 213, and the arcuate section 176*b* circumferentially extends from the radial recess section 176*a*. The recess 175 forms a portion of the supply oil passage 46, and the recess 176 forms a portion of the supply oil passage 49**.

Figure 28:
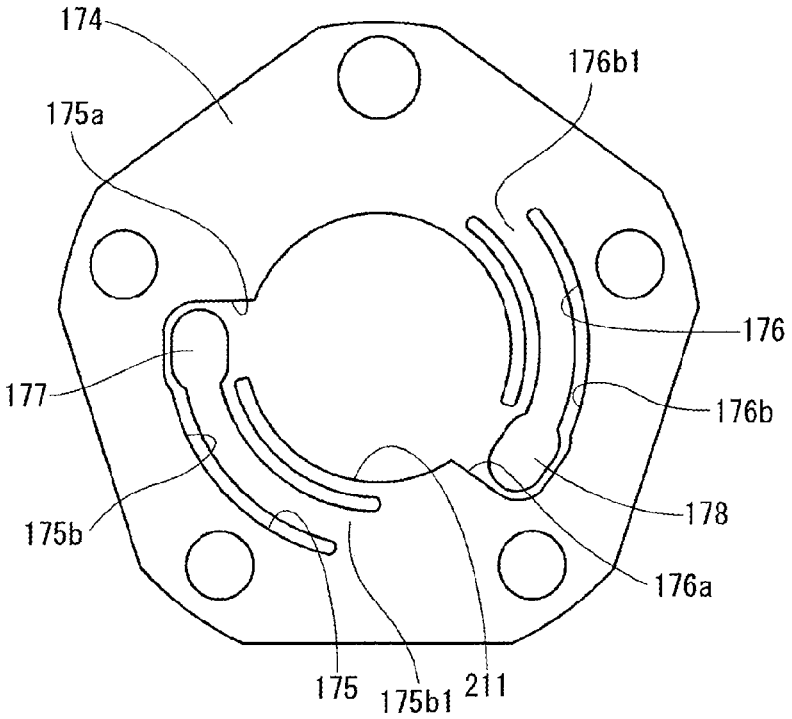
FIG. 28 is a plan view of a reed valve plate of the laminated body of FIG. 26.
Figure 29:
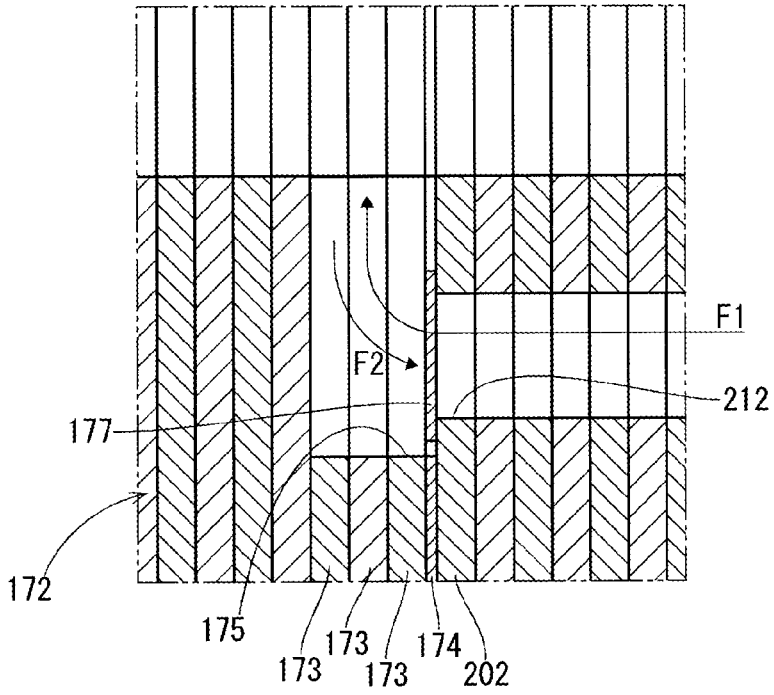
FIG. 29 is a schematic enlarged view of the laminated body of FIG. 26.

As shown in FIG. 28, the reed valve plate 174 is configured into a polygonal form, which is the same as the polygonal form of the metal plate 202 in the axial view. Furthermore, the reed valve plate 174 includes the fitting hole 211, the recess 175 and the recess 176. The reed valve plate 174 further includes a valve segment 177 and a valve segment 178. The valve segment 177 circumferentially extends from a circumferential end 175*b*1 of the arcuate section 175*b*, which is circumferentially opposite from the radial recess section 175*a*. The valve segment 178 circumferentially extends from a circumferential end 176*b*1 of the arcuate section 176*b*, which is circumferentially opposite from the radial recess section 176*a*. The valve segment 177 is liftable from and is seatable against a peripheral edge portion of the oil hole 212 of the adjacent metal plate 202, which is adjacent to the reed valve plate 174, to respectively open and close the oil hole 212. That is, the valve segment 177 enables a flow (see an arrow F1 in FIG. 29) of the oil from the oil pump 85 to the supply port 74 through the supply oil passage 46 by opening the oil hole 212 of the adjacent metal plate 202. In contrast, the valve segment 177 disables a flow (see an arrow F2 in FIG. 29) of the oil from the supply port 74 to the oil pump 85 through the supply oil passage 46 by closing the oil hole 212 of the adjacent metal plate 202. The valve segment 178 is liftable from and is seatable against a peripheral edge portion of the oil hole 213 of the adjacent metal plate 202, which is adjacent to the reed valve plate 174, to respectively open and close the oil hole 213 through valve opening movement and valve closing movement of the valve segment 178. That is, the valve segment 178 enables a flow of the oil from the oil pump 85 to the supply port 74 through the supply oil passage 49 by opening the oil hole 213 of the adjacent metal plate 202. In contrast, the valve segment 178 disables a flow of the oil from the supply port 74 to the oil pump 85 through the supply oil passage 49 by closing the oil hole 213 of the adjacent metal plate 202.

The metal plate 202 serves as an oil passage forming plate of the present disclosure. Furthermore, the recess 175 of the metal plate 173 serves as a relief space (a receiving space or simply referred to as a space), which receives the valve segment 177 when the valve segment 177 is lifted away from the peripheral edge portion of the oil hole 212 of the adjacent metal plate 202 during the valve opening movement of the valve segment 177. The recess 176 of the metal plate 173 serves as a relief space (a receiving space or simply referred to as a space), which receives the valve segment 178 when the valve segment 178 is lifted away from the peripheral edge portion of the oil hole 213 of the adjacent metal plate 202 during the valve opening movement of the valve segment 178. Thereby, the metal plate 173 serve as a relief plate of the present disclosure.

In a case of a prior art vane rotor, which is formed by a casting technique or a sintering technique, it is difficult to form a seat surface in a middle of a supply oil passage by an additional process, such as a mechanical process (e.g., a cutting process) and to provide a reed valve, which is seatable against this seat surface. That is, it is difficult to provide the reed valve in the inside of the vane rotor. Therefore, it is necessary to assemble the reed valve by using a separate member, which is formed separately from the vane rotor. Thus, a size of the valve timing control apparatus becomes disadvantageously large.

In contrast to this, according to the seventh embodiment, the reed valve plate 174 is included in the thin plates, which form the laminated body 172. Therefore, the reed valve plate 174 can be easily provided in the inside of the vane rotor. Thus, it is not necessary to use a separate member, such as a bushing, to assemble the reed valve to the vane rotor. As a result, the size of the valve timing control apparatus 10 can be reduced or minimized. Furthermore, since the bushing described above is not required according to the present embodiment, the number of the components can be reduced. Also, the process of assembling the components, such as the vane rotor, can be simplified.

Eighth Embodiment

Figure 30:
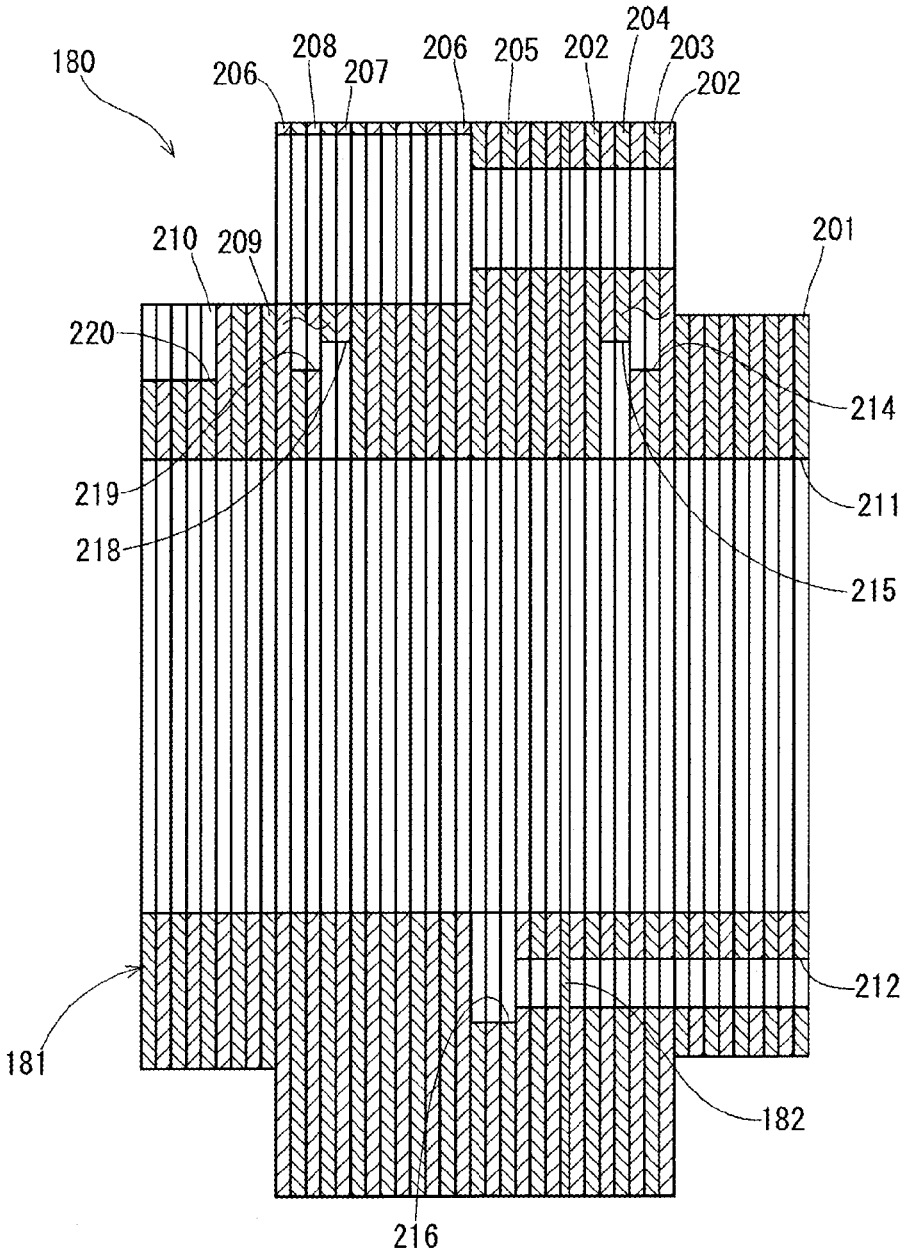
FIG. 30 is a longitudinal cross-sectional view of a laminated body of a vane rotor of a valve timing control apparatus according to an eighth embodiment of the present disclosure.

A valve timing control apparatus according to an eighth embodiment of the present disclosure will now be described with reference to FIGS. 30 and 31. FIG. 30 shows only the laminated body 181 for the sake of convenience.

Figure 31:
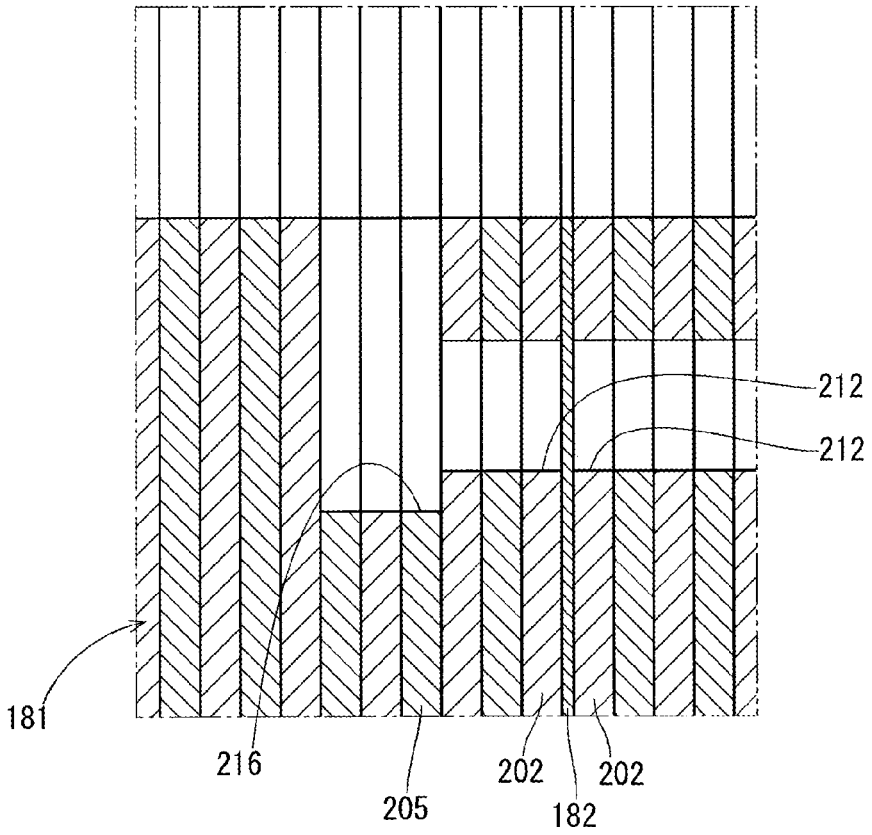
FIG. 31 is a partial enlarged view of the laminated body of FIG. 30.

As shown in FIGS. 30 and 31, unlike the laminated body 50 of the first embodiment, the laminated body 181 of the valve timing control apparatus 180 includes a filter 182, which is provided between corresponding two of the metal plates 202. The filter 182 is configured to capture foreign objects (e.g., dusts, debris), which are contained in the oil that flows in the supply oil passages 46, 49.

In the case of the prior art vane rotor, which is formed by, for example, the casting technique or the sintering technique, it is difficult to provide a filter in the inside of the vane rotor. Therefore, it is necessary to assemble the filter by using a separate member, which is formed separately from the vane rotor. Thus, a size of the valve timing control apparatus becomes disadvantageously large.

In contrast, according to the eighth embodiment, the filter 182 is included in the thin plates, which form the laminated body 181 of the vane rotor, and the filter 182 can be easily provided in the inside of the vane rotor. Thus, it is not necessary to use the separate member, such as the bushing, to assemble the filter. As a result, the size of the valve timing control apparatus can be reduced or minimized. Furthermore, since the bushing described above is not required according to the present embodiment, the number of the components can be reduced. Also, the process of assembling the components, such as the vane rotor, can be simplified.

Ninth Embodiment

Figure 32:
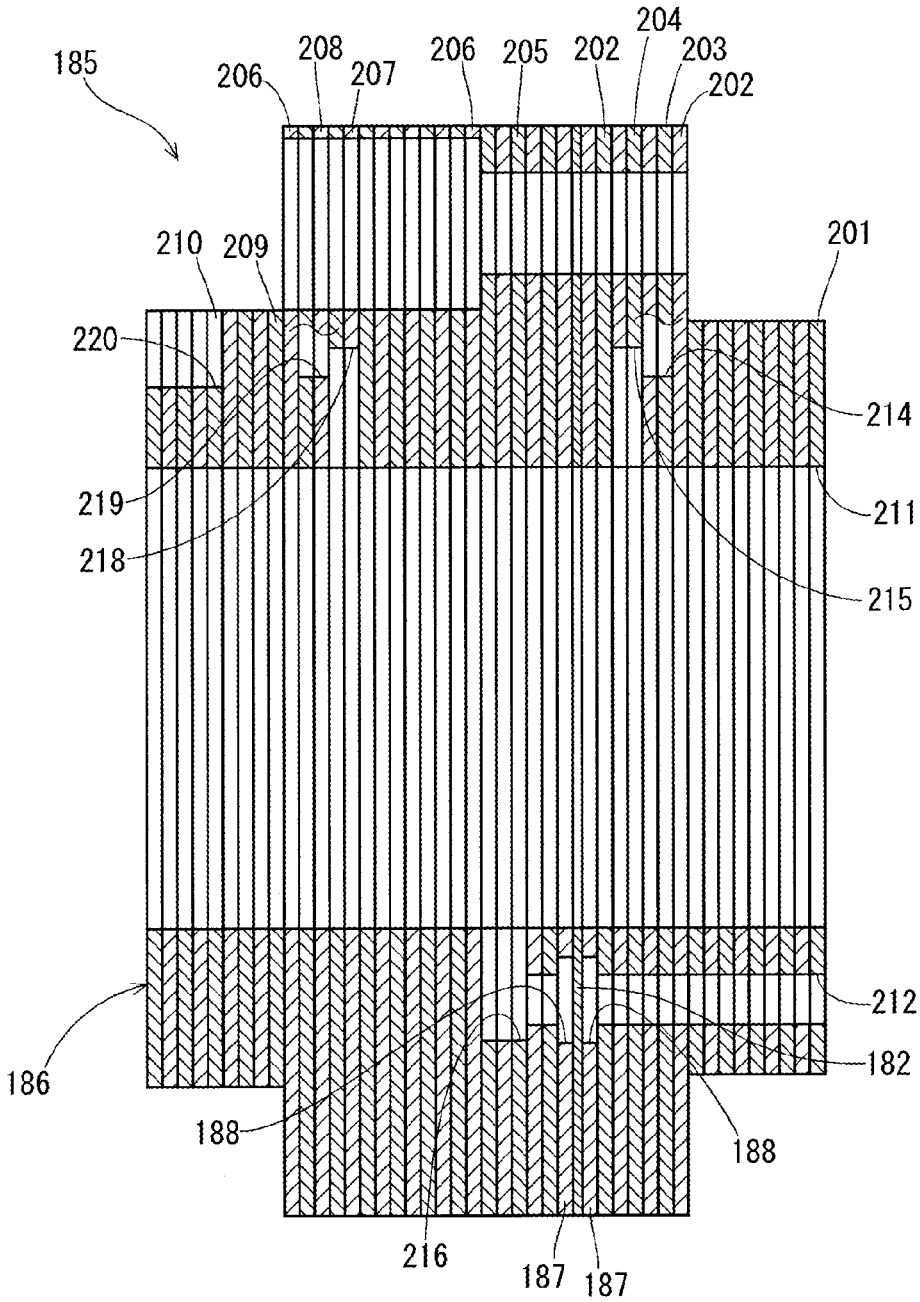
FIG. 32 is a longitudinal cross-sectional view of a laminated body of a vane rotor of a valve timing control apparatus according to a ninth embodiment of the present disclosure.

A valve timing control apparatus according to a ninth embodiment of the present disclosure will be described with reference to FIGS. 32 to 34. FIG. 32 shows only the laminated body 186 for the sake of convenience.

Figure 33:
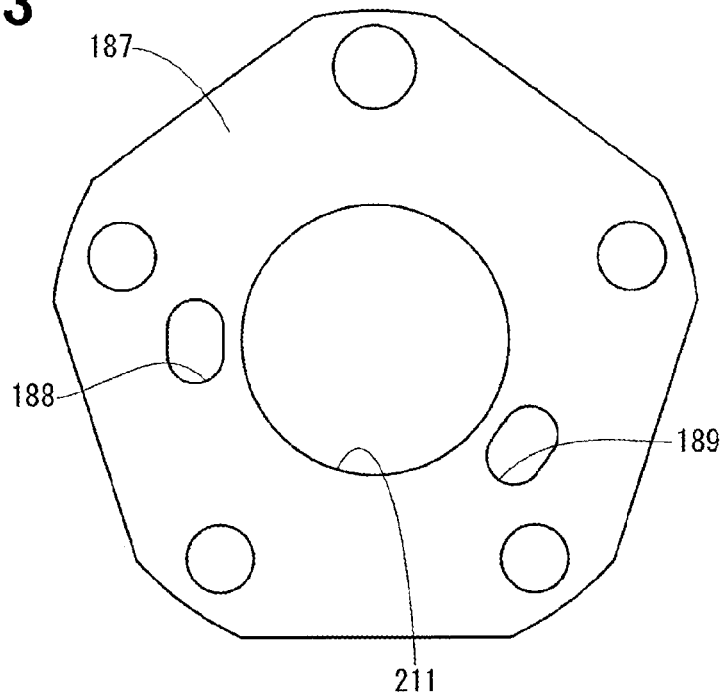
FIG. 33 is a plan view of one of metal plates of the laminated body of FIG. 32.
Figure 34:
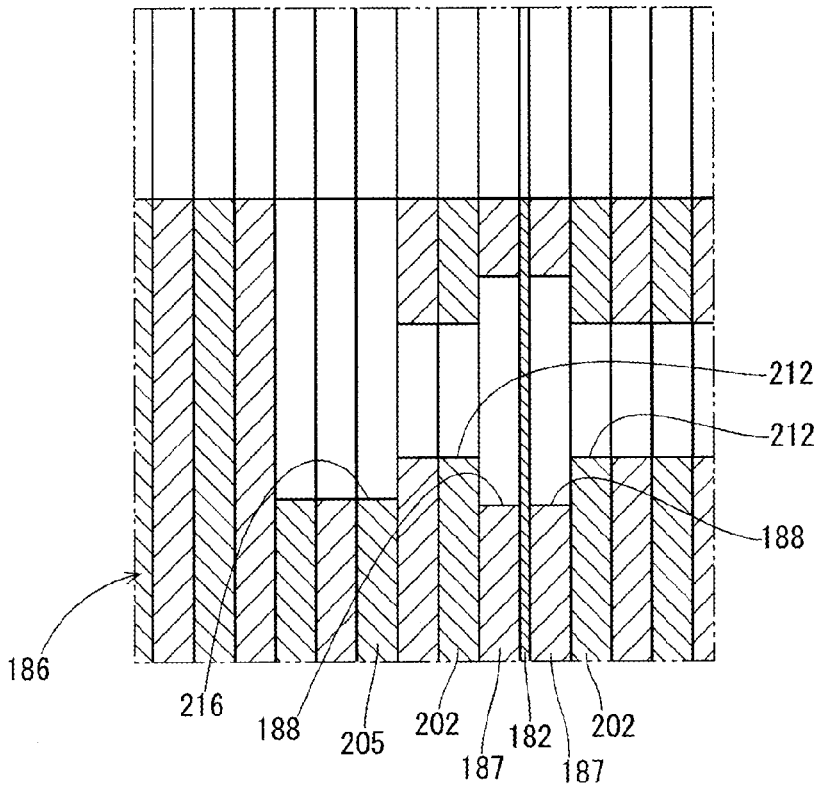
FIG. 34 is a partial enlarged view of the laminated body of FIG. 32.

As shown in FIGS. 32 to 34, the laminated body 186 of the valve timing control apparatus 185 of the present embodiment differs from the laminated body 181 of the eighth embodiment as follows. Specifically, two metal plates (serving as first and second enlarged oil passage forming plates) 187 are respectively placed on two axial sides, which are axially opposite to each other, of the filter 182. Each of the metal plates 187 includes an enlarged oil hole 188 and an enlarged oil hole 189. A passage cross-sectional area of the enlarged oil hole 188 is larger than a passage cross-sectional area of the oil hole 212, and a passage cross-sectional area of the enlarged oil hole 189 is larger than a passage cross-sectional area of the oil hole 213. The enlarged oil hole 188 forms an enlarged oil passage section, which has the locally enlarged passage cross section, in the middle of the supply oil passage 46. The enlarged oil hole 189 forms an enlarged oil passage section, which has the locally enlarged passage cross section, in the middle of the supply oil passage 49. In this way, the amount of the foreign objects, which can be captured by the filter 182, is increased. The metal plate 187 serves as an enlarged oil passage forming plate of the present disclosure.

In a case of the prior art vane rotor, which is formed by the casting technique or the sintering technique, it is difficult to form the enlarged oil passage section, which has the locally enlarged passage cross section, in the middle of the supply oil passage by the additional process, such as the mechanical process (e.g., the cutting process). Therefore, it is necessary to form the enlarged oil passage section, which has the locally enlarged passage cross section, in the middle of the supply oil passage by using a separate member, which is formed separately from the vane rotor. Thus, a size of the valve timing control apparatus becomes disadvantageously large.

In contrast, according to the ninth embodiment, the metal plates 187, which have the enlarged oil holes 188, 189, are included in the laminated body 186 of the vane rotor. Thereby, the enlarged oil passage section, which has the locally enlarged passage cross section, can be easily formed in the middle of the supply oil passage in the inside of the vane rotor. Therefore, it is not necessary to use a separate member, such as a bushing, to form the locally enlarged passage cross section in the middle of the supply oil passage. As a result, the size of the valve timing control apparatus can be reduced or minimized. Furthermore, since the bushing described above is not required according to the present embodiment, the number of the components can be reduced. Also, the process of assembling the components, such as the vane rotor, can be simplified.

Tenth Embodiment

Figure 35:
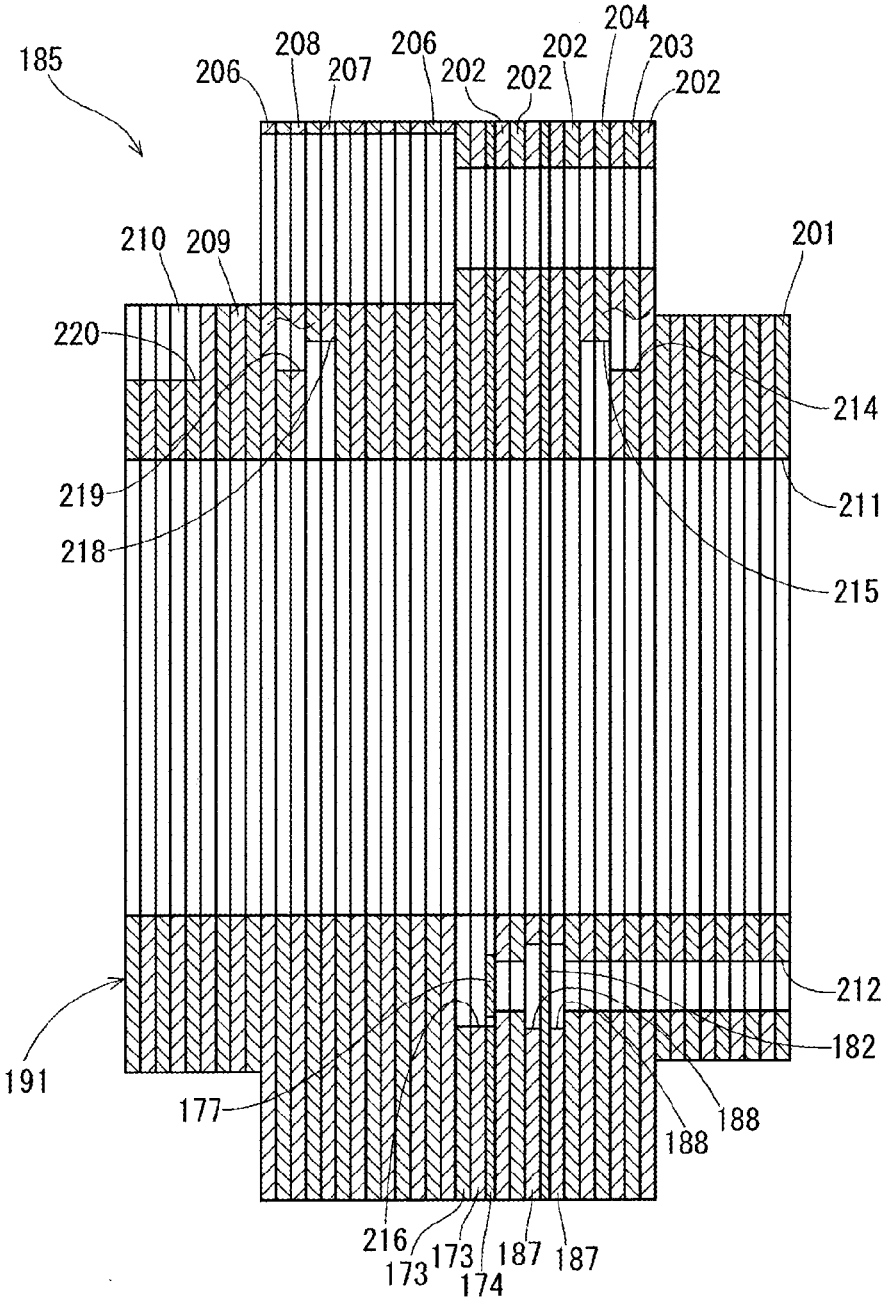
FIG. 35 is a longitudinal cross-sectional view of a laminated body of a vane rotor of a valve timing control apparatus according to a tenth embodiment of the present disclosure.

A valve timing control apparatus according to a tenth embodiment of the present disclosure will now be described with reference to FIGS. 35 and 36. FIG. 35 shows only the laminated body 191 for the sake of convenience.

Figure 36:
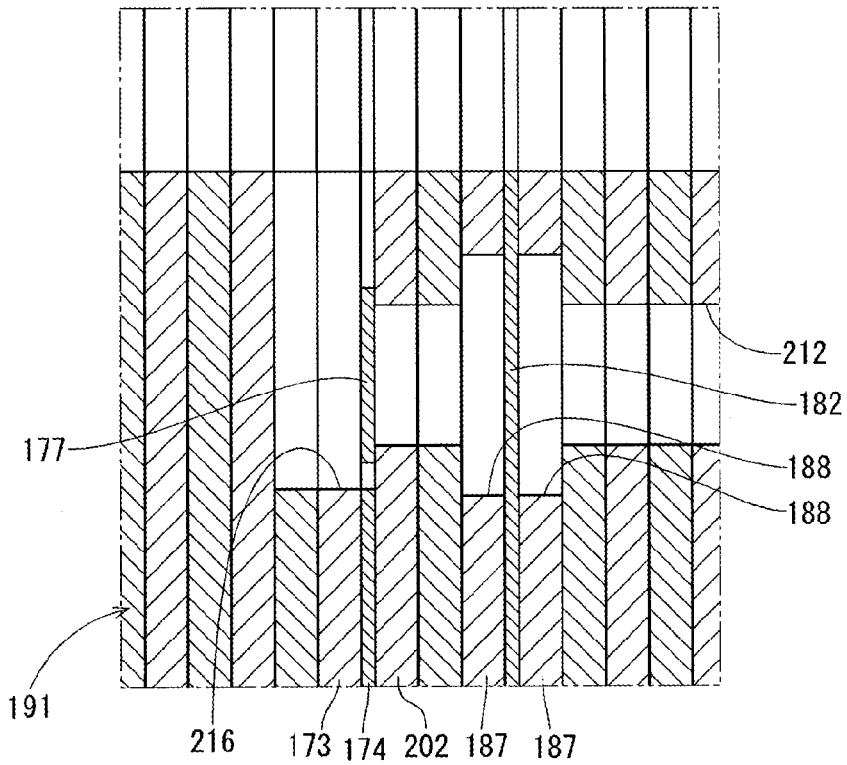
FIG. 36 is a partial enlarged view of the laminated body of FIG. 35.

As shown in FIGS. 35 and 36, the laminated body 191 of the valve timing control apparatus 190 differs from the laminated body 50 of the first embodiment with respect to that the laminated body 191 includes the reed valve plate 174, the metal plates 173, the filter 182 and the metal plates 187.

In the case of the prior art vane rotor, which is formed by the casting technique or the sintering technique, separate members, which are provided separately from the vane rotor, are required to provide the reed valve, the filter and the enlarged oil passages. That is, the member, which is required to assemble the reed valve, the member, which is required to assemble the filter, and the member, which is required to form the enlarged oil passages, are additionally required. Therefore, the size of the valve timing control apparatus is disadvantageously increased.

In contrast to this, according to the tenth embodiment, the reed valve plate 174, the filter 182 and the metal plates 187 are included in the thin plates, which form the laminated body 191 of the vane rotor. Therefore, the reed valve plate 174, the filter 182 and the enlarged oil passages can be easily provided in the inside of the vane rotor. Therefore, it is not necessary to use the separate members, such as the bushings. As a result, the size of the valve timing control apparatus can be reduced or minimized. Furthermore, since the bushings described above are not required according to the present embodiment, the number of the components can be reduced. Also, the process of assembling the components can be simplified.

(Eleventh Embodiment)

Figure 37:
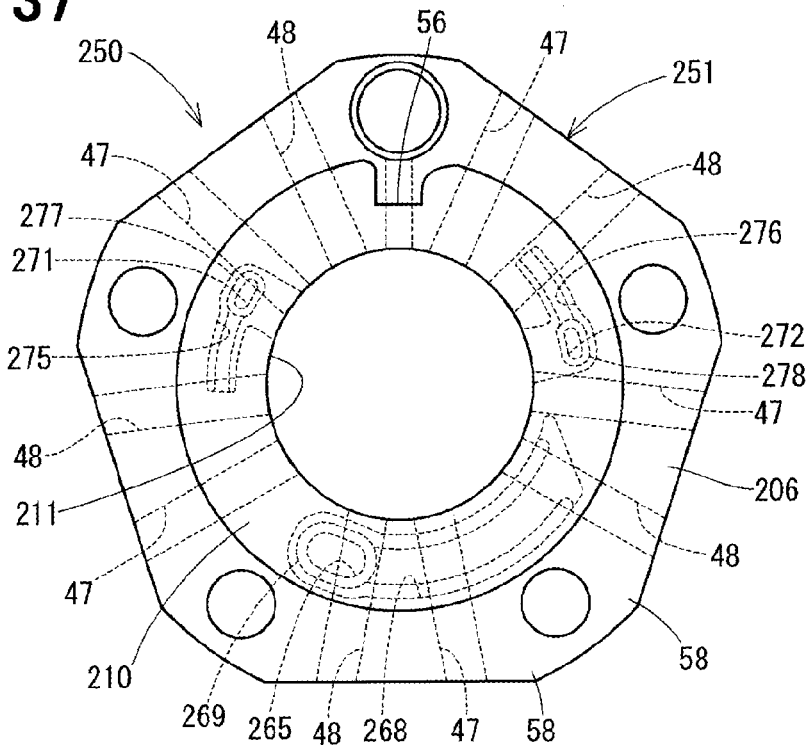
FIG. 37 is a front view of a vane rotor of a valve timing control apparatus according to an eleventh embodiment of the present disclosure.

A valve timing control apparatus according to an eleventh embodiment of the present disclosure will be described with reference to FIGS. 37 to 51. FIG. 37 shows only the laminated body 251 for the sake of convenience.

Figure 38:
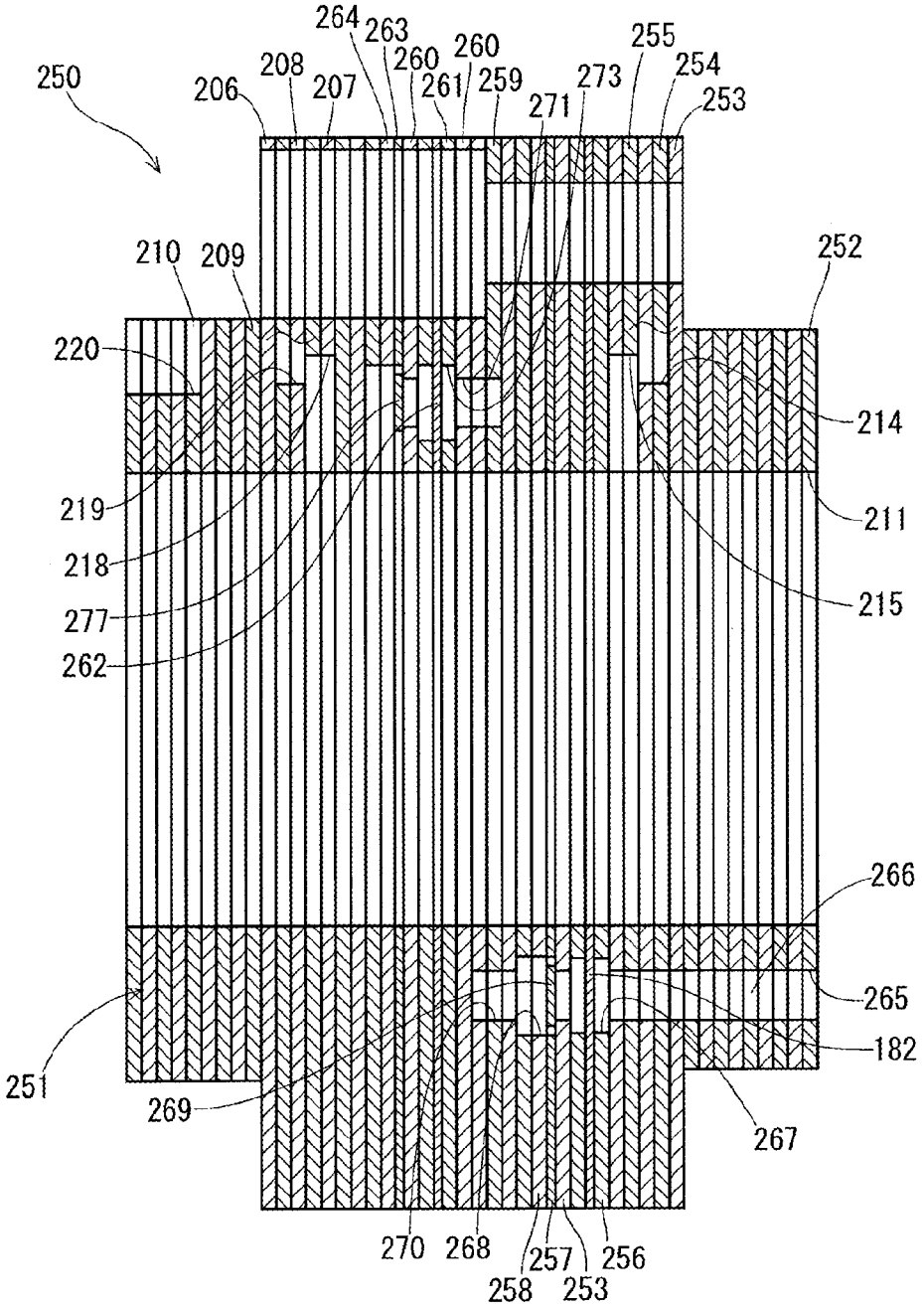
FIG. 38 is a longitudinal cross sectional view of the laminated body of FIG. 37.
Figure 39:
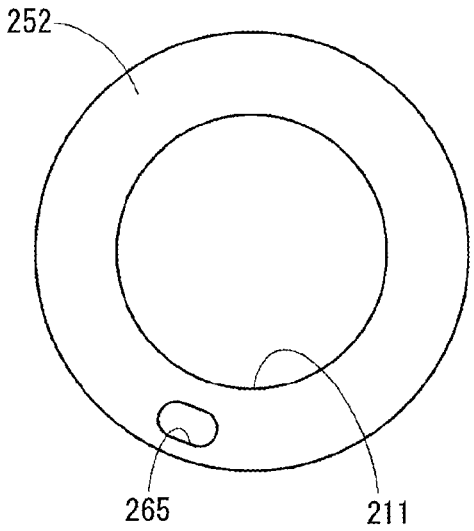
FIG. 39 is a plan view of a first type metal plate of the laminated body of FIG. 38.
Figure 40:
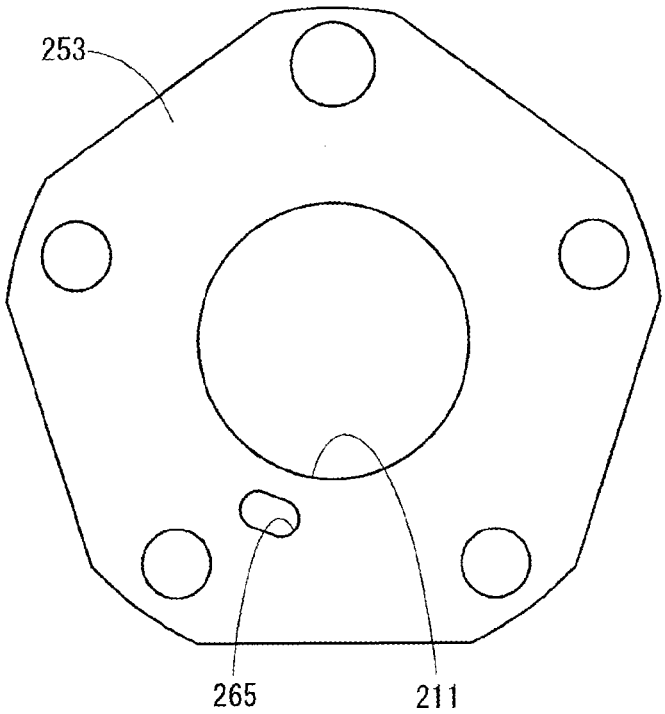
FIG. 40 is a plan view of a second type metal plate of the laminated body of FIG. 38.
Figure 41:
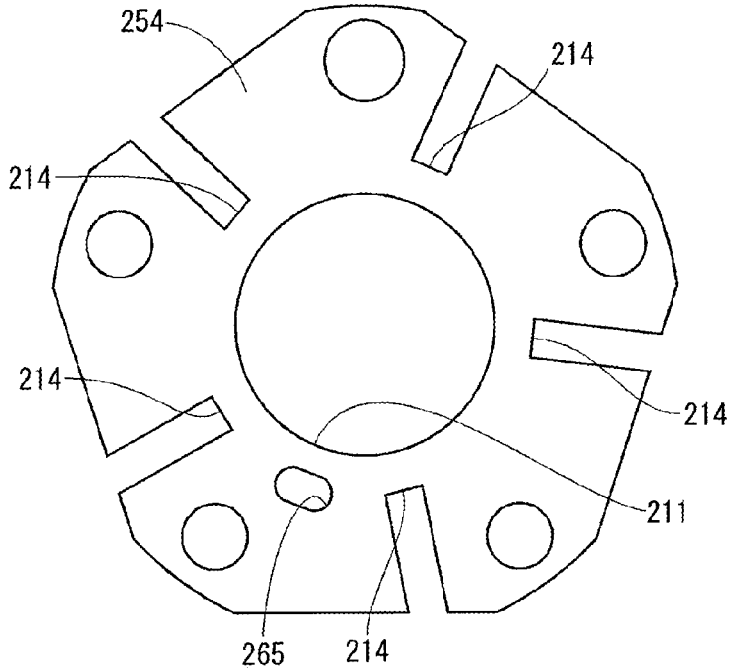
FIG. 41 is a plan view of a third type metal plate of the laminated body of FIG. 38.
Figure 42:
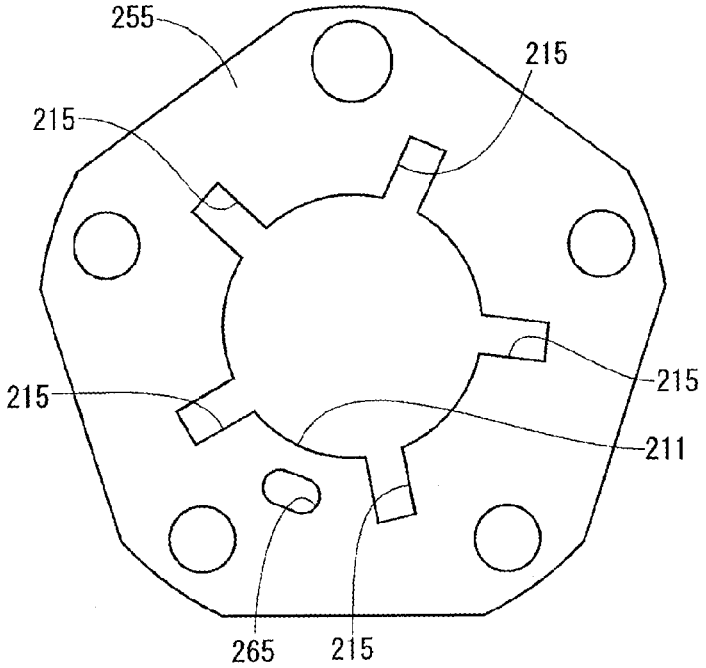
FIG. 42 is a plan view of a fourth type metal plate of the laminated body of FIG. 38.
Figure 43:
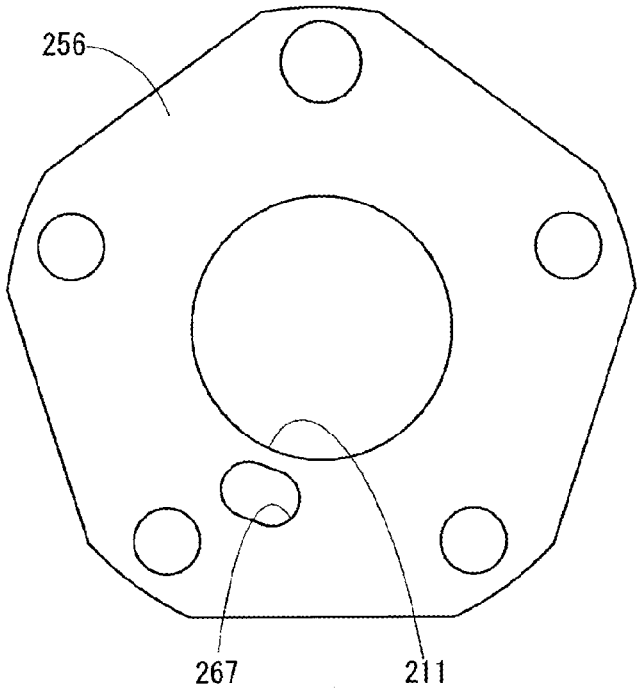
FIG. 43 is a plan view of a fifth type metal plate of the laminated body of FIG. 38.
Figure 44:
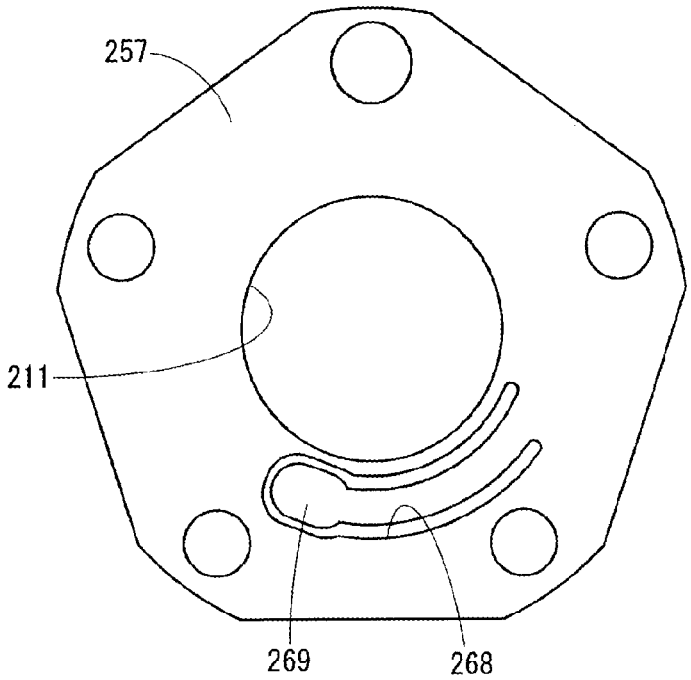
FIG. 44 is a plan view of a first type reed valve plate of the laminated body of FIG. 38.
Figure 45:
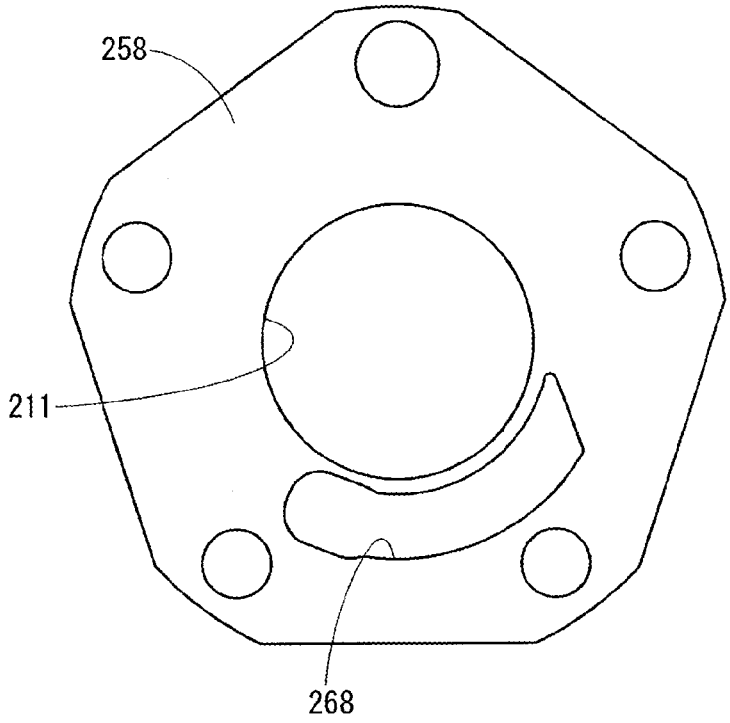
FIG. 45 is a plan view of a sixth type metal plate of the laminated body of FIG. 38.
Figure 46:
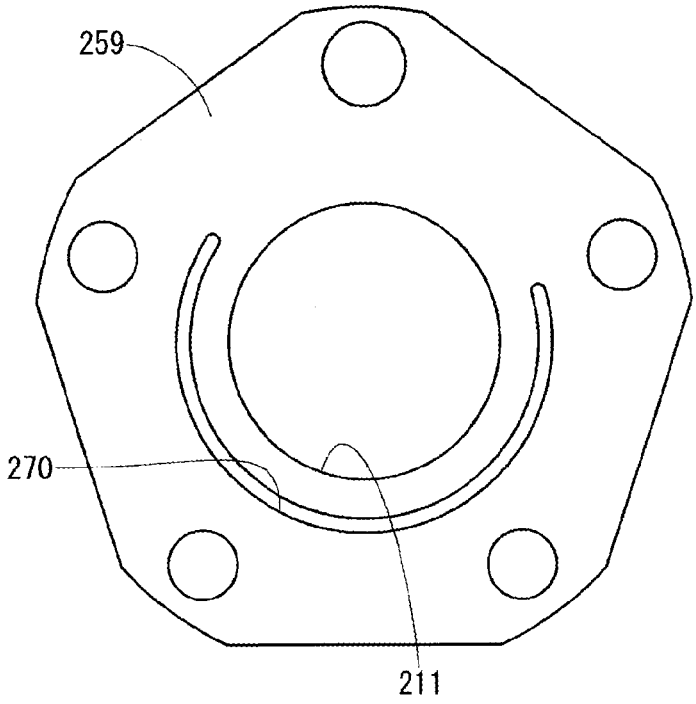
Figure 47:
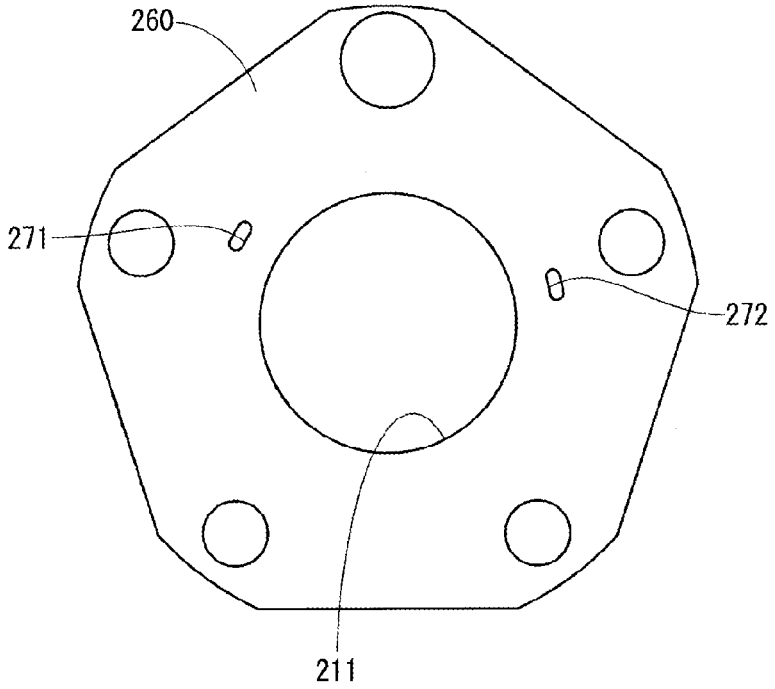
Figure 48:
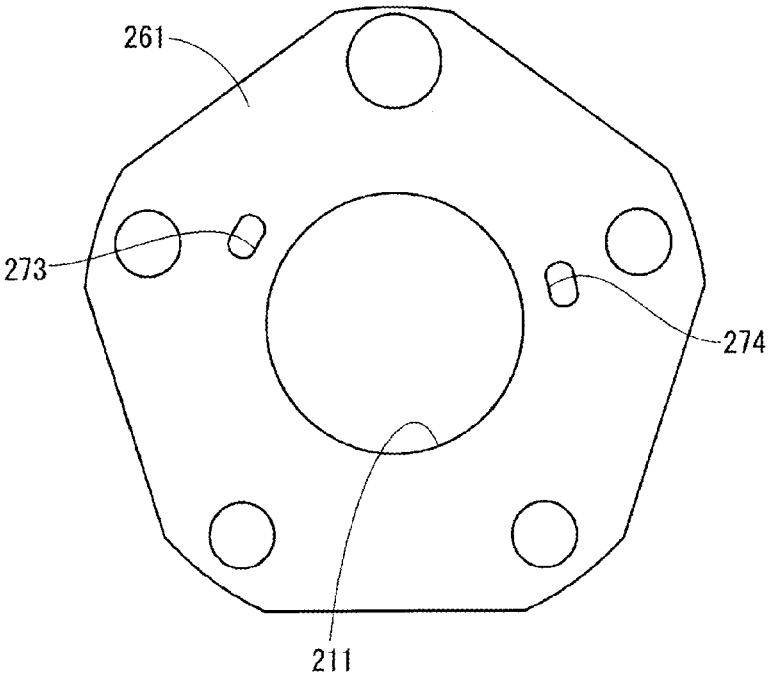
FIG. 48 is a plan view of a ninth type metal plate of the laminated body of FIG. 38.
Figure 49:
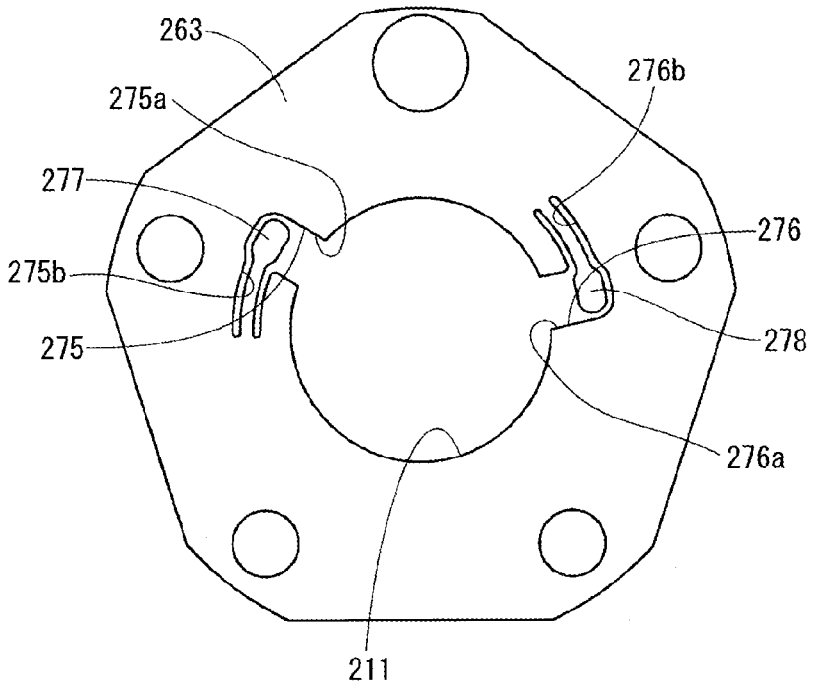
FIG. 49 is a plan view of a second type reed valve plate of the laminated body of FIG. 38.
Figure 50:
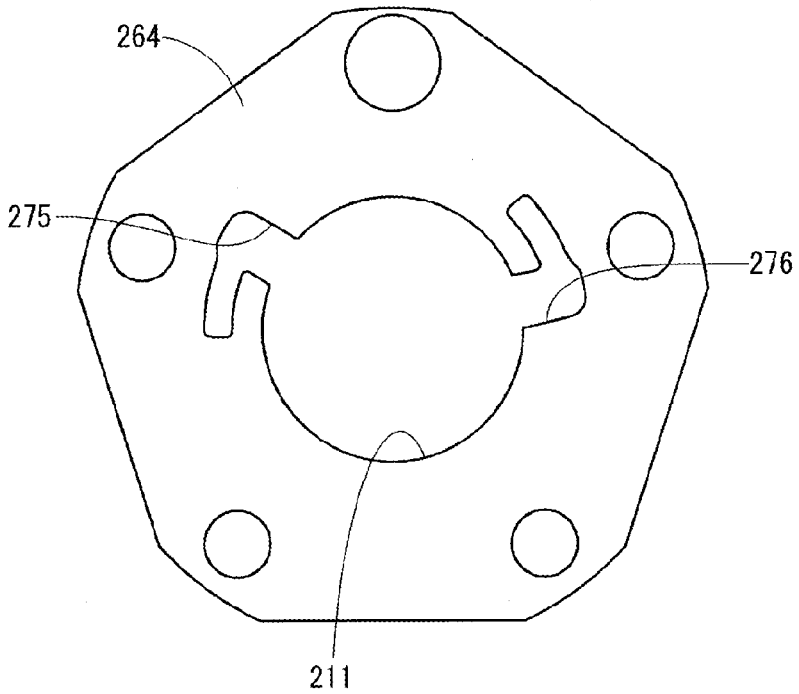
FIG. 50 is a plan view of a tenth type metal plate of the laminated body of FIG. 38.

As shown in FIGS. 37 and 38, the laminated body 251 of the valve timing control apparatus 250 includes a plurality of metal plates 252 of FIG. 39, a metal plate 253 of FIG. 40, a plurality of metal plates 254 of FIG. 41, a plurality of metal plates 255 of FIG. 42, a metal plate 256 of FIG. 43, the filter 182, the metal plate 256, the metal plate 253, a reed valve plate 257 of FIG. 44, a plurality of metal plates 258 of FIG. 45, the metal plate 253, a plurality of metal plates 259 of FIG. 46, a metal plate 260 of FIG. 47, a metal plate 261 of FIG. 48, a filter 262, the metal plate 261, the metal plate 260, a reed valve plate 263 of FIG. 49, a plurality of metal plates 264 of FIG. 50, a plurality of metal plates 206, a plurality of metal plates 207, a plurality of metal plates 208, the metal plate 206, a plurality of metal plates 209 and a plurality of metal plates 210, which are axially stacked one after another in this order.

As shown in FIG. 39, the metal plate 252 is configured into a circular form and includes the fitting hole 211 and an oil hole 265. The oil hole 265 is a hole that forms a part of a supply oil passage 266.

As shown in FIG. 40, the metal plate (serving as an oil passage forming plate) 253 is configured into a polygonal form in the axial view and includes the fitting hole 211 and the oil hole 265.

As shown in FIG. 41, the metal plate 254 is configured into a polygonal form, which is the same as the polygonal form of the metal plate 253 in the axial view. The metal plate 254 includes the fitting hole 211, the oil hole 265 and the radial recesses 214.

As shown in FIG. 42, the metal plate 255 is configured into a polygonal form, which is the same as the polygonal form of the metal plate 253 in the axial view. The metal plate 255 includes the fitting hole 211, the oil hole 265 and the radial recesses 215.

As shown in FIG. 43, the metal plate 256 is configured into a polygonal form, which is the same as the polygonal form of the metal plate 253 in the axial view. The metal plate 256 includes the fitting hole 211 and an enlarged oil hole 267. The enlarged oil hole 267 has a passage cross-sectional area, which is larger than a passage cross-sectional area of the oil hole 265. Thereby, the enlarged oil hole 267 forms an enlarged oil passage section, which has the locally enlarged passage cross section, in the middle of the supply oil passage 266. The metal plate 256 serves as an enlarged oil passage forming plate of the present disclosure.

As shown in FIG. 44, the reed valve plate 257 is configured into a polygonal form, which is the same as the polygonal form of the metal plate 253 in the axial view. The reed valve plate 257 includes the fitting hole 211 and a through-hole 268 and forms a valve segment 269. The through-hole 268 is an arcuate hole, which circumferentially extends from a circumferential position, which the same as the circumferential position of the oil hole 265. The through-hole 268 forms a portion of the supply oil passage 266. The valve segment 269 extends circumferentially from a circumferential end of the through-hole 268, which is circumferentially opposite from the oil hole 265. The valve segment 269 is liftable from and is seatable against a peripheral edge portion of the oil hole 265 of the adjacent metal plate 253, which is adjacent to the reed valve plate 257, to respectively open and close the oil hole 265. That is, the valve segment 269 enables a flow (see an arrow F3 in FIG. 51) of the oil from the oil pump 85 to the supply port 74 through the supply oil passage 266 by opening the oil hole 265 of the adjacent metal plate 253. In contrast, the valve segment 269 disables a flow (see an arrow F5 in FIG. 51) of the oil from the supply port 74 to the oil pump 85 through the supply oil passage 266 by closing the oil hole 265 of the adjacent metal plate 253.

As shown in FIG. 45, the metal plate 258 is configured into a polygonal form, which is the same as the polygonal form of the metal plate 253 in the axial view. The metal plate 258 includes the fitting hole 211 and the through-hole 268.

The metal plate 253 serves as an oil passage forming plate of the present disclosure. Furthermore, the through-hole 268 of the metal plate 258 serves as a relief space (receiving space), which receives the valve segment 269 when the valve segment 269 is lifted away from the peripheral edge portion of the oil hole 265 of the adjacent metal plate 253. The metal plate 258 serves as a relief plate of the present disclosure.

As shown in FIG. 46, the metal plate 259 is configured into a polygonal form, which is the same as the polygonal form of the metal plate 253 in the axial view. The metal plate 259 includes the fitting hole 211 and an arcuate hole 270. The arcuate hole 270 is a hole, which circumferentially extends from a circumferential position, which is the same as a circumferential position of an oil hole 271 described later, to a circumferential position, which is the same as a circumferential position of an oil hole 272 described later, through a circumferential position, which is the same as a circumferential position of the enlarged oil hole 267.

As shown in FIG. 47, the metal plate (serving as an oil passage forming plate) 260 is configured into a polygonal form, which is the same as the polygonal form of the metal plate 253 in the axial view. The metal plate 260 includes the fitting hole 211, the oil hole 271 and the oil hole 272. The oil hole 271 and the oil hole 272 form a part of the supply oil passage 266. The oil hole 271 and the oil hole 272 are arranged parallel to each other in the supply oil passage 266. Furthermore, the oil hole 271 and the oil hole 265 are arranged one after another in series in the supply oil passage 266. Also, the oil hole 272 and the oil hole 265 are arranged one after another in series in the supply oil passage 266. The arcuate hole 270 is a branch passage, at which the supply oil passage 266, which includes the oil hole 265, is branched into a branch passage (a sub-passage) of the supply oil passage 266, which includes the oil hole 271, and a branch passage (a sub-passage) of the supply oil passage 266, which includes the oil hole 272.

As shown in FIG. 48, the metal plate (serving as an enlarged oil passage forming plate) 261 is configured into a polygonal form, which is the same as the polygonal form of the metal plate 253 in the axial view. The metal plate 261 includes the fitting hole 211, an enlarged oil hole 273 and an enlarged oil hole 274. The enlarged oil hole 273 has a passage cross-sectional area, which is larger than a passage cross-sectional area of the oil hole 271. The enlarged oil hole 274 has a passage cross-sectional area, which is larger than a passage cross-sectional area of the oil hole 272. Each of the enlarged oil hole 273 and the enlarged oil hole 274 forms an enlarged oil passage section, which has a locally enlarged passage cross section, in a middle of the corresponding branch passage of the supply oil passage 266. The metal plate 261 serves as an enlarged oil passage forming plate of the present disclosure.

Figure 51:
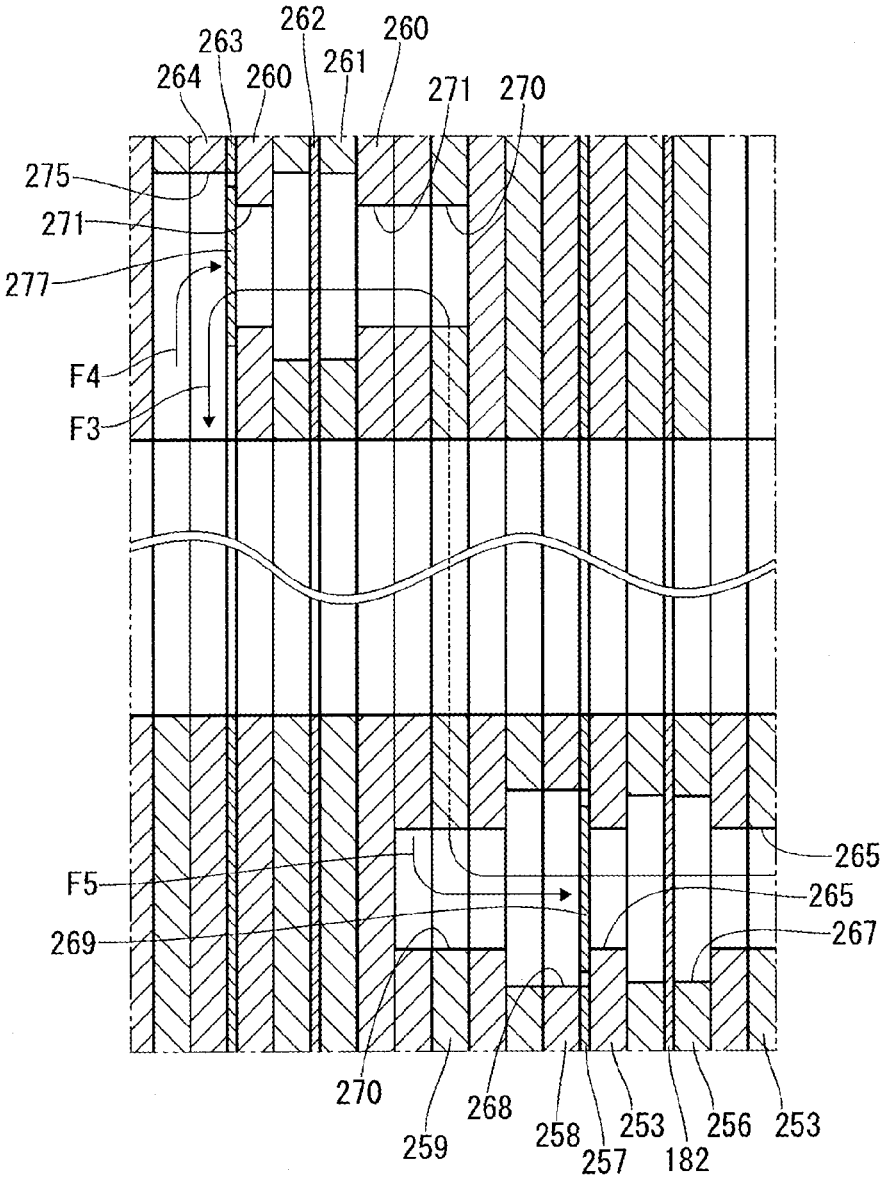
FIG. 51 is a partial enlarged view of the laminated body of FIG. 38.
Figure 52:
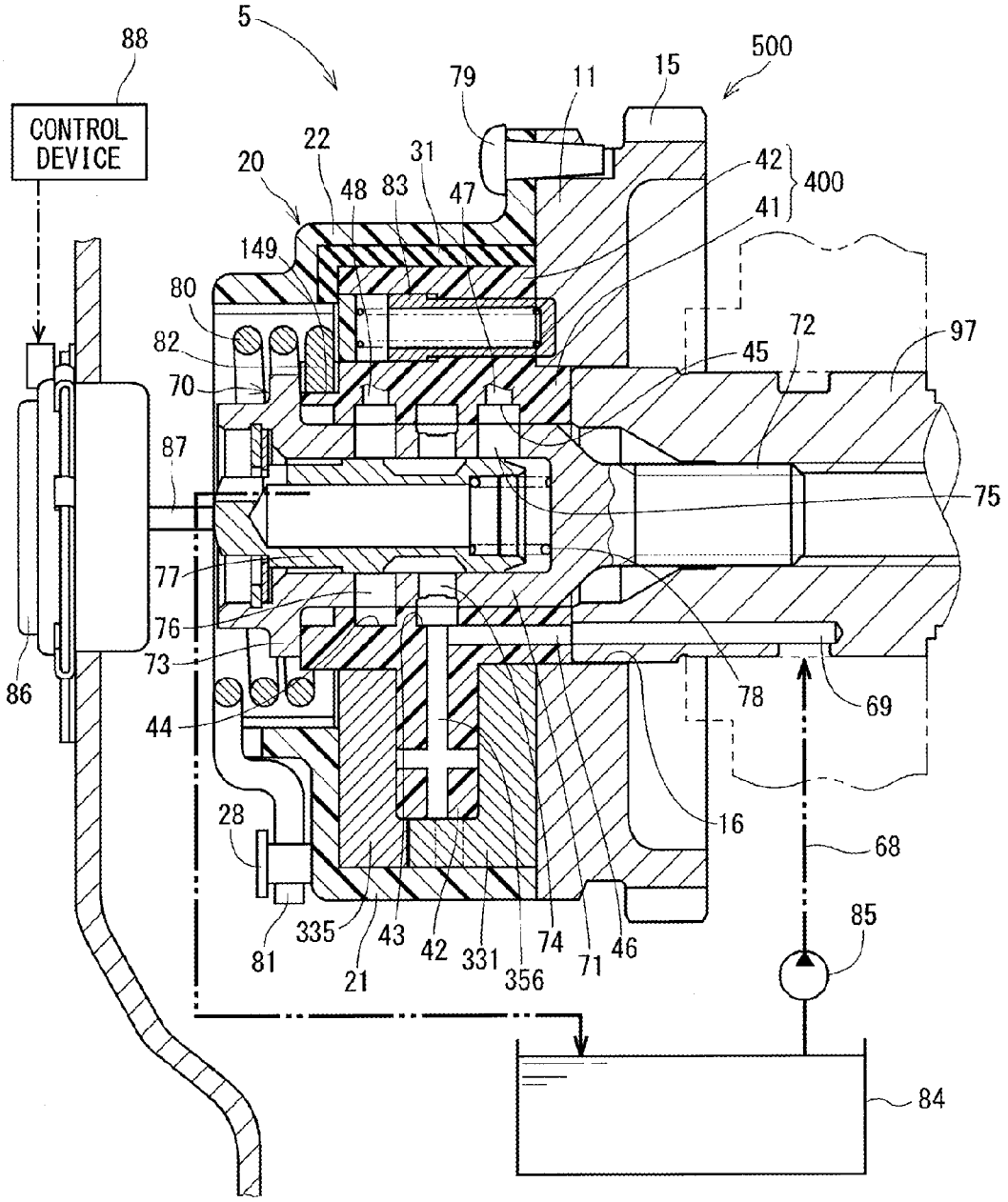
FIG. 52 is a schematic cross-sectional view showing a valve timing control system, which includes a valve timing control apparatus according to a twelfth embodiment of the present disclosure.
Figure 53:
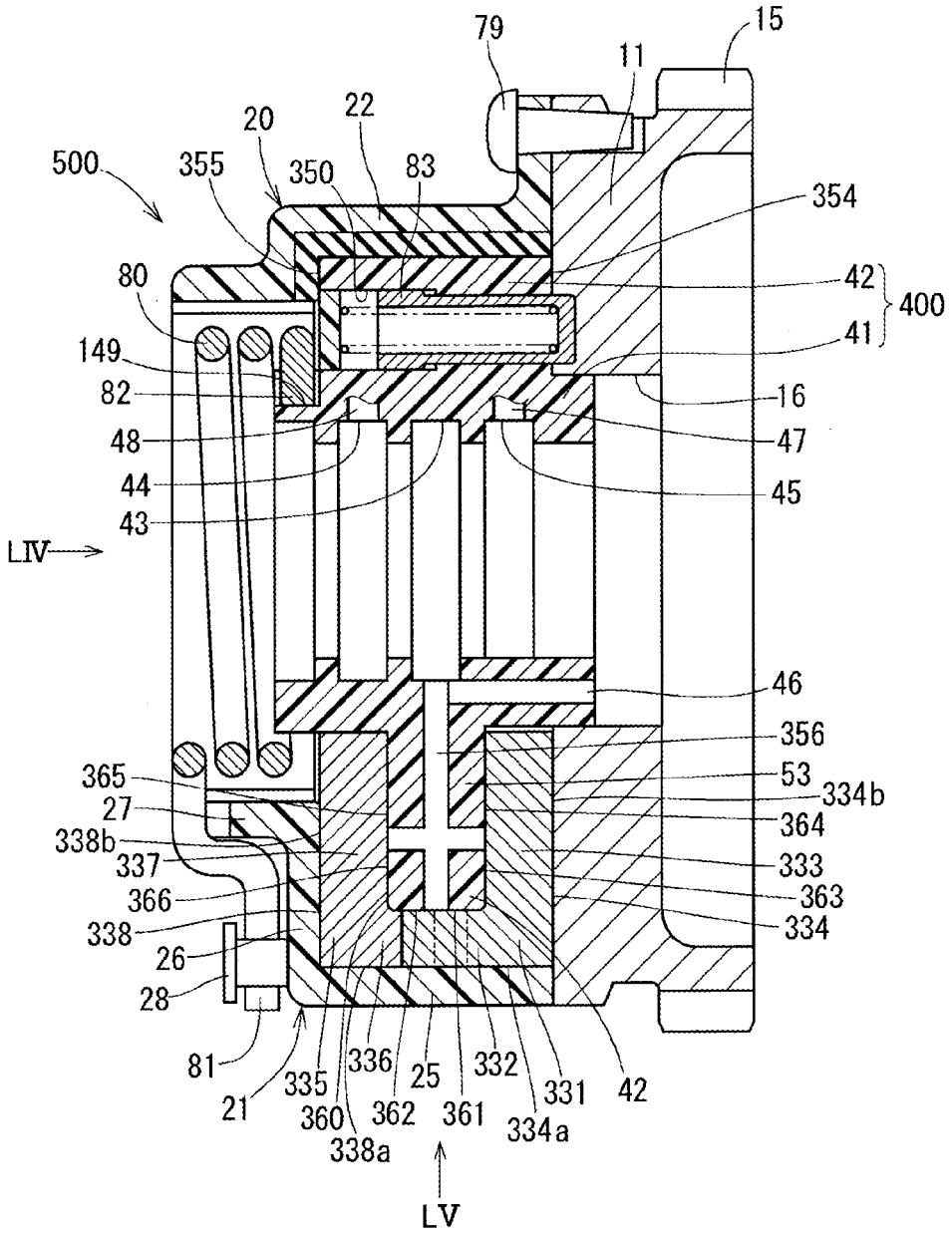
FIG. 53 is a longitudinal cross-sectional view of the valve timing control apparatus of FIG. 52.
Figure 54:
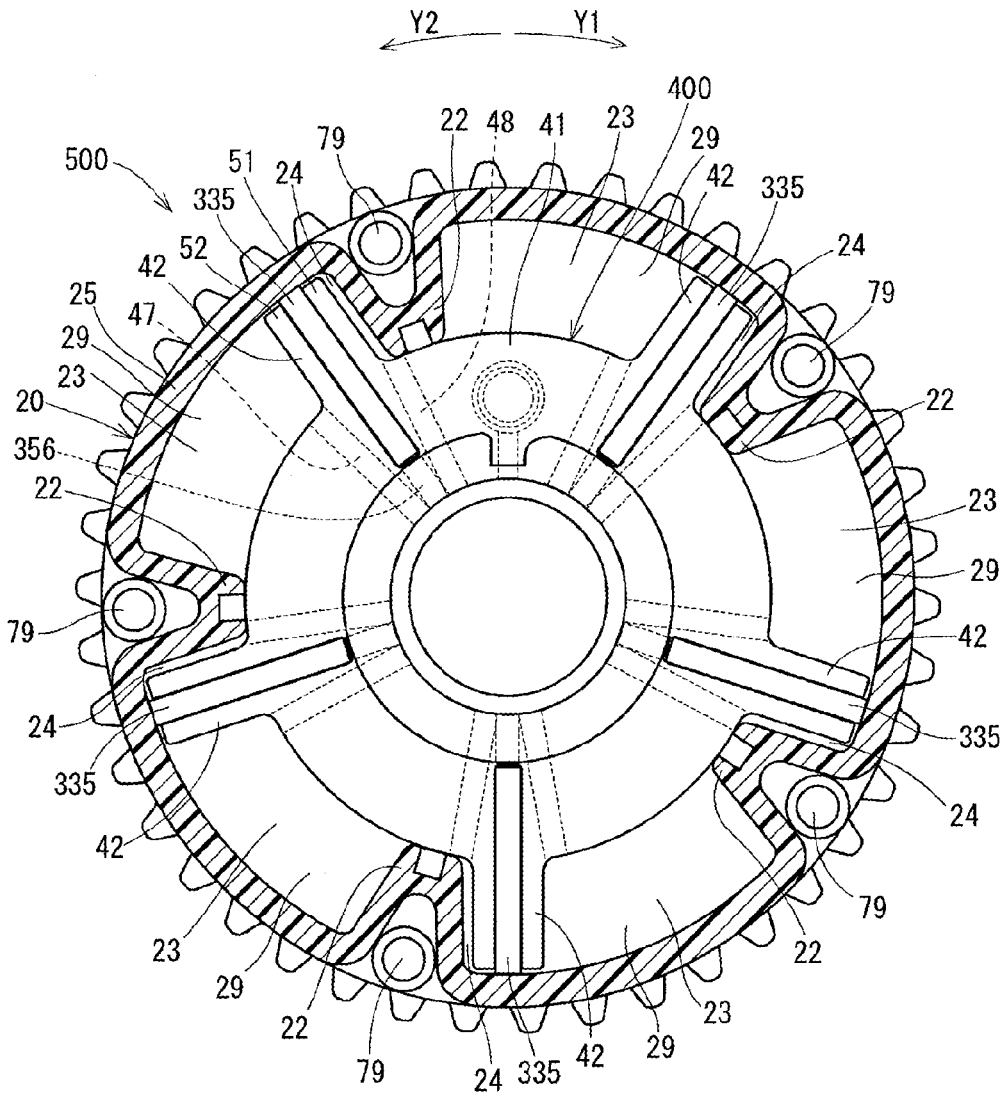
FIG. 54 is a schematic view of the valve timing control apparatus taken from a direction of an arrow LIV in FIG. 53 without depicting an outer shell of a housing and an assist spring for the sake of simplicity.
Figure 55:
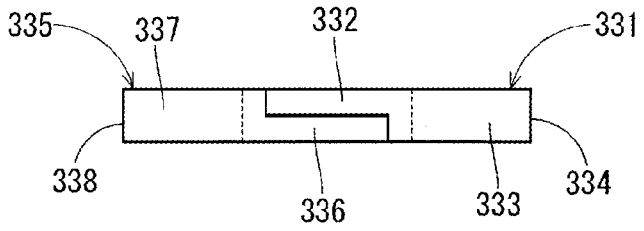
FIG. 55 is a view of a first seal member and a second seal member taken in a direction of an arrow LV in FIG. 53.
Figure 56:
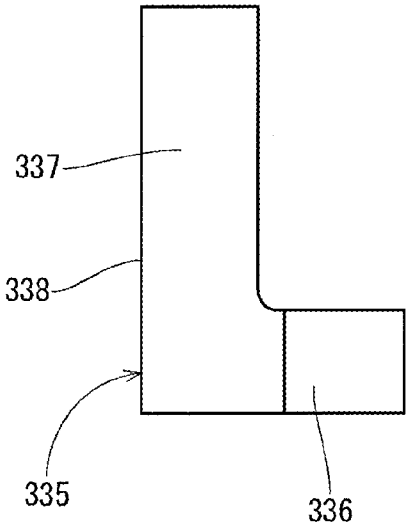
FIG. 56 is a schematic view, showing the second seal member of FIG. 53.

As shown in FIG. 51, the filter 262 is configured to capture foreign objects (e.g., dusts, debris), which are contained in the oil that flows in the supply oil passage 266.

As shown in FIG. 49, the reed valve plate 263 is configured into a polygonal form, which is the same as the polygonal form of the metal plate 253 in the axial view. The reed valve plate 263 includes the fitting hole 211, a recess 275 and a recess 276 and forms a valve segment 277 and a valve segment 278. The recess 275 includes a radial recess section 275*a* and an arcuate section 275*b*. In the reed valve plate 263, the radial recess section 275*a* radially outwardly extends from a circumferential position, which is the same as the circumferential position of the oil hole 271, and the arcuate section 275*b* circumferentially extends from the radial recess section 275*a*. The recess 276 includes a radial recess section 276*a* and an arcuate section 276*b*. In the reed valve plate 263, the radial recess section 276*a* radially outwardly extends from a circumferential position, which is the same as the circumferential position of the oil hole 272, and the arcuate section 276*b* circumferentially extends from the radial recess section 276*a*. The recess 275 forms one of the two parallel oil passages (the branch passages) of the supply oil passage 266, and the recess 276 forms the other one of the two parallel oil passages (the branch passages) of the supply oil passage 266.

The valve segment 277 circumferentially extends from a circumferential end of the arcuate section 275*b* of the recess 275, which is circumferentially opposite from the oil hole 271. A circumferential length of the valve segment 277 is smaller than a circumferential length of the valve segment 269. The valve segment 277 is liftable from and is seatable against a peripheral edge portion of the oil hole 271 of the adjacent metal plate 260, which is adjacent to the reed valve plate 263, to respectively open and close the oil hole 271. That is, the valve segment 277 enables a flow (see the arrow F3 in FIG. 51) of the oil from the oil pump 85 to the supply port 74 through the supply oil passage 266 (more specifically, the one of the branch passages of the supply oil passage 266) by opening the oil hole 271 of the adjacent metal plate 260. In contrast, the valve segment 277 disables a flow (see an arrow F4 in FIG. 51) of the oil from the supply port 74 to the oil pump 85 through the supply oil passage 266 by closing the oil hole 271 of the adjacent metal plate 260.

The valve segment 278 circumferentially extends from a circumferential end of the arcuate section 276*b* of the recess 276, which is circumferentially opposite from the oil hole 272. A circumferential length of the valve segment 278 is smaller than the circumferential length of the valve segment 269. The valve segment 278 is liftable from and is seatable against a peripheral edge portion of the oil hole 272 of the adjacent metal plate 260, which is adjacent to the reed valve plate 263, to respectively open and close the oil hole 272. That is, the valve segment 278 enables the flow of the oil from the oil pump 85 to the supply port 74 through the supply oil passage 266 (more specifically, the other one of the branch passages of the supply oil passage 266) by opening the oil hole 272 of the adjacent metal plate 260. In contrast, the valve segment 278 disables the flow of the oil from the supply port 74 to the oil pump 85 through the supply oil passage 266 by closing the oil hole 272 of the adjacent metal plate 260.

As shown in FIG. 50, the metal plate 264 is configured into a polygonal form, which is the same as the polygonal form of the metal plate 253 in the axial view. The metal plate 264 includes the fitting hole 211, a recess 275 and a recess 276.

The metal plate 260 serves as an oil passage forming plate of the present disclosure. Furthermore, the recess 275 of the metal plate 264 serves as a relief space (receiving space), which receives the valve segment 277 when the valve segment 277 is lifted away from the peripheral edge portion of the oil hole 271 of the adjacent metal plate 260. The recess 276 of the metal plate 264 serves a relief space (receiving space), which receives the valve segment 278 when the valve segment 278 is lifted away from the peripheral edge portion of the oil hole 272 of the adjacent metal plate 260. Thereby, the metal plate 264 serves as a relief plate of the present disclosure.

As discussed above, the valve timing control apparatus 250 includes the reed valve plate 257, the reed valve plate 263, the filter 182 and the filter 262 as the thin plates, which form the laminated body 251. Thus, unlike the prior art vane rotor, it is not necessary to use the separate members, such as the bushings, to assemble the reed valves and the filters, which are similar to the reed valve plates 257, 263 and the filters 182, 262 of the laminate body 251 of the present embodiment. As a result, the size of the valve timing control apparatus can be reduced or minimized.

Furthermore, according to the eleventh embodiment, the valve segment 269 limits the flow of the hydraulic oil from the supply oil passage 266 to the supply port 74 until the corresponding timing, at which pressure of the hydraulic oil supplied from the oil pump 85 to the supply oil passage 266 becomes equal to or larger than a predetermined value. In this way, unintentional repeated back and forth rotational movements of the vane rotor can be limited.

Furthermore, according to the eleventh embodiment, the circumferential length of the arm of the valve segment 277 and the circumferential length of the arm of the valve segment 278 are shorter than then circumferential length of the arm of the valve segment 269. Therefore, the closing speed of the valve segment 277 and the closing speed of the valve segment 278 can be increased in comparison to the closing speed of the valve segment 269.

Furthermore, according to the eleventh embodiment, a pore size (also referred to as a mesh size) of the filter 262 is smaller than a pore size of the filter 182. Thereby, it is possible to limit clogging of the valve segments 277, 278, which is caused by capturing of a small foreign object between the arm of the valve segment 277, 278 and the metal plate 260, thereby resulting in prevention of valve closing movement of the valve segment 277, 278.

Now, modifications of the first to eleventh embodiments will be described.

In a modification of the first to eleventh embodiments, the resin member does not need to have the peripheral wall. That is, the peripheral wall of the resin member may be eliminated. Even in such a case, the first side wall and the second side wall of the resin member can provide the advantages discussed above.

In another modification of the first to eleventh embodiments, the laminated body does not need to have the rotation limiting means for limiting the rotation of the laminated body relative to the resin member. That is, the laminated body may be configured into a circular form in the axial view.

In another modification of the first to eleventh embodiments, the laminated body does not need to have the polygonal form in the axial view and may have any other suitable form (e.g., a circular form) that is other than the polygonal form in the axial view. In such a case, the rotation limiting means (the rotation limiting portion) for limiting the rotation of the laminated body relative to the resin member may be in a form of a projection, which radially outwardly projects, or in a form of a recess, which is radially inwardly recessed. However, in the case where the rotation limiting means for limiting the rotation of the laminated body relative to the resin member is the corners of the polygon of the laminated body, the strength of the rotation limiting means can be advantageously increased.

In another modification of the first to eleventh embodiments, the cross section of the laminated body does not need to be the polygonal form, the number of the sides of which is twice greater than the number of the vanes of the resin member. Furthermore, the circumferential position of each of the vanes of the resin member does not need to coincide with the center part of the corresponding one of the sides of the outer peripheral wall surface of the laminated body in the axial view.

In another modification of the first to eleventh embodiments, the one axial end portion of the laminated body may be insert molded in the inside of the resin member.

In another modification of the first to eleventh embodiments, the metal plates may be fixed to each other by any other fixing method, which is other than the fixing method that uses the press-fit pins. For example, each of the metal plates may include projections and recesses. At the time of fixing the metal plates together, each axially adjacent two of the metal plates axially fixed together by press-fitting the projections of one of the axially adjacent two of the metal plates into the recesses of the other one of the axially adjacent two of the metal plates.

In another modification of the first to eleventh embodiments, the lock pin may be supported by the resin member.

In another modification of the first to eleventh embodiments, the assist spring may be eliminated.

In another modification of the first to eleventh embodiments, all of the metal plates may be made from the same material.

In another modification of the first to eleventh embodiments, the resin member may be made of another resin material, which is other than the thermoset resin material.

In another modification of the first to eleventh embodiments, the housing may be made of another material, such as a resin material, which is other than the fiber reinforced plastic, or a metal material.

In another modification of the first to eleventh embodiments, the number of the pressurization compartments of the housing may be equal to or smaller than 4 or alternatively equal to or larger than 6.

In another modification of the first to eleventh embodiments, the sprocket may be made of a resin material.

In another modification of the first to eleventh embodiments, the oil passage change valve, which is formed by the sleeve bolt and the spool, may be placed at any location in the supply oil passage.

In another modification of the first to eleventh embodiments, the rotation of the crankshaft of the engine may be transmitted to the housing through another type of drive force transmission member, which is other than the chain.

In another modification of the first to eleventh embodiments, any other type of rotation transmission member, which is other than the sprocket, may be used.

In another modification of the first to eleventh embodiments, the valve timing control apparatus may control the opening timing and closing timing of the exhaust valves of the engine.

Twelfth Embodiment

Now, a twelfth embodiment of the present disclosure will be described with reference to FIGS. 52 to 56. In the twelfth embodiment, the valve timing control apparatus 500 is applied to the valve timing control system 5 shown in FIG. 52. The valve timing control apparatus 500 of the twelfth embodiment mainly differs from the valve timing control apparatus 10 of the first embodiment with respect to the structure of the vane rotor 400. Therefore, in the following discussion, the present embodiment will be mainly discussed with respect to the vane rotor 400, and the components, which are similar to those discussed in the first embodiment, will be indicated by the same reference numerals and will not be described redundantly for the sake of simplicity.

The vane rotor 400 is received in the housing 20 and is rotatable integrally with the camshaft 97. The vane rotor 400 includes a boss portion 41 and a plurality of vanes 42. Each of the vanes 42 radially extends to partition the corresponding one of the pressurization compartments 29, which are formed in the inside of the housing 20, into the advancing chamber 23 and the retarding chamber 24. The vane rotor 400 includes the supply groove 43, the retarding groove 44, the advancing groove 45, the supply oil passage 46, the advancing oil passages 47 and the retarding oil passages 48. The supply groove 43 and the retarding groove 44 are formed in an inner peripheral wall of the boss portion 41 and are respectively configured into an annular form. The advancing groove 45 is formed in the inner peripheral wall of the boss portion 41 and is configured into a C-shape. The supply oil passage 46 extends from the supply groove 43 in the axial direction and receives the hydraulic oil from the outside (more specifically, the oil pan 84). Each of the advancing oil passages 47 extends outward from the advancing groove 45 in the radial direction and is communicated with a corresponding one of the advancing chambers 23. Each of the retarding oil passages 48 extends outward from the retarding groove 44 in the radial direction and is communicated with a corresponding one of the retarding chambers 24. The vane rotor 400 is rotated relative to the housing 20 in the advancing side, which is indicated by the arrow Y1 in FIG. 54, or the retarding side, which is indicated by the arrow Y2 in FIG. 54, depending on the pressure of hydraulic oil present in the advancing chambers 23 and the pressure of hydraulic oil present in the retarding chambers 24.

Similar to the first embodiment, the one end portion 81 of the assist spring 80 is engaged with the engaging pin 28, which is formed in the outer wall surface of the housing 20. However, unlike the first embodiment, the other end portion 82 of the assist spring 80 is engaged with an engaging groove 149, which is formed in the corresponding vane 42 of the vane rotor 400. The assist spring 80 urges the vane rotor 400 toward the advancing side.

The boss portion 41 of the vane rotor 400 includes a slide hole 350, which axially slidably supports the lock pin 83. The lock pin 83 is insertable into and removable from the sprocket 11 (more specifically, the engaging hole of the sprocket 11). When the lock pin 83 is inserted into the sprocket 11, the lock pin 83 limits relative rotation between the vane rotor 400 and the sprocket 11.

Each of the vanes 42 of the vane rotor 400 includes a first vane section 51, a second vane section 52 and a connecting section 53. In each vane 42, the first vane section 51 radially outwardly extends from the boss portion 41, and the second vane section 52 radially outwardly extends from the boss portion 41 at a circumferential position, which is circumferentially spaced from the first vane section 51. Furthermore, the connecting section 53 connects between the first vane section 51 and the second vane section 52. A radial length and an axial length of the connecting section 53 are larger than a radial length and an axial length of each of the first and second vane sections 51, 52. Furthermore, in each vane 42, a seal groove 360 is formed between the first vane section 51 and the second vane section 52 such that a groove bottom of the seal groove 360 is formed in an outer peripheral surface of the connecting section 53. The seal groove 360 includes a first groove section 361, a second groove section 363 and a third groove section 365. The first groove section 361 extends in the axial direction. The second groove section 363 radially inwardly extends from an axial end of the first groove section 361, which is located on an axial side where the sprocket 11 is placed. The third groove section 365 radially inwardly extends from an opposite axial end of the first groove section 361, which is located on an opposite axial side that is opposite from the sprocket 11 in the axial direction.

In each of the vanes 42, a first seal member 331 and a second seal member 335 are installed to the seal groove 360.

The first seal member 331 is placed in a corresponding space (location), which is defined by the corresponding vane 42 of the vane rotor 400, the sprocket 11 and the large-diameter tube section 25 of the housing 20. Specifically, the first seal member 331 includes a first peripheral wall section (also referred to as a first axial wall section) 332 and a first side wall section (also referred to as a first radial wall section) 333 and is configured into an L-shape. The first peripheral wall section 332 extends in the axial direction along the first groove section 361 of the seal groove 360 and is engageable with a groove bottom 362 of the first groove section 361. The first side wall section 333 radially inwardly extends from one axial end part of the first peripheral wall section 332, which is located on the axial side where the sprocket 11 is placed, along the second groove section 363 of the seal groove 360, and the first side wall section 333 is engageable with a groove bottom 364 of the second groove section 363. The other axial end part of the first peripheral wall section 332 is stepped and has a width (a circumferential width), which is one half of a width (a circumferential width) of a center part of the first peripheral wall section 332, which is axially located between the one axial end part and the other axial end part of the first peripheral wall section 332. The first side wall section 333 of the first seal member 331 radially inwardly extends to a radially inner end of a slide wall 354 of the vane rotor 400, along which the sprocket 11 is slidable. The groove bottom 362 of the first groove section 361 forms an outer peripheral wall surface of the vane rotor 400. The groove bottom 364 of the second groove section 363 forms one axial side wall surface of the vane rotor 400. The first seal member 331 is radially and axially movable relative to the vane rotor 400.

The second seal member 335 is placed in a corresponding space (location), which is defined by the corresponding vane 42 of the vane rotor 400, the large-diameter tube section 25 and the bottom section 26 of the housing 20. Specifically, the second seal member 335 includes a second peripheral wall section (also referred to as a second axial wall section) 336 and a second side wall section (also referred to as a second radial wall section) 337 and is configured into an L-shape. The second peripheral wall section 336 extends in the axial direction along the first groove section 361 of the seal groove 360 and is engageable with the groove bottom 362 of the first groove section 361. The second side wall section 337 radially inwardly extends from one axial end part of the second peripheral wall section 336, which is located on the axial side that is opposite from the sprocket 11 in the axial direction, along the third groove section 365 of the seal groove 360, and the second side wall section 337 is engageable with a groove bottom 366 of the third groove section 365. The other axial end part of the second peripheral wall section 336 is stepped and has a width (a circumferential width), which is one half of a width (a circumferential width) of a center part of the second peripheral wall section 336, which is axially located between the one axial end part and the other axial end part of the second peripheral wall section 336. The second side wall section 337 of the second seal member 335 radially inwardly extends to a radially inner end of a slide wall 355 of the vane rotor 400, along which the bottom section 26 of the housing 20 is slidable. The groove bottom 366 of the third groove section 365 forms the other axial side wall surface of the vane rotor 400. The second seal member 335 is radially and axially movable relative to the vane rotor 400 and the first seal member 331.

The shape of the first seal member 331 is substantially the same as the shape of the second seal member 335, and the other axial end part of the first peripheral wall section 332 of the first seal member 331 is circumferentially overlapped with the other axial end part of the second peripheral wall section 336 of the second seal member 335.

The vane rotor 400 is made of a resin material. A material of the first seal member 331 and a material of the second seal member 335 are different from the material of the vane rotor 400. In the present embodiment, the first seal member 331 is made of hardened steel, and the second seal member 335 is made of an aluminum alloy. Furthermore, a slide surface 334 of each first seal member 331 (more specifically a slide surface 334*a* of the first peripheral wall section 332 and a slide surface 334*b* of the first side wall section 333), which is slidable relative to the housing 20 (more specifically, the large-diameter tube section 25) and the sprocket 11, is surface treated through a surface-treating process. Also, a slide surface 338 of each second seal member 335 (more specifically a slide surface 338*a* of the second peripheral wall section 336 and a slide surface 338*b* of the second side wall section 337), which is slidable relative to the housing 20 (more specifically, the large-diameter tube section 25 and the bottom section 26), is surface treated through the surface-treating process. The surface-treating process may be, for example, a plating process, a vapor deposition process, a printing process or a coating process.

The vane rotor 400 is molded by filling the resin material in a molten state into a molding die, in which the first seal members 331 and the second seal members 335 are set in advance, and thereafter solidifying the filled resin material. The relative movement of each of the first seal members 331 and the second seal members 335 relative to the molded vane rotor 400 is enabled through selection of the material of the vane rotor 400 and application of a releasing process (peeling process) on a boundary surface of each first seal member 331 and a boundary surface of each second seal member 335, which are bordered on the vane rotor 400, at the time of setting the first seal member 331 and the second seal member 335 in the molding die.

The vane rotor 400 includes a pressing oil passage 356, which opens to the groove bottoms 362, 364, 366 of the first to third groove sections 361, 363, 365 at each vane 42. The groove bottoms 362, 364 serve as contact surfaces, which are abuttable against (i.e., can contact) the first seal member 331. Furthermore, the groove bottoms 362, 366 serve as contact surfaces, which are abuttable against (i.e., can contact) the second seal member 335. The pressing oil passage 356 is directly communicated with the supply oil passage 46. The pressing oil passage 356 guides the hydraulic oil, which is supplied from the outside to the supply oil passage 46, to the first seal member 331 and the second seal member 335 without passing through the advancing chamber(s) 23 and the retarding chamber(s) 24 to exert pressing forces, which press the first seal member 331 and the second seal member 335 in the radially outer direction and the axial direction. In other words, the pressing oil passage 356 guides the hydraulic oil, which is supplied from the outside to the supply oil passage 46, to the first seal member 331 and the second seal member 335 while bypassing the advancing chamber(s) 23 and the retarding chamber(s) 24.

The hydraulic oil, which is pumped from the oil pump 85 to the supply oil passage 46, is guided to a clearance between the groove bottoms 362, 364 and the first seal member 331 and is also guided to a clearance between the groove bottoms 362, 366 and the second seal member 335. The hydraulic oil, which is supplied to these clearances, urge the first seal member 331 against the large-diameter tube section 25 and the sprocket 11 and also urge the second seal member 335 against the large-diameter tube section 25 and the bottom section 26, so that the gap between the corresponding advancing chamber 23 and the corresponding retarding chamber 24 is fluid-tightly sealed (oil-tightly sealed).

As discussed above, the valve timing control apparatus 500 of the twelfth embodiment includes the first seal member 331, which is placed between the sprocket 11 and the vane rotor 400, and the second seal member 335, which is placed between the housing 20 and the vane rotor 400. The first seal member 331 is radially and axially movable relative to the vane rotor 400, and the second seal member 335 is radially and axially movable relative to the vane rotor 400 and the first seal member 331.

Furthermore, the vane rotor 400 includes the pressing oil passage 356. The pressing oil passage 356 opens to the groove bottoms 362, 364, 366 of the seal groove 360 and guides the hydraulic oil, which is supplied from the outside, to the first seal member 331 and the second seal member 335 without passing through the advancing chamber(s) 23 and the retarding chamber(s) 24 to exert the pressing forces, which press the first seal member 331 and the second seal member 335 in the radially outer direction and the axial direction.

Therefore, the first seal member 331 can seal both of the axial gap between the sprocket 11 and the vane rotor 400 and the radial gap between the large-diameter tube section 25 of the housing 20 and the vane rotor 400. Furthermore, the second seal member 335 can seal both of the axial gap between the bottom section 26 of the housing 20 and the vane rotor 400 and the radial gap between the large-diameter tube section 25 of the housing 20 and the vane rotor 400.

Furthermore, the hydraulic oil, which presses the first seal member 331 and the second seal member 335, is directly supplied from the pressing oil passage 356 formed in the inside of the vane rotor 400 without passing through the advancing chamber(s) 23 and the retarding chamber(s) 24. Thereby, it is possible to reduce or minimize a pressure loss of the hydraulic oil, which is lost when the hydraulic oil supplied from the outside reaches each corresponding one of the first seal member 331 and the second seal member 335. Furthermore, each of the first seal member 331 and the second seal member 335 can be effectively pressed with the hydraulic oil supplied through the pressing oil passage 356 regardless of a pressure difference between the corresponding advancing chamber 23 and the corresponding retarding chamber 24. For example, even in a case where the pressure of the hydraulic oil in the advancing chamber 23 is the same as the pressure of the hydraulic oil in the retarding chamber 24, each of the first seal member 331 and the second seal member 335 can be effectively pressed with the hydraulic oil supplied through the pressing oil passage 356. Thereby, the oil leakage can be effectively limited.

Furthermore, according to the twelfth embodiment, the first side wall section 333 of the first seal member 331 radially inwardly extends to the radially inner end of the slide wall 354 of the vane rotor 400, along which the sprocket 11 is slidable. The second side wall section 337 of the second seal member 335 radially inwardly extends to the radially inner end of the slide wall 355 of the vane rotor 400, along which the bottom section 26 of the housing 20 is slidable.

Therefore, the axial gap between the vane rotor 400 and the housing 20 and the axial gap between the vane rotor 400 and the sprocket 11 can be sealed as much as possible.

Furthermore, in the twelfth embodiment, as discussed above, the first seal member 331 includes the first peripheral wall section 332 and the first side wall section 333 and is configured into the L-shape. The first peripheral wall section 332 extends in the axial direction along the first groove section 361 of the seal groove 360 and is engageable with the groove bottom 362 of the first groove section 361. The first side wall section 333 radially inwardly extends from the one axial end part of the first peripheral wall section 332, which is located on the axial side where the sprocket 11 is placed, along the second groove section 363 of the seal groove 360, and the first side wall section 333 is engageable with the groove bottom 364 of the second groove section 363. Furthermore, the second seal member 335 includes the second peripheral wall section 336 and the second side wall section 337 and is configured into the L-shape. The second peripheral wall section 336 extends in the axial direction along the first groove section 361 of the seal groove 360 and is engageable with the groove bottom 362 of the first groove section 361. The second side wall section 337 radially inwardly extends from the one axial end part of the second peripheral wall section 336, which is located on the axial side that is opposite from the sprocket 11 in the axial direction, along the third groove section 365 of the seal groove 360, and the second side wall section 337 is engageable with the groove bottom 366 of the third groove section 365. The shape of the first seal member 331 is substantially the same as the shape of the second seal member 335, and the other axial end part of the first peripheral wall section 332 of the first seal member 331 is circumferentially overlapped with the other axial end part of the second peripheral wall section 336 of the second seal member 335 at each vane 42.

Therefore, a common seal member can be used as the first seal member 331 and the second seal member 335. Thus, the manufacturing costs can be reduced, and the assembling can be eased.

Furthermore, in the twelfth embodiment, as discussed above, the vane rotor 400 includes the supply oil passage 46, the advancing oil passages 47 and the retarding oil passages 48. The supply oil passage 46 receives the hydraulic oil from the outside. Each of the advancing oil passages 47 is communicated with the corresponding advancing chamber 23, and each of the retarding oil passages 48 is communicated with the corresponding retarding chamber 24. The communication between the supply oil passage 46 and each advancing oil passage 47 and the communication between the supply oil passage 46 and each retarding oil passage 48 are enabled and disabled by the oil passage change valve, which includes the sleeve bolt 70 and the spool 77. The oil change valve (more specifically, the spool 77) is shiftable, i.e., is changeable to enable and disable communication of the supply oil passage 46 to the advancing oil passages 47 and also communication of the supply oil passage 46 to the retarding oil passage 48. Furthermore, the pressing oil passage 356 is directly communicated with the supply oil passage 46.

Therefore, the first seal member 331 and the second seal member 335 are urged by the supplied oil pressure. Thus, in the state where the supplied oil pressure is applied in the valve timing control apparatus 500, the urging force of the first seal member 331 and the urging force of the second seal member 335 can be always maintained. That is, even in the state where the hydraulic oil is not supplied to the advancing oil passages 47, the retarding oil passages 48, the advancing chambers 23 and the retarding chambers 24, the first seal member 331 and the second seal member 335 can be urged by the supplied oil pressure.

Furthermore, in the twelfth embodiment, the second seal member 335 is made of the material, which is different from the material of the first seal member 331. Therefore, it is possible to limit adhesive wearing at the connection (overlapped portion) between the first seal member 331 and the second seal member 335.

Furthermore, in the twelfth embodiment, the slide surfaces 334, 338 of the first seal member 331 and the second seal member 335, each of which is slidable relative to the housing 20, are surface treated through the surface-treating process. Thereby, the required abrasion resistance of the housing 20 made of the resin material can be achieved.

Furthermore, in the twelfth embodiment, the material of the first seal member 331 and the material of the second seal member 335 are different from the material (the resin material) of the vane rotor 400. The first seal member 331 is made of the hardened steel, and the second seal member 335 is made of the aluminum alloy. Therefore, it is possible to limit the adhesive wearing at the connection (overlapped portion) between the first seal member 331 and the second seal member 335. Furthermore, the amount of wearing generated between the first seal member 331 and the sprocket 11 and the amount of wearing generated between the second seal member 335 and the housing 20 can be made generally equal to each other. In addition, the first seal member 331 made of the metal material and the second seal member 335 made of the metal material can improve the strength of the corresponding vane 42 of the vane rotor 400.

Furthermore, in the twelfth embodiment, the first vane section 51 and the second vane section 52 of each vane 42 of the vane rotor 400 are connected with each other through the connecting section 53. Therefore, the strength of each vane 42 can be improved.

Furthermore, in the twelfth embodiment, the vane rotor 400 is molded by filling the resin material in the molten state into the molding die, in which the first seal members 331 and the second seal members 335 are set in advance, and thereafter solidifying the filled resin material. Therefore, the clearance between the first seal member 331 and the vane rotor 400 and the clearance between the second seal member 335 and the vane rotor 400 can be minimized, and thereby the leakage of the hydraulic oil through these clearances can be limited. Furthermore, since the first seal members 331, the second seal members 335 and the vane rotor 400 are integrally molded, the assembling of the components can be eased. Furthermore, the required dimensional accuracy of the first seal member 331 and the required dimensional accuracy of the second seal member 335 can be reduced. Thus, each of the first seal member 331 and the second seal member 335 can be manufactured through, for example, a press-working process, so that the manufacturing costs can be reduced or minimized.

Thirteenth Embodiment

Figure 57:
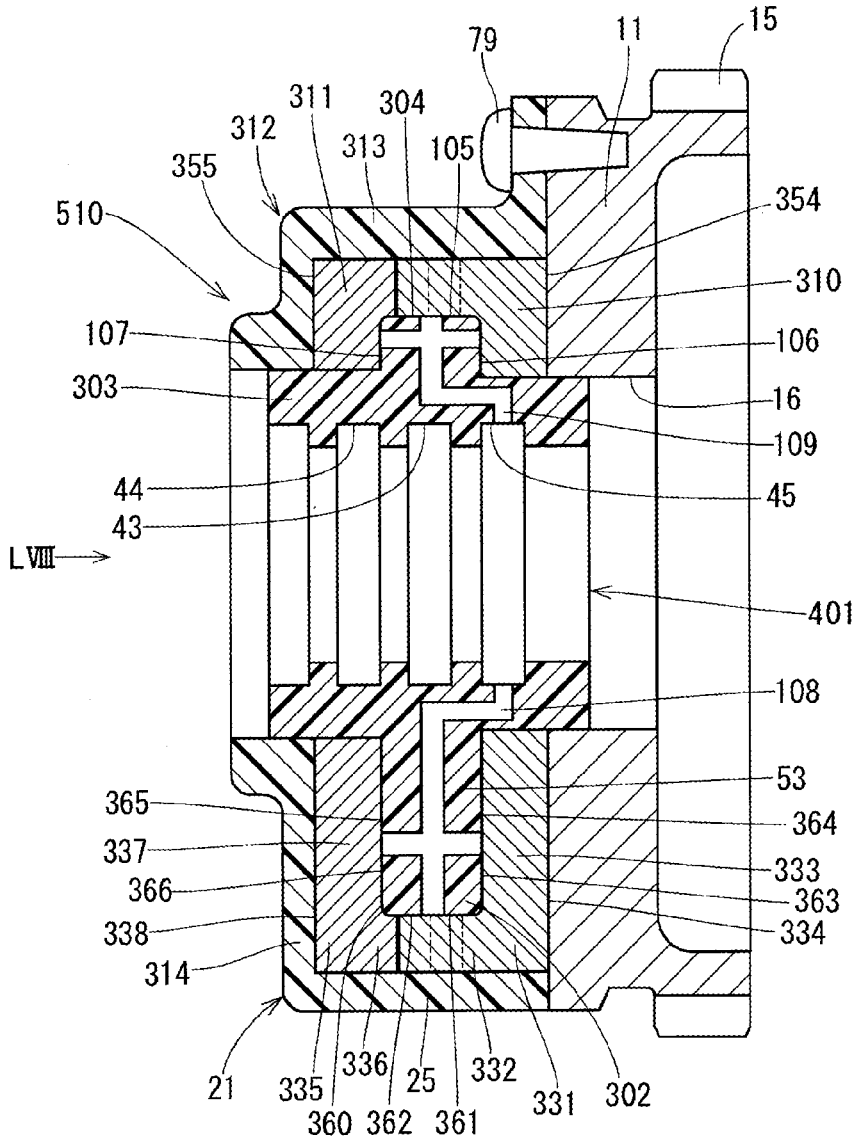
FIG. 57 is a longitudinal cross sectional view of a valve timing control apparatus according to a thirteenth embodiment of the present disclosure.
Figure 58:
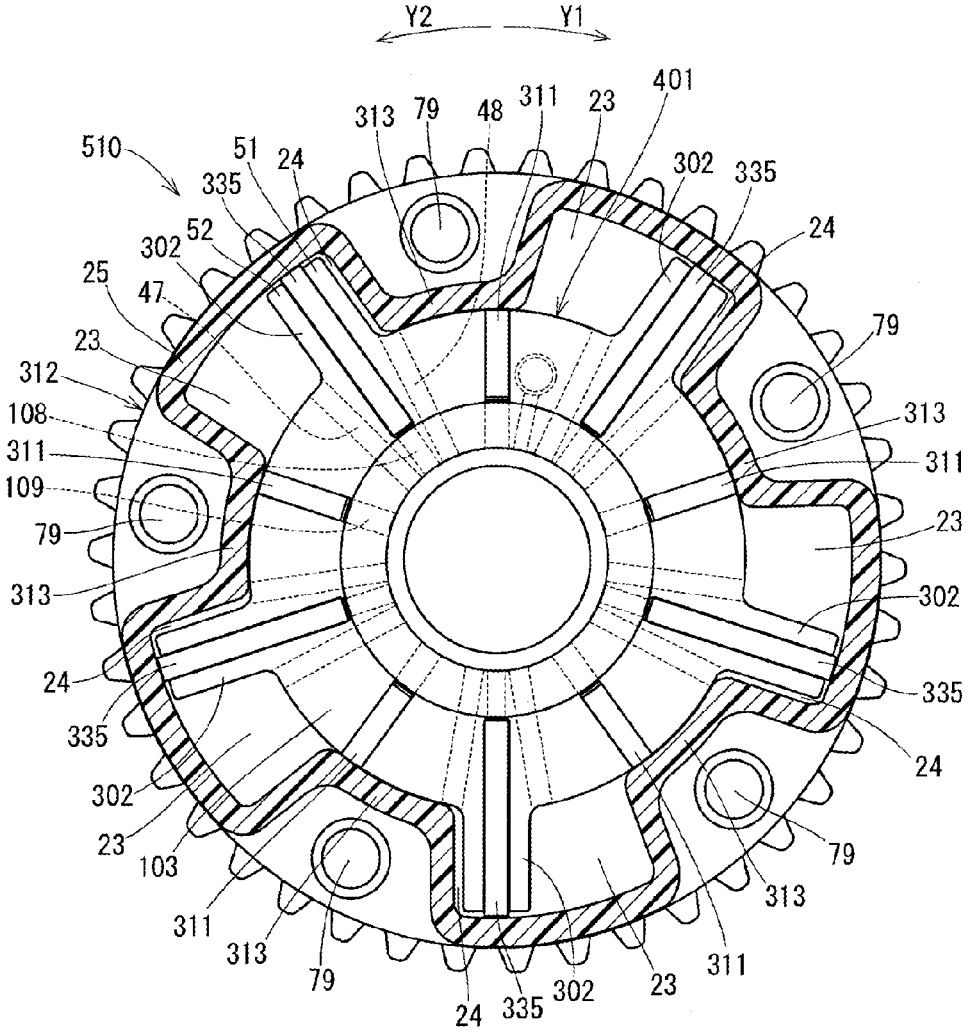
FIG. 58 is a schematic view of the valve timing control apparatus taken from a direction of an arrow LVIII in FIG. 57 without depicting the outer shell of the housing.

A valve timing control apparatus according to a thirteenth embodiment of the present disclosure will be described with reference to FIGS. 57 and 58. The valve timing control apparatus 510 is an apparatus for controlling the opening timing and closing timing of the intake valves 91 (see FIG. 2). The sprocket 11 is rotated together with the crankshaft 93.

In addition to the first seal members 331 and the second seal members 335, which are installed to the vanes 302 of the vane rotor 401, the vane rotor 401 further includes first seal members 310 and second seal members 311, which are installed to seal grooves 304 of the boss portion 303. Here, each first seal member 310 and each second seal member 311 are installed to a corresponding one of the seal grooves 304. More specifically, each first seal member 310 is installed to a corresponding space, which is defined by the sprocket 11, a corresponding one of the partitions 313 of the housing 312 and the boss portion 303 of the vane rotor 401. Each second seal member 311 is installed to a corresponding space, which is defined by the bottom section 314 of the housing 312, a corresponding one of the partitions 313 and the boss portion 303 of the vane rotor 401.

The vane rotor 401 includes a plurality of pressing oil passages 108 and a plurality of pressing oil passages 109. Each of the pressing oil passages 108 opens to the groove bottom 362, the groove bottom 364 and the groove bottom 366 of the seal groove 360 of the corresponding vane 302. Furthermore, each of the pressing oil passages 109 opens to a seal bottom 105, a seal bottom 106 and a seal bottom 107 of the corresponding seal groove 304. The pressing oil passages 108 and the pressing oil passages 109 are directly communicated with the advancing groove 45, which also serves as an advancing oil passage. Thereby, each pressing oil passage 108 guides the hydraulic oil to the corresponding first seal member 331 and the corresponding second seal member 335 without passing through the corresponding advancing chamber 23 and the corresponding retarding chamber 24 to radially outwardly and axially urge the corresponding first seal member 331 and the corresponding second seal member 335. Also, each pressing oil passage 109 guides the hydraulic oil to the corresponding first seal member 310 and the corresponding second seal member 311 without passing through the corresponding advancing chamber 23 and the corresponding retarding chamber 24 to radially outwardly and axially urge the corresponding first seal member 310 and the corresponding second seal member 311.

In the thirteenth embodiment, the first seal members 331, 310 and the second seal members 335, 311 are radially outwardly and axially pressed when the hydraulic oil is supplied to the advancing oil passages 47 through the advancing groove 45. At the time of rotating the engine 90, a cam torque of the camshaft 97 periodically oscillates, i.e., changes between a positive side for exerting a positive cam torque (also referred to as a positive oscillating cam torque) and a negative side for exerting a negative cam torque (also referred to as a negative oscillating cam torque). When the positive oscillating cam torque is increased, the pressure of the hydraulic oil in each advancing oil passage 47 is increased. Thereby, the pressing force, which is applied to the first seal members 331, 310 and the second seal members 335, 311 from the hydraulic oil in the pressing oil passages 108, 109, is increased.

Thus, when the positive oscillating cam torque is exerted to rotate the vane rotor 401 toward the retarding side, the first seal members 331, 310 and the second seal members 335, 311 are urged against the housing 312 and the sprocket 11 with the relatively large force. Thus, the rotation of the vane rotor 401 toward the retarding side is limited. Thus, the vane rotor 401 can be thereafter quickly rotated toward the advancing side.

Furthermore, according to the thirteenth embodiment, the seal members (i.e., the first seal members 331, 310 and the second seal members 335, 311) are provided to both of the vanes 302 and the boss portion 303 (the corresponding locations, i.e., the seal grooves 304 of the boss portion 303). Therefore, the axial gap between the vane rotor 401 and the housing 312 and the axial gap between the vane rotor 401 and the sprocket 11 are reduced, and thereby the internal leakage of the hydraulic oil can be limited.

Fourteenth Embodiment

Figure 59:
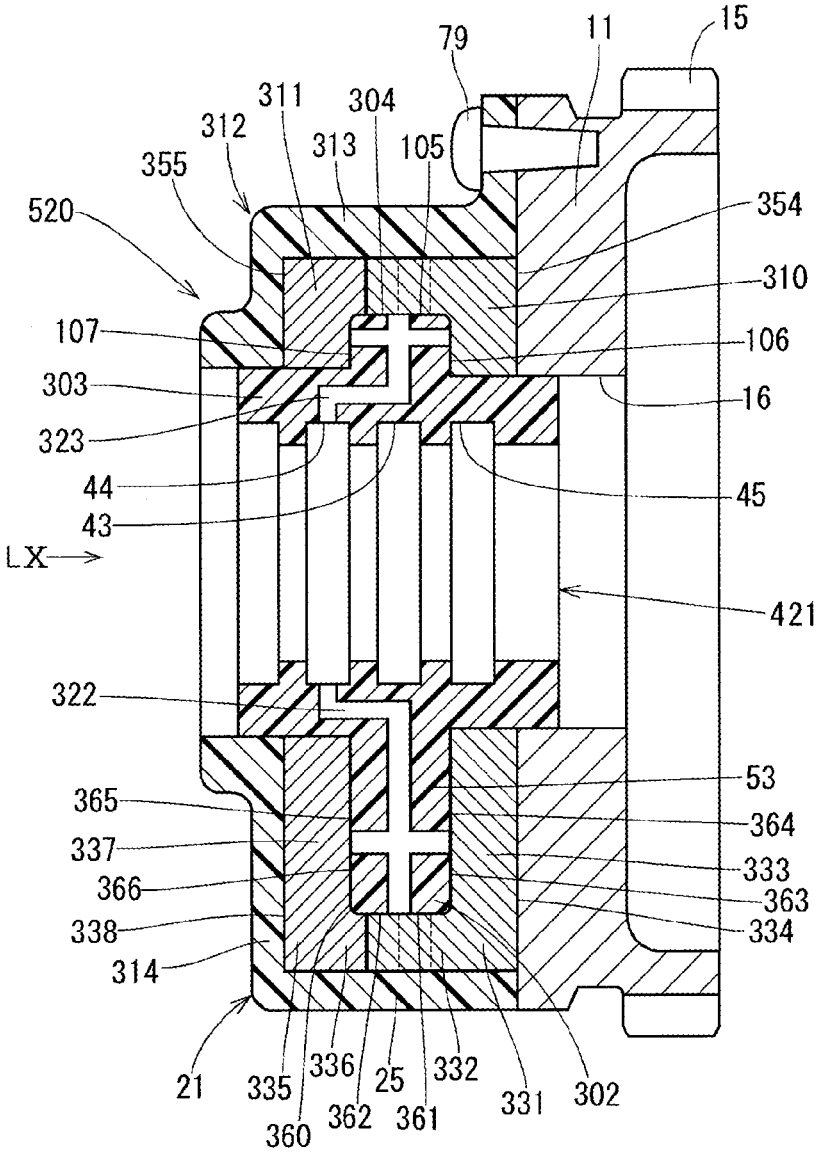
FIG. 59 is a longitudinal cross sectional view of a valve timing control apparatus according to a fourteenth embodiment of the present disclosure.
Figure 60:
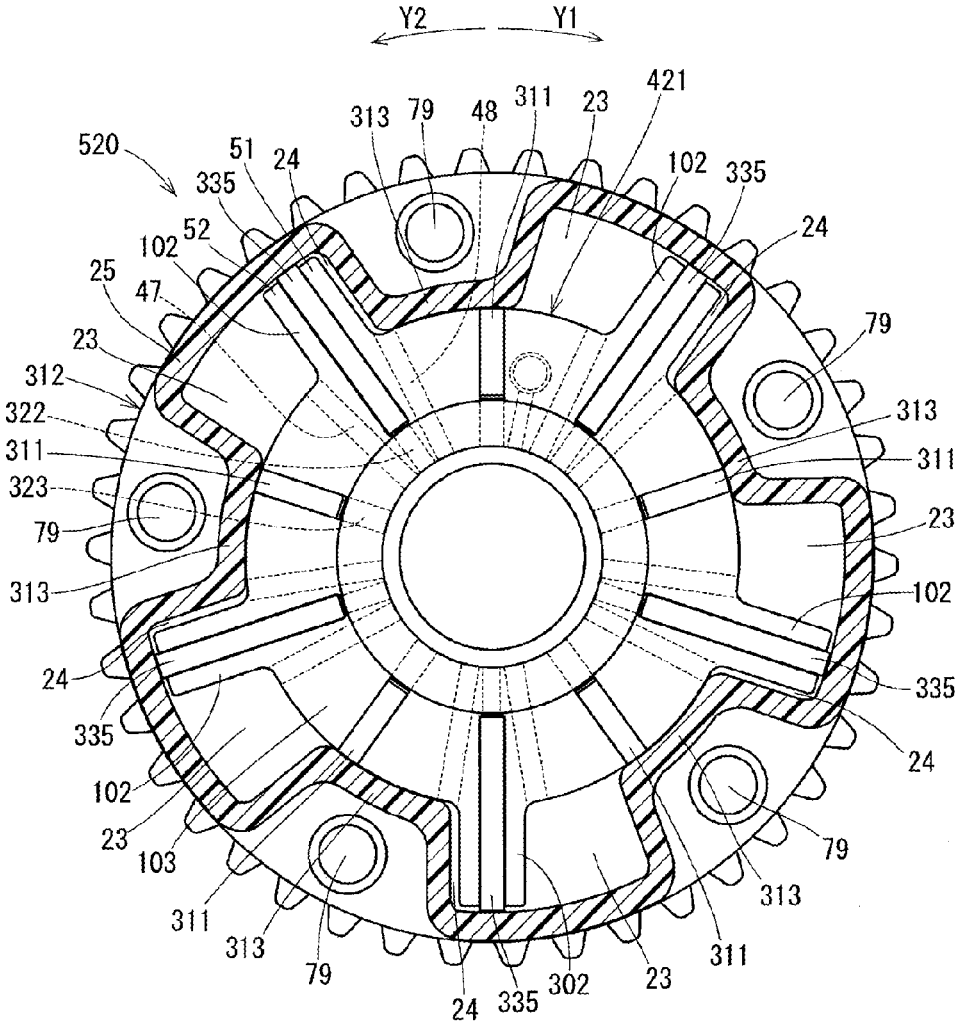
FIG. 60 is a schematic view of the valve timing control apparatus taken from a direction of an arrow LX in FIG. 59 without depicting the outer shell of the housing.

A valve timing control apparatus according to a fourteenth embodiment of the present disclosure will be described with reference to FIGS. 59 and 60. The valve timing control apparatus 520 is an apparatus for controlling the opening timing and closing timing of the exhaust valves 92 (see FIG. 2). The sprocket 11 is rotated together with the crankshaft 93.

The vane rotor 421 includes a plurality of pressing oil passages 322 and a plurality of pressing oil passages 323. Each of the pressing oil passages 322 opens to the groove bottom 362, the groove bottom 364 and the groove bottom 366 of the seal groove 360 of the corresponding vane 302. Furthermore, each of the pressing oil passages 323 opens to the seal bottom 105, the seal bottom 106 and the seal bottom 107 of the corresponding seal groove 304. The pressing oil passages 322 and the pressing oil passages 323 are directly communicated with the retarding groove 44, which also serves as a retarding oil passage. Thereby, each pressing oil passage 322 guides the hydraulic oil to the corresponding first seal member 331 and the corresponding second seal member 335 without passing through the corresponding advancing chamber 23 and the corresponding retarding chamber 24 to radially outwardly and axially urge the corresponding first seal member 331 and the corresponding second seal member 335. Also, each pressing oil passage 323 guides the hydraulic oil to the corresponding first seal member 310 and the corresponding second seal member 311 without passing through the corresponding advancing chamber 23 and the corresponding retarding chamber 24 to radially outwardly and axially urge the corresponding first seal member 310 and the corresponding second seal member 311.

In the fourteenth embodiment, the first seal members 331, 310 and the second seal members 335, 311 are radially outwardly and axially pressed when the hydraulic oil is supplied to the retarding oil passages 48 through the retarding groove 44. At the time of rotating the engine 90, the cam torque of the camshaft 97 periodically oscillates, i.e., changes between the positive side for exerting the positive cam torque (also referred to as the positive oscillating cam torque) and the negative side for exerting the negative cam torque (also referred to as the negative oscillating cam torque). When the negative oscillating cam torque is increased, the pressure of the hydraulic oil in each retarding oil passage 48 is increased. Thereby, the pressing force, which is applied to the first seal members 331, 310 and the second seal members 335, 311 from the hydraulic oil in the pressing oil passages 322, 323, is increased.

Thus, when the negative oscillating cam torque is exerted to rotate the vane rotor 421 toward the advancing side, the first seal members 331, 310 and the second seal members 335, 311 are urged against the housing 312 and the sprocket 11 with the relatively large force. Thus, the rotation of the vane rotor 421 toward the advancing side is limited. Thus, the vane rotor 421 can be thereafter quickly rotated toward the retarding side.

Fifteenth Embodiment

Figure 61:
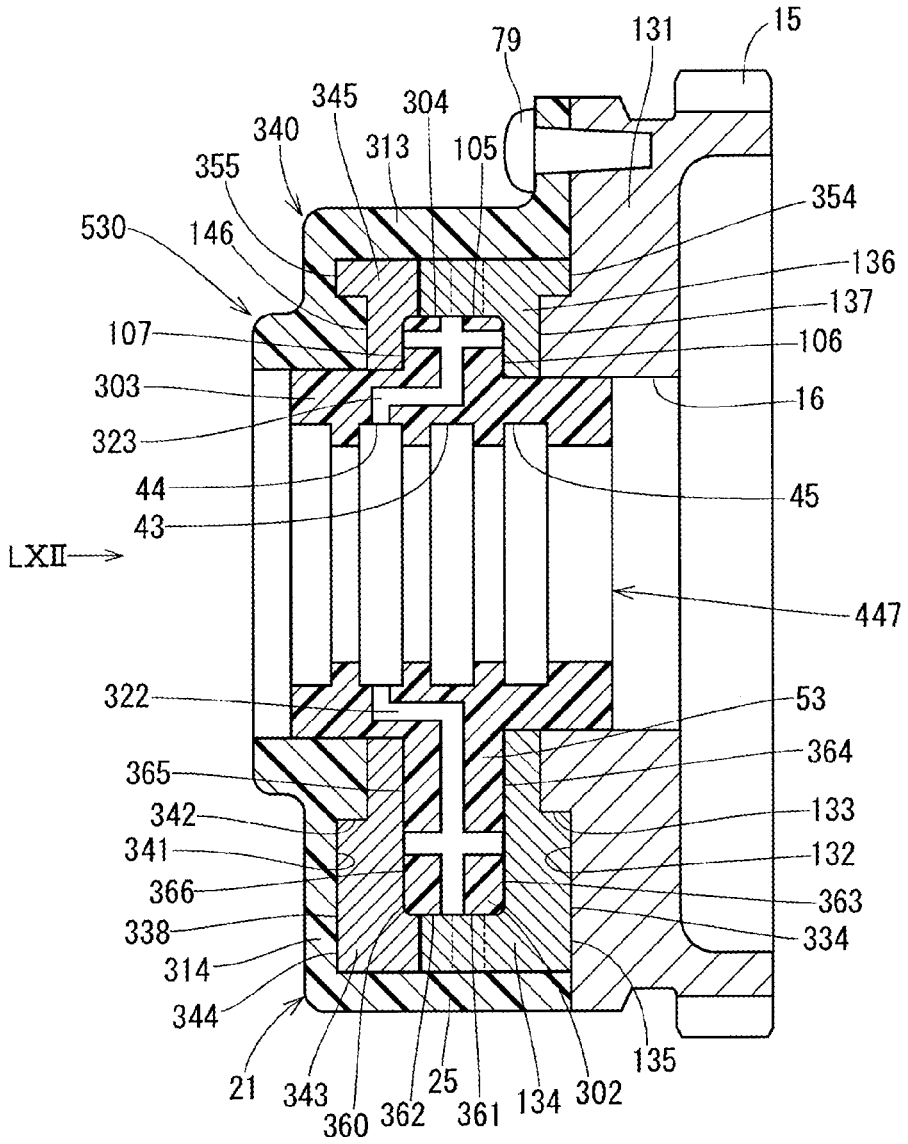
FIG. 61 is a longitudinal cross sectional view of a valve timing control apparatus according to a fifteenth embodiment of the present disclosure.
Figure 62:
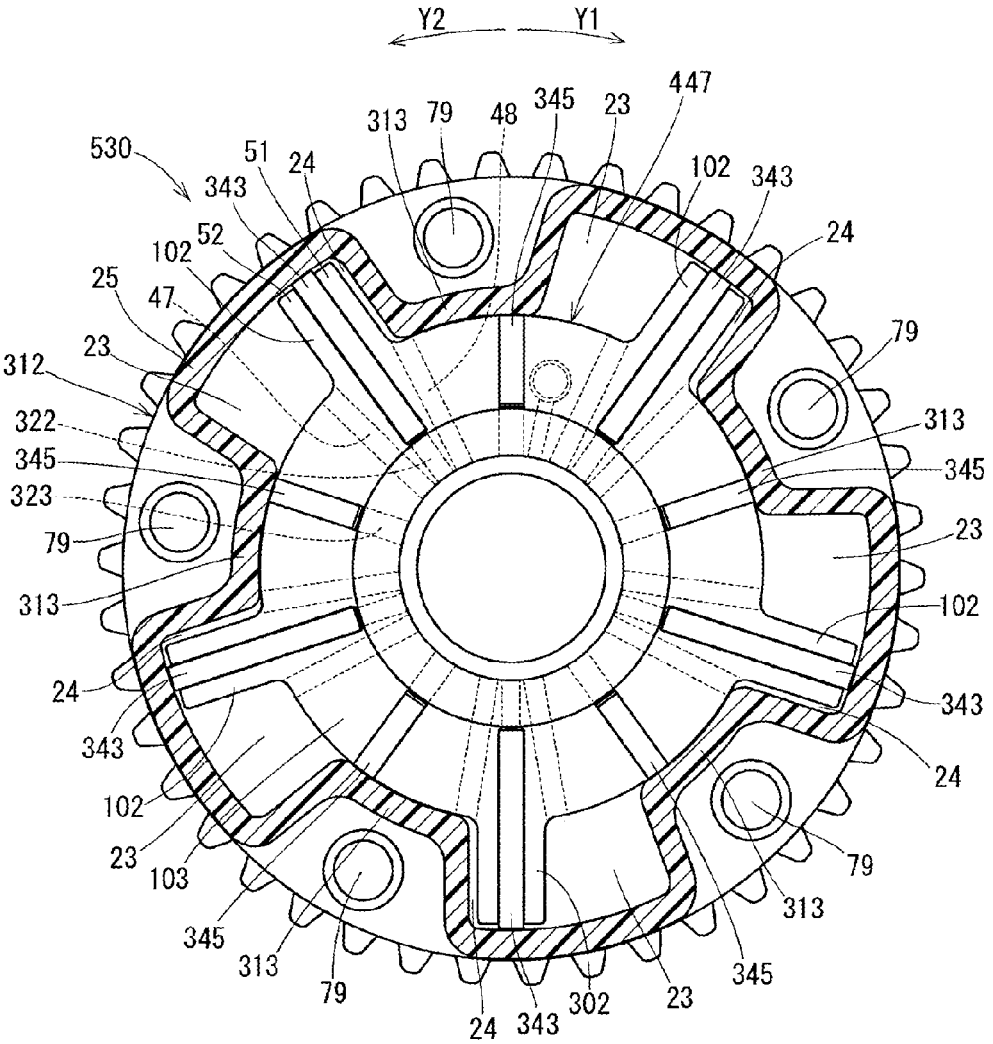
FIG. 62 is a schematic view of the valve timing control apparatus taken from a direction of an arrow LXII in FIG. 61 without depicting the outer shell of the housing.

A valve timing control apparatus according to a fifteenth embodiment of the present disclosure will be described with reference to FIGS. 61 and 62. In the valve timing control apparatus 530, the sprocket 131 includes a plurality of first inner wall surfaces 132, each of which has a bent part (or a curved part) 133. Each of the first inner wall surfaces 132 is axially opposed to the corresponding first seal member 134, 136. Each of the first seal members 134, 136 has a first seal surface 135, 137 that is tightly abuttable against (i.e., can tightly contact) the corresponding first inner wall surface 132 of the sprocket 131 along the entire first seal surface 135, 137.

The housing 340 includes a plurality of second inner wall surfaces 341, each of which has a bent part (or a curved part) 342. Each of the second inner wall surfaces 341 is axially opposed to the corresponding second seal member 343, 345. Each of the second seal members 343, 345 has a second seal surface 344, 146 that is tightly abuttable against (i.e., can tightly contact) the corresponding second inner wall surface 341 of the housing 340 along the entire second seal surface 344, 146.

According to the fifteenth embodiment, each first seal member 134, 136 is urged against the sprocket 131 to seal the corresponding axial gap between the sprocket 131 and the vane rotor 447, and each second seal member 343, 345 is urged against the housing 340 to seal the corresponding axial gap between the housing 340 and the vane rotor 447. Thus, it is possible to form each bent part 133 in the corresponding part of the sprocket 131, which is axially opposed to the corresponding first seal member 134, 136, and it is also possible to form each bent part 342 in the corresponding part of the housing 340, which is axially opposed to the corresponding second seal member 343, 345. Thus, it is possible to achieve a high degree of designing freedom for the sprocket 131 and the housing 340.

Sixteenth Embodiment

Figure 63:
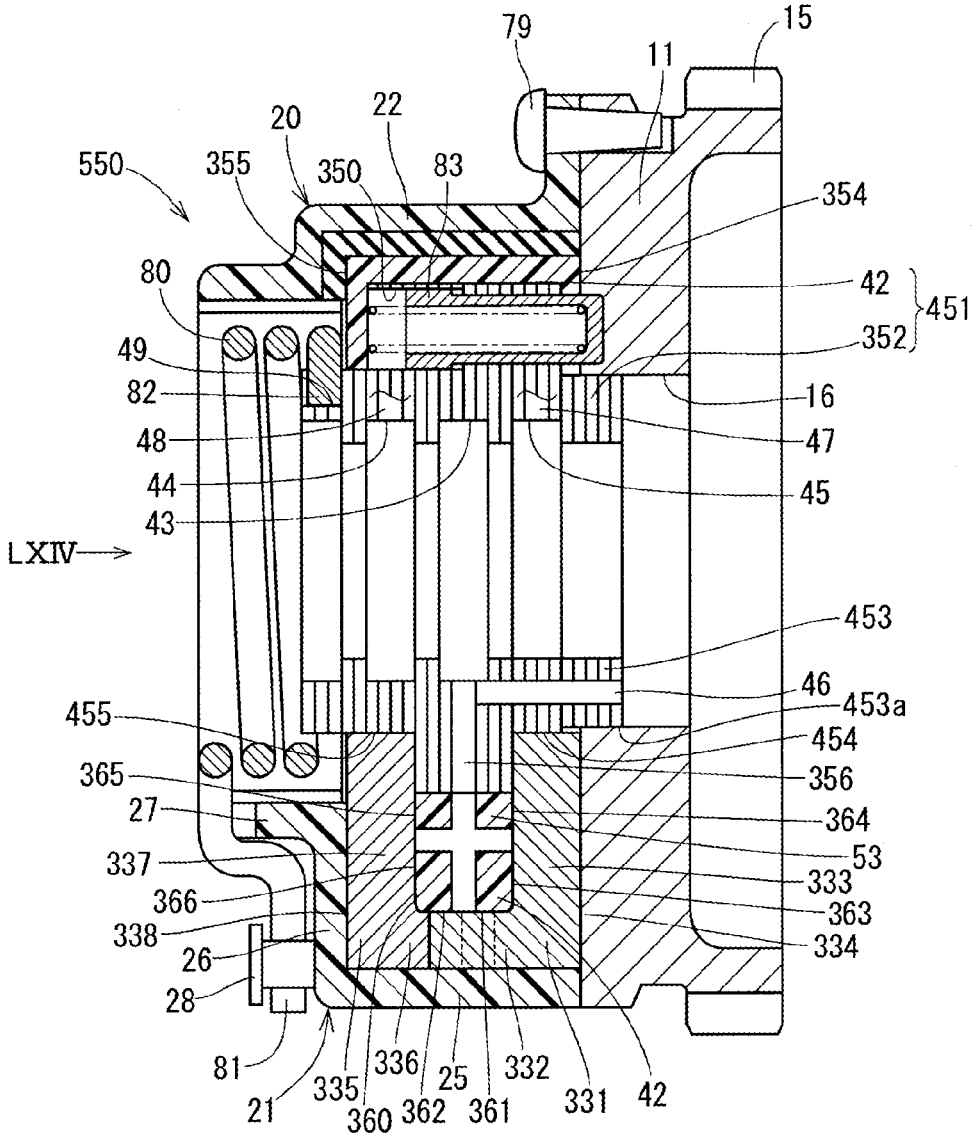
FIG. 63 is a longitudinal cross sectional view of a valve timing control apparatus according to a sixteenth embodiment of the present disclosure.
Figure 64:
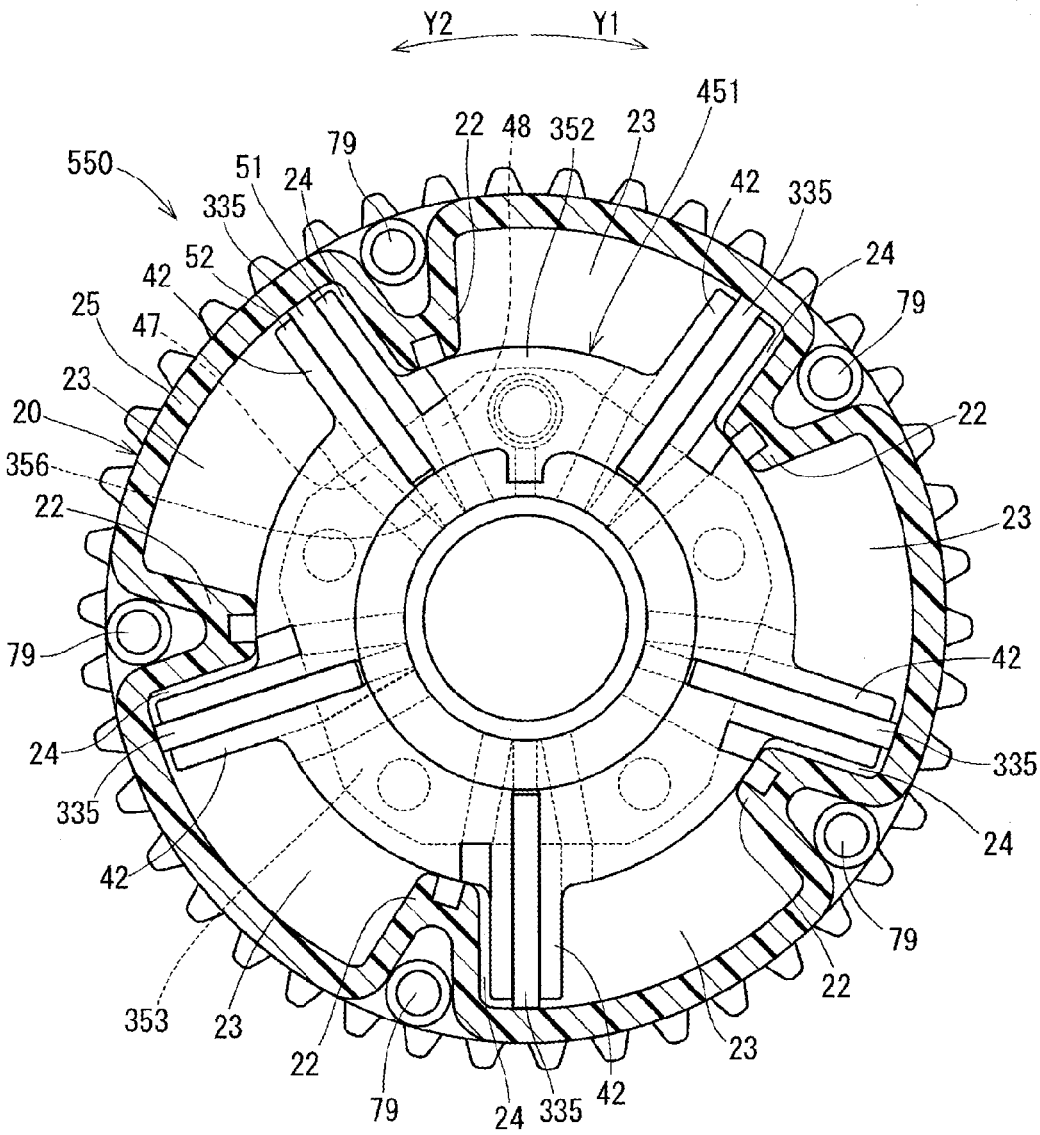
FIG. 64 is a schematic view of the valve timing control apparatus taken from a direction of an arrow LXIV in FIG. 63 without depicting the outer shell of the housing and the assist spring.
Figure 65:
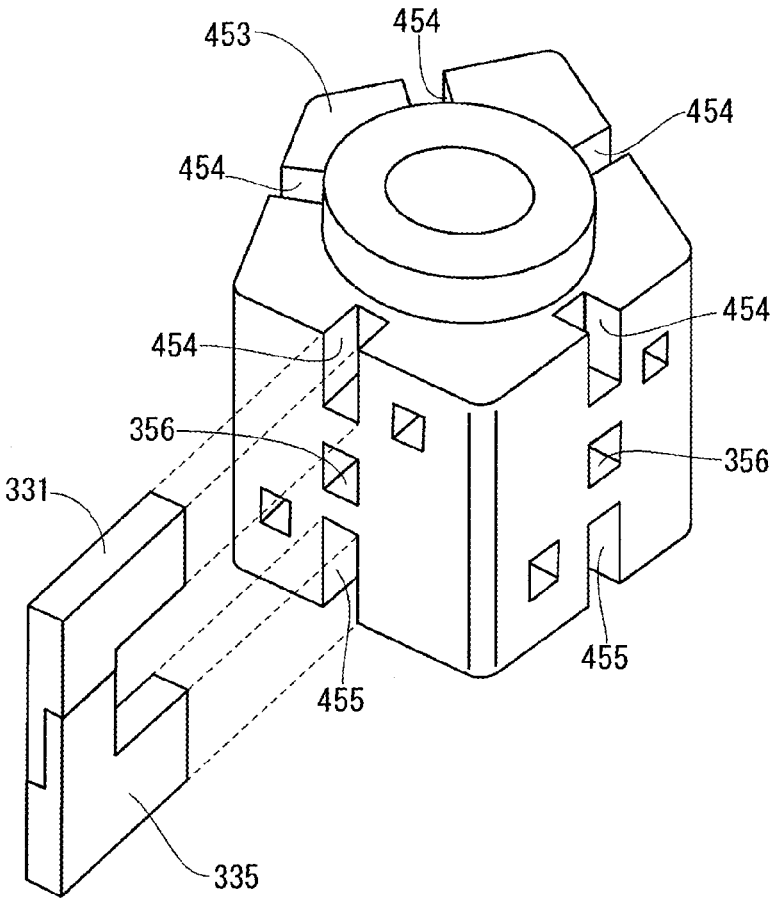
FIG. 65 is a perspective view showing an insert member of a vane rotor of FIG. 63 along with a first seal member and a second seal member.

A valve timing control apparatus according to a sixteenth embodiment of the present disclosure will be described with reference to FIGS. 63 to 65. In the valve timing control apparatus 550, the boss portion 352 of the vane rotor 451 includes a metal insert member 453. The insert member 453 includes a plurality of metal plates 453*a*, which are stacked one after another in the axial direction. The insert member 453 includes a plurality of first guide grooves 454 and a plurality of second guide grooves 455. Each first seal member 331 is fitted into the corresponding first guide groove 454 such that the first seal member 331 is movable in the axial direction and the radial direction relative to the insert member 453 and is not movable in the circumferential direction relative to the insert member 453. Each second seal member 335 is fitted into the corresponding second guide groove 455 such that the second seal member 335 is movable in the axial direction and the radial direction relative to the insert member 453 and the first seal member 331 and is not movable in the circumferential direction relative to the insert member 453.

The vane rotor 451 is molded by filling the resin material in a molten state into the molding die, in which the first seal members 331 and the second seal members 335 are set in advance along with the insert member 453, and thereafter solidifying the filled resin material. The relative movement of each of the first seal members 331 and the second seal members 335 relative to the molded vane rotor 451 is enabled through selection of the material of the vane rotor 451 and application of a releasing process (peeling process) on a boundary surface of each first seal member 331 and a boundary surface of each second seal member 335 at the time of setting the first seal member 331 and the second seal member 335 in the molding die.

In the sixteenth embodiment, the rigidity of each of the vanes 42 of the vane rotor 451 is increased by fitting an end portion of the corresponding first seal member 331 and an end portion of the corresponding second seal member 335 into the insert member 453. Particularly, as discussed above, each first seal member 331 and each second seal member 335 are fitted into the insert member 453 in a manner that disables the movement of the first seal member 331 and the second seal member 335 in the circumferential direction, so that the rigidity of each vane 42 of the vane rotor 451 is relatively high in the circumferential direction.

Furthermore, in the sixteenth embodiment, the insert member 453 includes the first guide grooves 454, each of which guides the corresponding first seal member 331 in the axial direction and the radial direction, and the second guide grooves 455, each of which guides the corresponding second seal member 335 in the axial direction and the radial direction. Therefore, each first seal member 331 and each second seal member 335 can be moved in the axial direction and the radial direction.

Now, modifications of the twelfth to sixteenth embodiments will be described.

In a modification of the twelfth to sixteenth embodiments, the number of opening(s) of the pressing oil passage(s) may be one, two, four or more.

In another modification of the twelfth to sixteenth embodiments, the pressing oil passage(s) may be formed to have two or more paths. That is, the pressing oil passage(s) may be only required to have the function of guiding the hydraulic oil, which is supplied from the outside, to the corresponding first seal member and the corresponding second seal member without passing through the advancing chamber and the retarding chamber.

In another modification of the twelfth to sixteenth embodiments, each of the number of the partitions of the housing and the number of the vanes of the vane rotor may be four or smaller or alternatively six or larger.

In another modification of the twelfth to sixteenth embodiments, the shape of each first seal member may differ from the shape of each second seal member. For example, the length of the second peripheral wall section of each second seal member may be shorter than the length of the first peripheral wall section of each first seal member. Furthermore, one of the first seal member and the second seal member may be configured into the L-shape, and the other one of the first seal member and the second seal member may be configured into an I-shape.

In another modification of the twelfth to sixteenth embodiments, the width of the other axial end part of the first peripheral wall section, i.e., the part of the first peripheral wall section, which is engaged with the second seal member, may be smaller or larger than the width of the center part of the first peripheral wall section 332.

In another modification of the twelfth to sixteenth embodiments, each first seal member may not radially extend to the radially inner end of the slide wall of the vane rotor, along which the sprocket is slidable. Furthermore, each second seal member may not radially extend to the radially inner end of the slide wall of the vane rotor, along which the bottom section of the housing is slidable.

In another modification of the twelfth to sixteenth embodiments, each first seal member and each second seal member may be provided only in the boss portion of the vane rotor.

In another modification of the twelfth to sixteenth embodiments, the vane rotor may be made of another material (e.g., a metal material), which is other than the resin material. Furthermore, each first seal member and each second seal member may be made of the material, which is the same as the material of the vane rotor. Furthermore, each first seal member and each second seal member may be made of another material (e.g., a resin material), which is other than the metal material. Furthermore, the material of each second seal member may be the same as the material of each first seal member.

In another modification of the twelfth to sixteenth embodiments, each first seal member and each second seal member may be installed to the vane rotor after the completion of the molding process of the vane rotor.

In another modification of the twelfth to sixteenth embodiments, each first seal member and each second seal member may have a bent part at one axial side thereof. Furthermore, the bent part may be formed in one of the first seal member and the second seal member.

In another modification of the twelfth to sixteenth embodiments, the slide surfaces of the first seal member and the second seal member may not be surface treated through the surface-treating process.

In another modification of the twelfth to sixteenth embodiments, the sprocket may be made of another material (e.g., a resin material), which is other than the metal material.

In another modification of the twelfth to sixteenth embodiments, the oil passage change valve may be placed at the outside of the valve timing control apparatus rather than the inside of the valve timing control apparatus.

In another modification of the twelfth to sixteenth embodiments, it is not required to form the external teeth, which are connected to the crankshaft, in the sprocket. That is, the external teeth, which are connected to the crankshaft, may be formed in a cover that closes an opening of the housing.

In another modification of the twelfth to sixteenth embodiments, the rotation of the crankshaft of the engine may be transmitted to the housing through another type of drive force transmission member, which is other than the chain.

In addition, any one or more components of any one of the first to sixteenth embodiments may be combined with any one or more components of any other one or more of the first to sixteenth embodiments.

The present disclosure is not limited the above embodiments and modifications thereof. That is, the above embodiments and modifications thereof may be modified in various ways without departing from the spirit and scope of the present disclosure.

What is claimed is:

1. A valve timing control apparatus, which controls opening timing and closing timing of one of an intake valve and an exhaust valve of an internal combustion engine, which is driven by a driven-side shaft of the internal combustion engine, through changing of a rotational phase between a driving-side shaft of the internal combustion engine and the driven-side shaft, the valve timing control apparatus comprising:

a first housing that is rotatable integrally with one of the driving-side shaft and the driven-side shaft;

a second housing that is fixed to the first housing and forms a plurality of pressurization compartments in cooperation with the first housing;

a vane rotor that includes:

a boss portion that is rotatable integrally with the other one of the driving-side shaft and the driven-side shaft and is placed in one of the first housing and the second housing; and a plurality of vanes, each of which radially extends from the boss portion to partition a corresponding one of the plurality of pressurization compartments into an advancing chamber and a retarding chamber;

a first seal member that is placed between the first housing and the vane rotor and is radially and axially movable relative to the vane rotor; and a second seal member that is placed between the second housing and the vane rotor and is radially and axially movable relative to the vane rotor and the first seal member, wherein:

the vane rotor includes a pressing oil passage that opens in a contact surface of the vane rotor, which is abuttable against the first seal member, and also opens in a contact surface of the vane rotor, which is abuttable against the second seal member; and the pressing oil passage is configured to guide hydraulic oil, which is received from an outside of the valve timing control apparatus, to the first seal member and the second seal member without passing through the advancing chambers and the retarding chambers of the plurality of pressurization compartments to exert a pressing force, which radially outwardly and axially urge the first seal member and the second seal member.

2. The valve timing control apparatus according to claim 1, wherein:

the first seal member radially extends to a radially inner end of a slide wall of the vane rotor, along which the first housing is slidable; and the second seal member radially extends to a radially inner end of a slide wall of the vane rotor, along which the second housing is slidable.

3. The valve timing control apparatus according to claim 1, wherein:

the first seal member is configured into an L-shape and has:

a first peripheral wall section that axially extends and is abuttable against an outer peripheral wall surface of the vane rotor; and a first side wall section that radially inwardly extends from one axial end part of the first peripheral wall section, which is located on an axial side where the first housing is located, wherein the first side wall section is abuttable against one axial side wall surface of the vane rotor;

the second seal member is configured into an L-shape that is substantially the same as the L-shape of the first seal member and has:

a second peripheral wall section that axially extends and is abuttable against the outer peripheral wall surface of the vane rotor; and a second side wall section that radially inwardly extends from one axial end part of the second peripheral wall section, which is located on an axial side where the second housing is located, wherein the second side wall section is abuttable against the other axial side wall surface of the vane rotor, which is axially opposite from the one axial side wall surface of the vane rotor; and the other axial end part of the first peripheral wall section, which is axially opposite from the one axial end part of the first peripheral wall section, is circumferentially overlapped with the other axial end part of the second peripheral wall section, which is axially opposite from the one axial end part of the second peripheral wall section.

4. The valve timing control apparatus according to claim 1, wherein:

the vane rotor includes:

a supply oil passage that is configured to receive the hydraulic oil from the outside;

at least one advancing oil passage that is communicated with the advancing chambers of the plurality of pressurization compartments; and at least one retarding oil passage that is communicated with the retarding chambers of the plurality of pressurization compartments;

the valve timing control apparatus further comprises an oil passage change valve, which is shiftable to enable and disable communication of the supply oil passage to the at least one advancing oil passage and also communication of the supply oil passage to the at least one retarding oil passage; and the pressing oil passage is directly communicated with the supply oil passage.

5. The valve timing control apparatus according to claim 1, wherein:

the valve timing control apparatus controls the opening timing and closing timing of the intake valve;

the vane rotor includes:

at least one advancing oil passage that is configured to supply the hydraulic oil, which is received from the outside, to the advancing chambers of the plurality of pressurization compartments; and at least one retarding oil passage that is configured to supply the hydraulic oil, which is received from the outside, to the retarding chambers of the plurality of pressurization compartments; and the pressing oil passage is directly communicated with the at least one advancing oil passage.

6. The valve timing control apparatus according to claim 1, wherein:

the valve timing control apparatus controls the opening timing and closing timing of the exhaust valve;

the vane rotor includes:

at least one advancing oil passage that is configured to supply the hydraulic oil, which is received from the outside, to the advancing chambers of the plurality of pressurization compartments; and at least one retarding oil passage that is configured to supply the hydraulic oil, which is received from the outside, to the retarding chambers of the plurality of pressurization compartments; and the pressing oil passage is directly communicated with the at least one retarding oil passage.

7. The valve timing control apparatus according to claim 1, wherein:

the first seal member is one of a plurality of first seal members, which are respectively provided to the plurality of vanes and a plurality of corresponding locations of the boss portion; and the second seal member is one of a plurality of second seal members, which are respectively provided to the plurality of vanes and the plurality of corresponding locations of the boss portion.

8. The valve timing control apparatus according to claim 1, wherein a material of the second seal member differs from a material of the first seal member.

9. The valve timing control apparatus according to claim 1, wherein:

the first housing includes a first inner wall surface that has a bent part or a curved part, which is axially opposed to the first seal member;

the first seal member has a first seal surface that is tightly abuttable against the first inner wall surface of the first housing;

the second housing includes a second inner wall surface that has a bent part or a curved part, which is axially opposed to the second seal member; and the second seal member has a second seal surface that is tightly abuttable against the second inner wall surface of the second housing.

10. The valve timing control apparatus according to claim 1, wherein:

a slide surface of the first seal member, which is slidable relative to the first housing, is surface treated; and a slide surface of the second seal member, which is slidable relative to the second housing, is surface treated.

11. The valve timing control apparatus according to claim 1, wherein:

the vane rotor is made of a resin material;

the first seal member is made of a material, which is different from the resin material of the vane rotor; and the second seal member is made of a material, which is different from the resin material of the vane rotor.

12. The valve timing control apparatus according to claim 1, wherein the first seal member is made of metal material, and the second seal member is made of a metal material.

13. The valve timing control apparatus according to claim 1, wherein:

the first seal member is one of a plurality of first seal members;

the second seal member is one of a plurality of second seal members; and each of the plurality of vanes includes:

a first vane section that radially outwardly extends from the boss portion;

a second vane section that radially outwardly extends from the boss portion; and a connecting section that connects between the first vane section and the second vane section and has a corresponding one of the plurality of first seal members and a corresponding one of the plurality of second seal members, which are placed on an outer side of the connecting section.

14. The valve timing control apparatus according to claim 1, wherein the vane rotor is molded from a resin material by filling the resin material in a molten state into a molding die, in which the first seal member and the second seal member are set in advance, and thereafter solidifying the resin material.

15. The valve timing control apparatus according to claim 14, wherein:

the boss portion of the vane rotor has an insert member made of a metal material; and the insert member includes:

a first guide groove, in which the first seal member is fitted such that the first seal member is axially and radially moveable relative to the insert member; and a second guide groove, in which the second seal member is fitted such that the second seal member is axially and radially movable relative to the insert member.

* * * * *